US012104865B2

(12) United States Patent
Heusser

(10) Patent No.: US 12,104,865 B2
(45) Date of Patent: Oct. 1, 2024

(54) HEAT EXCHANGER

(71) Applicant: Promix Solutions AG, Winterthur (CH)

(72) Inventor: Rolf Heusser, Winterhur (CH)

(73) Assignee: Promix Solutions AG, Winterthur (CH)

( * ) Notice: Subject to any disclaimer, the term of this patent is extended or adjusted under 35 U.S.C. 154(b) by 736 days.

(21) Appl. No.: 17/096,653

(22) Filed: Nov. 12, 2020

(65) Prior Publication Data

US 2021/0148650 A1 May 20, 2021

(30) Foreign Application Priority Data

Nov. 14, 2019 (EP) ..... 19209037

(51) Int. Cl.
*F28F 3/12* (2006.01)
*F28F 3/08* (2006.01)

(52) U.S. Cl.
CPC ..... *F28F 3/12* (2013.01); *F28F 3/086* (2013.01)

(58) Field of Classification Search
CPC .... F28D 7/0066; F28D 7/1623; F28D 7/0058; F28F 2009/228; B01F 35/93; F02B 29/04
See application file for complete search history.

(56) References Cited

U.S. PATENT DOCUMENTS 1,769,994 A * 7/1930 Hendryx ..... F28F 13/08 126/109
3,203,475 A * 8/1965 Crews ..... F28F 27/00 165/300
6,103,118 A * 8/2000 Ter Meulen ..... B01D 63/043 210/321.89
6,412,975 B1 * 7/2002 Schuchardt ..... B01F 25/43161 366/337
2010/0101755 A1 * 4/2010 Morini ..... F28F 1/04 165/53

(Continued)

FOREIGN PATENT DOCUMENTS

DE 29618460 U1 9/1997
DE 19953612 A1 5/2001

(Continued)

OTHER PUBLICATIONS

Heusser Rolfm Method for the manufacture of a tube, 2019, English translation (Year: 2019).*

(Continued)

*Primary Examiner* — Tho V Duong
(74) *Attorney, Agent, or Firm* — Hard IP LLC

(57) ABSTRACT

A heat exchanger comprises a jacket element and an insert element, the jacket element forming a fluid channel for a fluid to be tempered, a flowable medium or a fluid mixture. The insert element is arranged in the fluid channel. The insert element contains a plurality of web elements which are connected to the jacket element at different locations. At least some of the web elements contain web element passages which are in fluid-conducting connection with the jacket element so that, in the operating state, a heat transfer fluid which is fed to the jacket element can flow through the web elements, wherein the jacket element contains a plurality of chambers for a heat transfer fluid, wherein at least one of the chambers is disposed with a plurality of inlet openings and outlet openings for the heat transfer fluid.

19 Claims, 11 Drawing Sheets

(56) References Cited

U.S. PATENT DOCUMENTS

| | | | | |
|---|---|---|---|---|
| 2011/0185714 | A1* | 8/2011 | Lohbreyer | F28D 7/163 60/320 |
| 2014/0262166 | A1* | 9/2014 | Xu | F28F 9/187 165/121 |
| 2015/0083375 | A1* | 3/2015 | Heusser | F28F 13/125 29/890.03 |

FOREIGN PATENT DOCUMENTS

| | | | |
|---|---|---|---|
| EP | 0004081 | A2 | 9/1979 |
| EP | 1123730 | A2 | 8/2001 |
| EP | 2851118 | A1 | 3/2015 |
| EP | 3431911 | A1 | 1/2019 |
| EP | 3444097 | A2 | 2/2019 |
| EP | 3489603 | A1 | 5/2019 |
| GB | 971334 | A | 9/1964 |
| NL | 1027948 | C2 | 7/2006 |
| WO | 2018/023101 | A1 | 2/2018 |

OTHER PUBLICATIONS

European search report for EP 19 20 9037 dated May 5, 2020, 2 pages.
European search report for EP 20207057 dated Feb. 25, 2021, 2 pages.

* cited by examiner (Sect. A-A)

HEAT EXCHANGER

CROSS-REFERENCE TO RELATED APPLICATION

This application claims the benefit of European patent application no. EP 19209037.1, filed Nov. 14, 2019, the contents of which are hereby incorporated by reference in their entirety.

BACKGROUND

The invention relates to a jacket element for a heat exchanger for adjusting the temperature of a fluid. The jacket element of the heat exchanger is intended to receive a heat transfer fluid. The jacket element forms a circumferentially closed fluid passage for a fluid which flows through the heat exchanger when in use and which is heated or cooled by the heat exchange with the jacket element.

To improve the heat transfer, such a jacket element is often configured as a double jacket. The double jacket represents a chamber through which a heat transfer fluid can flow.

DESCRIPTION OF RELATED ART

For example, document EP 3 444 097 A2 shows a cooling element and a mixing element for a plastic melt. The plastic melt is mixed by means of the known mixing element and the plastic melt is cooled by means of the cooling element. The cooling element has a double jacket to divert the wall flow, i.e. to cool the plastic melt flowing near the inner wall of the jacket element. When the plastic melt hits the mixing element which protrudes into the core flow and has a corresponding guide element for this purpose, the wall flow and the core flow can be mixed with one another. The plastic melt flowing along the wall is deflected by the guide element in such a way that it is introduced into the core flow, which enables heat to be exchanged between the cooled wall flow and the core flow.

If the heat transfer via the double jacket is not sufficient for temperature adjustment of the fluid, webs can be provided, as shown in EP 2851118 A1, through which the heat transfer fluid in the double jacket can flow. The webs are arranged in such a way that they traverse the fluid passage. The webs contain channels for the heat transfer fluid, which are in fluid-conducting connection with the chamber formed by the double jacket. It has been found that the heat transfer between the fluid and the heat transfer fluid can be improved with these webs. In addition, a mixing effect can be obtained by means of the webs, which means that, for example, a fluid consisting of several components can additionally be mixed by the webs designed as mixer inserts, which improves the mixing effect compared to conventional tube bundle heat exchangers, see for example DE 199 53 612 A1. Such web elements are also used in EP 3 489 603 A1. For the cooling of bulk goods, cooling channels in the form of tubes with a circular cross-section according to WO2018/023101 A1 or EP 1 123 730 A2 or in the form of tubes with a square cross-section according to DE 296 18 460 U1 or in the form of cooling channels with a zig-zag cross-sectional shape according to EP 0 004 081 A2 can be provided. It is also known from EP 3 431 911 A1 to arrange multiply branched hollow structures consisting of pipe pieces in a pipe. The hollow structures are traversed by a heat transfer fluid, for example oil, and a compressible fluid, for example air, flows around the hollow structures.

In all of the previously known solutions that show fluid-conducting web elements or tubes, the heat transfer fluid is distributed to the web elements or tubes via a distribution channel and passes from the web elements or tubes into a collecting channel. The distribution channel thus contains only one single feed and the inlet openings for the web elements, the collector channel contains all the discharge openings of the web elements and one single discharge.

It has been shown, however, that the heat transfer fluid flowing through the web elements or tubes flows through the webs at manifestly different speeds. The inlet openings of the web elements are arranged in the distribution channel at different distances from the feed according to this design. The outlet openings of the web elements are arranged in the collector channel at different distances from the discharge according to this design. Due to the structural arrangement of the inlet openings in the distributor channel or the outlet openings in the collector channel, different flow velocities result for the heat transfer fluid. Therefore, with an increase in the number of web elements, as shown for example in EP 1 123 730 A2, or an enlargement of the cross-section of the web elements through which fluid flows, as disclosed in EP 0 004 081 A2 a further improvement in the heat transfer cannot necessarily be achieved with an increase in the number of web elements, because the design-related different distances and thus the different flow velocities are retained even if the web elements increase or the cross-section of the web elements through which the fluid flows is increased. In addition, the fact that the heat transfer fluid in the previously known constructions in the web elements is heated to different degrees during cooling or cools to different degrees during heating also has a negative effect on the heat transfer.

It is therefore an object of the invention to ensure that the heat transfer fluid flows evenly through all of the chambers and the web element channels. In addition, it is an object of the invention to keep the pressure loss of the heat transfer fluid flowing through the web elements as low as possible or to reduce it to the lowest possible value in order to reduce energy costs for conveying means and/or pressure increasing means, for example for pumps.

SUMMARY OF THE INVENTION

If the term "for example" is used in the following description, this term relates to exemplary embodiments and/or variants, which is not necessarily to be understood as a more preferred application of the teaching of the invention. The terms "preferably", "preferred" are to be understood in a similar manner by referring to an example from a set of exemplary embodiments and/or variants, which is not necessarily to be understood as a preferred application of the teaching of the invention. Accordingly, the terms "for example", "preferably" or "preferred" can relate to a plurality of exemplary embodiments and/or variants.

The following detailed description contains various exemplary embodiments for a heat exchanger. The description of a specific heat exchanger is to be regarded as exemplary only. In the description and claims, the terms "contain", "comprise", "have" are interpreted as "including, but not limited to".

If the term "fluid" is used in the following description, this term also stands for "flowable medium" or "fluid mixture".

The object of the invention is achieved by a heat exchanger which comprises a jacket element and an insert element, the jacket element forming a fluid channel for a fluid, a flowable medium or a fluid mixture to be adjusted in temperature. The insert element is arranged in the fluid channel. The insert element contains a plurality of web elements which are connected to the jacket element at different locations. The web elements are arranged in at least two web element sets, the web elements of each web element set being arranged essentially parallel to one another. The angles which the web elements of different web element sets enclose with the longitudinal axis of the heat exchanger differ at least in part. At least some of the web elements contain web element passages which are in fluid-conducting connection with the jacket element, so that in the operating state a heat transfer fluid, which is supplied to the jacket element, can flow through the web element passages of the web elements. The jacket element contains a plurality of chambers for a heat transfer fluid. At least one of the chambers contains a plurality of inlet openings and at least two outlet openings or a plurality of outlet openings and at least two inlet openings for the heat transfer fluid. Thus, at least one of the chambers has a plurality of inlet openings and outlet openings. In particular, at least two chambers can be provided which contain a plurality of inlet openings and at least two outlet openings. Thus, at least one of the chambers has a plurality of inlet openings and outlet openings. In particular, at least two chambers have a plurality of inlet openings and outlet openings.

In particular, at least a first and a second set of web elements can be provided. The web elements of the first web element set are aligned parallel to one another, that is to say the web elements of the first web element set have the same orientation to one another. The web elements of the second web element set are aligned parallel to one another, that is to say the web elements of the second web element set have the same orientation to one another. The alignment of the web elements of the first web element set differs from the alignment of the web elements of the second web element set.

Of course, any number of first web element sets and second web element sets can be provided. Each of the first and second web element sets can contain a different number of web elements. The number of web elements of each web element set can in particular be at least two. Of course, more than two web element sets can be provided, the web elements of each of the web element sets having the same alignment with one another, but having a different alignment with respect to the web elements of every other web element set. For example, the web elements of three web element sets can be aligned according to FIG. 10 of EP 1 123 730 A2.

The inlet openings and the outlet openings, which are located in the same chamber, are preferably associated with web elements of different web element sets. The distance that the fluid travels between the inlet opening and the closest outlet opening in the same chamber is smaller than the distance between two inlet openings of adjacent, co-aligned web element sets. This ensures that the residence time of the heat transfer fluid in the chamber in the jacket element is as short as possible, since it can flow directly from the outlet opening into the nearest inlet opening. Therefore, inlet openings and outlet openings of different of web element sets are advantageously combined in a common chamber, the distance of which is smaller than the distance between the inlet openings of adjacent web element sets in the same direction.

In particular, at least some of the web elements that are provided with web element passages and lead to the entry of the chamber do not run parallel to one another, and at least some of the web elements that are provided with web element passages and lead out of the chamber do not run parallel to one another. The heat transfer fluid which flows through the web element passages thus has a different temperature depending on the orientation of the web elements. The fluid that flows around the web elements is thus exposed to locally different temperatures. Since the fluid flows around the web elements, this fluid is continually divided and rearranged, which leads to its mixing. If the fluid is exposed to different temperatures depending on the orientation of the web elements, these temperature differences can quickly equalize each other through the mixing action of the web elements, because the fluid is better mixed, which in turn has an advantageous effect on the heat exchange.

In particular, an inlet for the heat transfer fluid can be provided in the jacket element. In particular, a drain for the heat transfer fluid can be provided in the jacket element. According to an embodiment, the jacket element has at least three chambers for the heat transfer fluid. The heat transfer fluid can be mixed and redistributed in at least the chambers which contain a plurality of inlet openings and a plurality of outlet openings. These chambers are thus designed as mixing chambers for the heat transfer fluid.

According to an embodiment, at least some of the chambers can be at least partially separated from one another by partition walls. According to an embodiment, at least one of the chambers contains a partition wall.

According to an embodiment, at least one of the chambers is connected to a further chamber via the web element passages. In particular, the inlet openings and/or outlet openings of different chambers can be at least partially connected to one another via web elements which run through the fluid channel. According to this exemplary embodiment, at least part of the heat transfer fluid thus flows sequentially through several mixing chambers. The heat transfer fluid can be remixed and distributed in each of the chambers, which have a plurality of inlet openings and a plurality of outlet openings. In particular, it is possible for the heat transfer fluid to flow transversely or against the direction of flow of the fluid.

According to an embodiment, each of the chambers can extend over part of the circumference of the jacket element. This allows several chambers to be arranged next to one another on the circumference of the jacket element. A cross flow of the heat transfer fluid with respect to the direction of flow of the fluid results when the heat transfer fluid flows through these adjacent chambers sequentially.

According to an embodiment, the width of the chamber which contains the plurality of inlet openings and the at least two outlet openings or the plurality of outlet openings and the at least two inlet openings can be at most equal to its length. In particular, the length of the chamber can be greater than its width. According to an embodiment, the width of the chamber is at most half of its length. According to this exemplary embodiment, the length of the chamber is measured parallel to the longitudinal axis of the heat exchanger. The width of the chamber is measured in a normal plane with respect to the longitudinal axis of the heat exchanger. A normal plane is intended to refer to a plane which is arranged at a right angle, that is to say at an angle of 90 degrees, to the longitudinal axis of the heat exchanger. The width can extend along a straight line if the heat exchanger is rectangular. The width of the chamber can also extend along a line of curvature, for example be designed as a segment of a circle if the heat exchanger is designed as a cylinder.

According to an embodiment, the length of at least one of the chambers can correspond to the length of the jacket element. If the heat transfer fluid is fed to a chamber via an inlet which is arranged at a smaller distance from the outlet opening of the heat exchanger than from the inlet opening, the heat transfer fluid can flow against the direction of flow of the fluid.

According to an embodiment, at least some of the web elements are oriented at an angle other than 90 degrees to the longitudinal axis of the heat exchanger. The longitudinal axis of the heat exchanger corresponds to the main flow direction of the fluid. In particular, the angle of the web elements can differ from one another, in particular at least one first web element can be arranged crosswise to a second web element.

According to an embodiment, a chamber has at least two inlet openings and at least two outlet openings. According to one embodiment, a chamber has at least four inlet openings and/or at least four outlet openings. In particular, a chamber has at least four inlet openings and at least four outlet openings.

According to an embodiment, at least one of the chambers covers at least 10 to 80% of the surface of the jacket element. According to an embodiment, all chambers cover at least 10 to 80% of the surface of the jacket element. According to an embodiment, all chambers cover at least 50% to 80% of the surface of the jacket element.

According to an embodiment, one of the chambers has a width that is 10% to 100% of the circumference of the jacket element. According to an embodiment, one of the chambers has a width that is 50% to 100% of the circumference of the jacket element. According to an embodiment, one of the chambers has a width that is 70% to 100% of the circumference of the jacket element.

Each of the chambers can have a length and a width and a height. The length of the chamber is its dimension parallel to the direction of flow of the fluid, that is, parallel to the longitudinal axis of the heat exchanger. The width of the chamber is the dimension transverse to the direction of flow of the fluid, i.e. the dimension of the chamber, measured in a normal plane to the longitudinal axis of the heat exchanger, in other words, the normal plane is arranged at a right angle to the longitudinal axis of the heat exchanger. The height of the chamber corresponds to the distance between the outer wall of the jacket element and the inner wall of the jacket element. The ratio of the width of a chamber to the length of the chamber can in particular be a maximum of two. That is to say, according to this embodiment, the width of the chamber is at most twice as large as its length. In particular, the ratio of the width of a chamber to the length of the chamber can be a maximum of one. This means that the width of the chamber is essentially as large as its length. The ratio of the width of a chamber to the length of the chamber can in particular be a maximum of 0.5. In other words, according to this embodiment, the width of the chamber is at most half as large as its length.

According to an embodiment, the heat transfer fluid can flow through a plurality of chambers, for example at least one of the chambers can be connected in a fluid-conducting manner to at least one of the further chambers through openings in at least one of the partition walls. In particular, the heat transfer fluid can flow through more than two or more than three chambers; the chambers can be connected to one another via the web element passages and/or via openings in the partition walls.

According to an embodiment, the inlet openings and the outlet openings which are located in the same chamber belong at least partially to web elements of different web element sets. In particular, at least some of the web elements which are provided with web element passages and do not lead into the chamber run parallel to one another. In particular, at least some of the web elements which are provided with web element passages and which lead out of the chamber do not run parallel to one another.

A method for temperature adjustment of a fluid, flowable medium or fluid mixture comprises adjusting the temperature of the fluid by means of a heat exchanger, the heat exchanger comprising a jacket element and an insert element, wherein the fluid flows in a fluid channel enclosed by the jacket element. The insert element is arranged in the fluid channel, wherein the insert element contains a plurality of web elements which are connected to the jacket element at different locations. The web elements are arranged in at least two web element sets, wherein the web elements of each web element set are arranged essentially parallel to one another. The angle which the web elements of different web element sets enclose with the longitudinal axis of the heat exchanger differ at least in part. At least some of the web elements contain web element passages which are in fluid-conducting connection with the jacket element, so that in the operating state a heat transfer fluid, which is supplied to the jacket element, can flow through the web elements. The jacket element comprises a plurality of chambers for a heat transfer fluid, wherein at least one of the chambers has a plurality of inlet openings and/or outlet openings for the heat transfer fluid.

In particular, the inlet openings and/or outlet openings of different chambers can be connected to one another via web elements that run through the fluid channel, so that heat can be transferred between the heat transfer fluid and the fluid via the inner wall of the jacket element and the web elements.

According to different variants of the method, the heat transfer fluid flows through the chambers and/or the web element channels in the direction of flow of the fluid and/or against the direction of flow of the fluid and/or transversely to the direction of flow of the fluid.

According to a variant of the method, the heat transfer fluid flows from an outlet opening of one of the chambers to an inlet opening in another chamber through a web element passage which is arranged in a web element which is arranged in the fluid channel. In particular, at least one of the inlet openings and one of the outlet openings of a chamber can be arranged in such a way that the heat transfer fluid flows in the chamber in a direction transverse to the main flow direction of the fluid, wherein the main flow direction of the fluid corresponds to the longitudinal axis of the heat exchanger.

According to a variant of the method, the heat transfer fluid can flow in the chamber essentially along the straight connecting line between the midpoints of the inlet openings leading into the chamber and the midpoints of the outlet openings leading out of the chamber, wherein the straight connecting line is arranged at an angle to the center axis of the web element passage, the angle being in the range from 30 degrees up to and including 160 degrees.

In particular, the heat transfer fluid can flow in the web element passages in the direction of flow or against the direction of flow of the fluid.

The invention thus relates to a heat exchanger which can be produced inexpensively and which can also be used as a static mixer or as a static mixer which can also be configured also as a heat exchanger or which can include the function of a heat exchanger. The heat exchanger is particularly suitable for cooling or heating flowable media, for example fluids, wherein the fluids can include, for example, viscous or highly viscous fluids, in particular polymers. If such a device is used for processing highly viscous fluids, for example polymer melts, the static mixers employed typically have to withstand nominal pressures of 50 to 400 bars and temperatures of 50 to 300 degrees Celsius.

Heat exchangers are used in many areas of the processing industry. According to an embodiment, a flowable medium can be moved over at least one stationary insert element. The insert element usually contains built-in elements which deflect the fluid flow or the flowable medium that is guided through the interior of the insert element, which is delimited by an insert jacket element. A heat transfer fluid flows through the insert elements. When the flowable medium flows through the insert element a pressure gradient is created. The pressure gradient can be generated, for example, by using pumps.

BRIEF DESCRIPTION OF THE DRAWINGS

The heat exchanger according to the invention is illustrated below for some exemplary embodiments. It is shown in FIG. 1*a* a view of a heat exchanger according to a first embodiment, FIG. 1*b* a view of the heat exchanger according to FIG. 1 of the first embodiment, FIG. 1*c* a section through the heat exchanger according to FIG. 1*a* or FIG. 1*b*

DETAILED DESCRIPTION

Figure 1A:
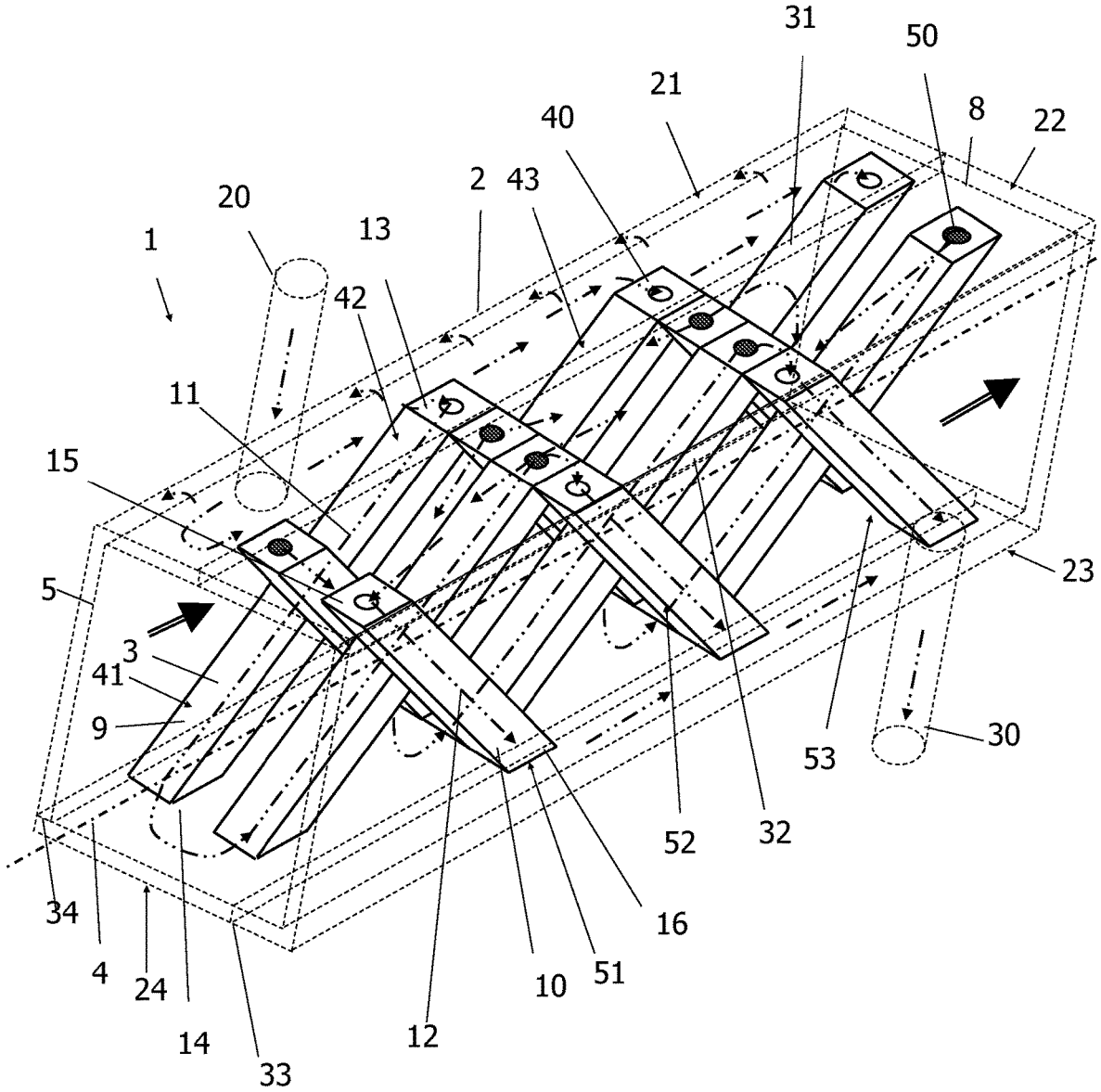
FIG. 1*d* section through the heat exchanger according to FIG. 1*a* or FIG. 1*b* according to a first variant, FIG. 1*e* section through the heat exchanger according to FIG. 1*a* or FIG. 1*b* according to a second variant, FIG. 1*f* section through the heat exchanger according to FIG. 1*a* or FIG. 1*b* according to a third variant, FIG. 2*a* a view of a heat exchanger according to a second embodiment, FIG. 2*b* a view of a jacket element of a heat exchanger according to the second embodiment, FIG. 3*a* a view of a heat exchanger according to a third embodiment, FIG. 3*b* a view of a jacket element of a heat exchanger according to the third embodiment, FIG. 4*a* a view of a heat exchanger according to a fourth embodiment, FIG. 4*b* a view of a jacket element of a heat exchanger according to the fourth embodiment, FIG. 5*a* a view of a heat exchanger according to a fifth embodiment, FIG. 5*b* a view of a jacket element of a heat exchanger according to the fifth embodiment, FIG. 6*a* a view of a heat exchanger according to a sixth embodiment, FIG. 6*b* a view of a jacket element of a heat exchanger according to the sixth embodiment, FIG. 7*a* a section through a heat exchanger according to a first variant of the second embodiment, FIG. 7*b* a section through a heat exchanger according to a second variant of the second embodiment, FIG. 8*a* a view of a heat exchanger according to a seventh embodiment, FIG. 8*b* a longitudinal section of the heat exchanger according to FIG. 8*a*, FIG. 8*c* a longitudinal section of a variant of the heat exchanger according to FIG. 8*a*.

FIG. 1*a* shows a view of a heat exchanger 1 according to a first embodiment of the invention. The heat exchanger according to FIG. 1*a* comprises a jacket element 2 and an insert element 3. In this illustration, the jacket element 2 is shown as a transparent component so that the insert element 3 located in the interior of the jacket element 2 is visible. The heat exchanger 1 for static mixing and heat exchange according to FIG. 1*a* thus contains a jacket element 2 and an insert element 3, the insert element 3 being arranged in the interior of the jacket element 2 in the installed state. The jacket element 2 is designed as a hollow body. The insert element 3 is received in the hollow body. The jacket element 2 has a longitudinal axis 4 which extends essentially in the main flow direction of the flowable medium which flows through the jacket element 2 in the operating state. The longitudinal axis 4 runs through the center point of the cross section of the opening of the jacket element. According to the present illustration, the jacket element 2 has a rectangular opening cross section. The longitudinal axis 4 thus runs through the intersection of the diagonals of the rectangle.

The insert element 3 contains a plurality of web elements 9, 10. According to the present exemplary embodiment, the web elements 9 and the web elements 10 have a different angle of inclination with respect to the longitudinal axis 4. For the sake of simplicity, the reference numerals 9, 10 each designate only one of the web elements of the web element set. All of the other web elements of the web element set 41, 42, 43 belonging to the web element 9 are preferably arranged essentially parallel to the web element 9. All of the other web elements of the web element set 51, 52, 53 belonging to the web element 10 are preferably arranged essentially parallel to the web element 10.

Each of the web elements 9 has a first end 13 and a second end 14, the first end 13 and the second end 14 of the web element 9 being connected to the jacket element 2 at different locations. The web element 9 contains a web element passage 11. The web element passage 11 is shown only by a line in the present illustration. Such web element passages are already known from EP 2851118 A1 and EP 3489603 A1. The webs disclosed in these documents are to be regarded as examples of a large number of other possible web shapes. The jacket element according to the invention can be used for any number, arrangement, or shape of the web elements. The web element passage 11 extends from the first end 13 of the web element 9 to the second end 14 of the web element 9.

Each of the web elements 10 has a first end 15 and a second end 16, the first end 15 and the second end 16 of the web element 10 being connected to the jacket element 2 at different locations. The web element 10 contains a web element passage 12. The web element passage 12 is shown only by a line in the present illustration. Such web element passages are already known from EP 2851118 A1 and EP 3489603 A1. The webs disclosed in these documents are to be regarded as examples of a large number of other possible web shapes. The web element passage 12 extends from the first end 15 of the web element 10 to the second end 16 of the web element 10.

According to the embodiment shown in FIG. 1*a*, a first, second and third web element set 41, 42, 43 are shown, each of which consist of web elements 9. Furthermore, a first, second and third web element set 51, 52, 53 are shown, which each consist of web elements 10. According to this exemplary embodiment, each of the web element sets consists of two web elements. This arrangement is only to be regarded as an example. Each of the web element sets can contain more than two web elements. Each of the web element sets can have a different number of web elements. The number of web element sets can differ from the illustration according to FIG. 1*a*.

The web elements 9 can be arranged crosswise to the web elements 10. The web elements 9 of one of the first, second or third web element sets 41, 42, 43, which are positioned in a first angle of inclination with respect to the longitudinal axis 4, can be arranged crosswise to the web elements 10 of one of the first, second or third web element sets 51, 52, 53, which are positioned in a second angle of inclination with respect to the longitudinal axis 4.

Figure 1B:
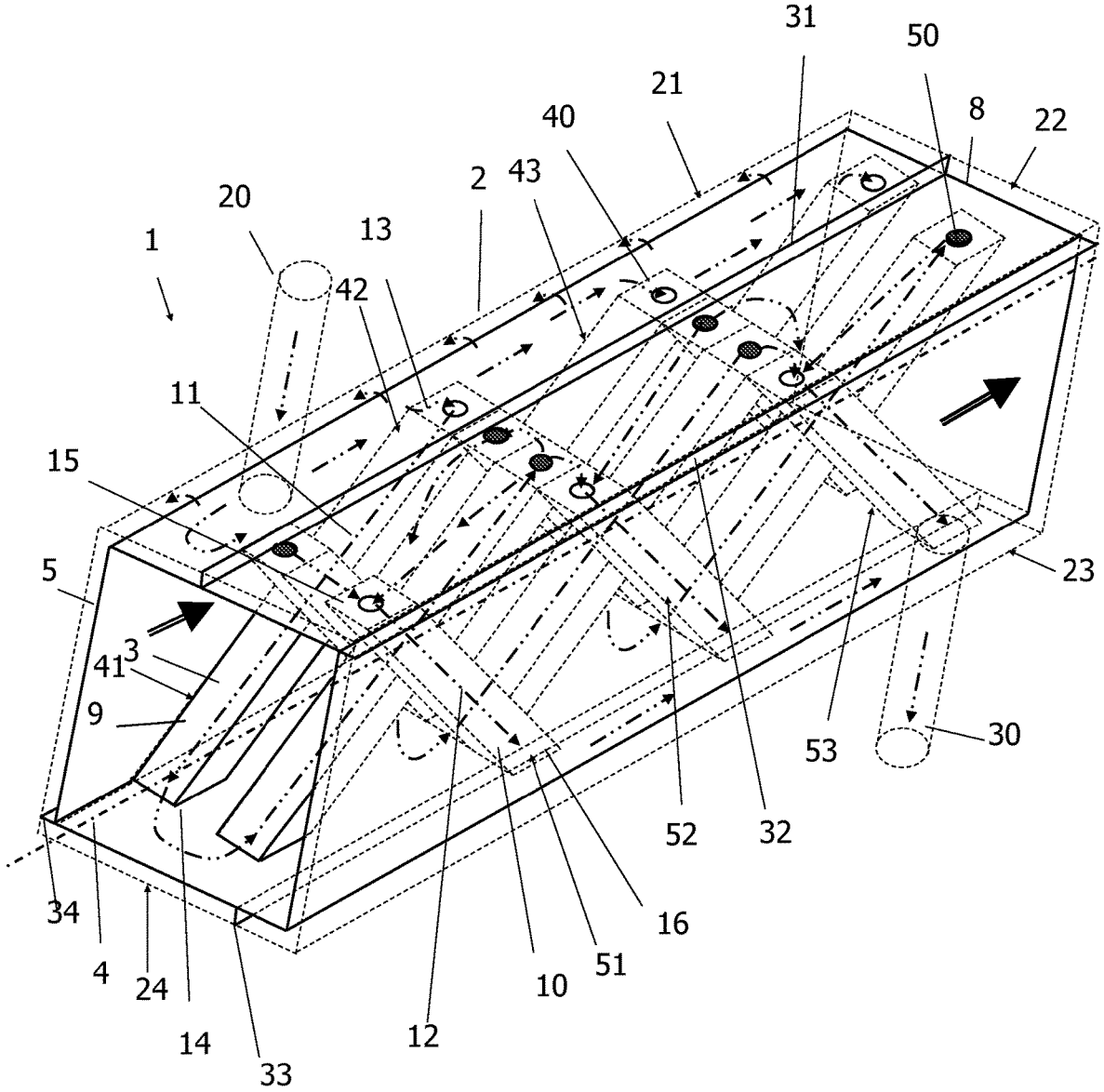

FIG. 1*b* shows the jacket element 2 with the built-in insert element 3. The jacket element 2 has an inlet opening 5 and an outlet opening 8 for a fluid or fluid mixture which flows through the heat exchanger in the operating state. The jacket element 2 is configured as a hollow body, for example as a double jacket, in a sense that there are arranged a plurality of chambers in the interior of the jacket element 2. A heat transfer fluid flows through these chambers in the operating state. The flow of the heat transfer fluid is shown in the present illustration by dash-dotted lines with two points each between two adjacent lines. The double jacket is formed by an outer shell and an inner shell. The outer shell is shown as transparent in FIG. 1*b* in order to allow a view of the chambers of the jacket element 2.

The jacket element 2 contains at least one feed 20 and one discharge 30. The jacket element 2 according to FIG. 1*a* or FIG. 1*b* consists of four chambers. The first chamber 21 contains the feed 20, comprising a tubular element containing an inlet channel for a heat transfer fluid. The third chamber 23 contains the discharge 30, which comprises a tubular element containing an outlet channel for the heat transfer fluid. A second and a fourth chamber 22, 24 are located between the first and third chambers 21, 23.

According to the present embodiment, each of the first and third chambers 21, 23 is larger than the second and fourth chambers 22, 24. In particular, each of the first or third chambers 21, 23 can each comprise more than 10%, in particular more than 25% of the circumference of the jacket element 2.

According to FIG. 1*a*, the first chamber 21 extends from the inlet opening 5 to the outlet opening 8 for the fluid which flows through the jacket element 2 in the operating state. According to this exemplary embodiment, the first chamber 21 extends over the entire length of the jacket element 2. The first chamber 21 forms part of the top surface of the jacket element 2 and the side surface adjoining this top surface according to the position shown in FIG. 1*b*. The second chamber 22 comprises that part of the top surface of the jacket element 2 which is not occupied by the first chamber 21. A first partition 31 is located between the first chamber 21 and the second chamber 22. The second chamber 22 extends from the inlet opening 5 to the outlet opening 8 for the fluid which flows through the jacket element 2 in the operating state.

According to this exemplary embodiment, the third chamber 23 extends over the entire length of the jacket element 2. In other words, the third chamber 23 extends from the inlet opening 5 to the outlet opening 8 for the fluid which flows through the jacket element 2 in the operating state. The third chamber 23 adjoins the second chamber 22. According to the position shown in FIG. 1*b*, the third chamber extends over the side surface adjoining the top surface, which is opposite to the side surface formed by the first chamber 21. In addition, the third chamber 23 forms part of the base surface of the jacket element 2. A second partition 32 is located between the second chamber 22 and the third chamber 23. The second partition 32 prevents heat transfer fluid from passing from the second chamber 22 directly into the third chamber 23. In this context, directly means in the interior of the hollow body spanned by the jacket element 2.

A fourth chamber 24 adjoins the third chamber 23 and extends over part of the base surface of the jacket element 2. The fourth chamber 24 also adjoins the first chamber 21. A third partition 33 is located between the third chamber 23 and the fourth chamber 24. A fourth partition 34 is located between the fourth chamber 24 and the first chamber 21. In other words, the fourth chamber 24 extends from the inlet opening 5 to the outlet opening 8 for the fluid which flows through the jacket element 2 in the operating state.

According to the present exemplary embodiment, the first chamber 21 has three inlet openings 40 which are in fluid-conducting connection with passages that run within the web elements 9 that adjoin the first chamber 21. In the operating state, heat transfer fluid can flow through these inlet openings 40 into the web elements 9, which in the present illustration adjoin the first chamber 21 and extend to the fourth chamber 24. In the fourth chamber there are outlet openings, which are not visible in this FIG. 1*b*, through which the heat transfer fluid can exit the web element channels and can reach the fourth chamber 24. The heat transfer fluid flows through the fourth chamber 24 to the inlet openings, which open into the passages of the parallel web elements 9 and into the passages of the web elements 10 which are arranged crosswise to the web elements 9 and which extend from the fourth chamber 24 to the second chamber 22. The heat transfer fluid emerges from the passages of the web elements 9, 10 through six outlet openings 50 and enters the second chamber 22. The outlet openings 50 are painted in black color in FIG. 1*a* and FIG. 1*b* to distinguish them from the inlet openings. The heat transfer fluid flows through the second chamber 22 up to the inlet openings which open into the passages of the web elements 10, which extend from the second chamber 22 to the third chamber 23. The passages of part of the web elements 10, in the present exemplary embodiment three web elements 10, thus open into outlet openings which open into the third chamber 23. The heat transfer fluid reaches the third chamber 23 via these outlet openings, which are not visible in the present illustration, and can leave the jacket element 2 via the discharge 30. A part of the heat transfer fluid also flows through the chamber portion of the third chamber 23 adjoining the right-hand side surface. A heat exchange between the heat transfer fluid and the fluid can thus take place both via the walls of the web elements and via chamber walls of the first to fourth chambers 21, 22, 23, 24.

Figure 1C:
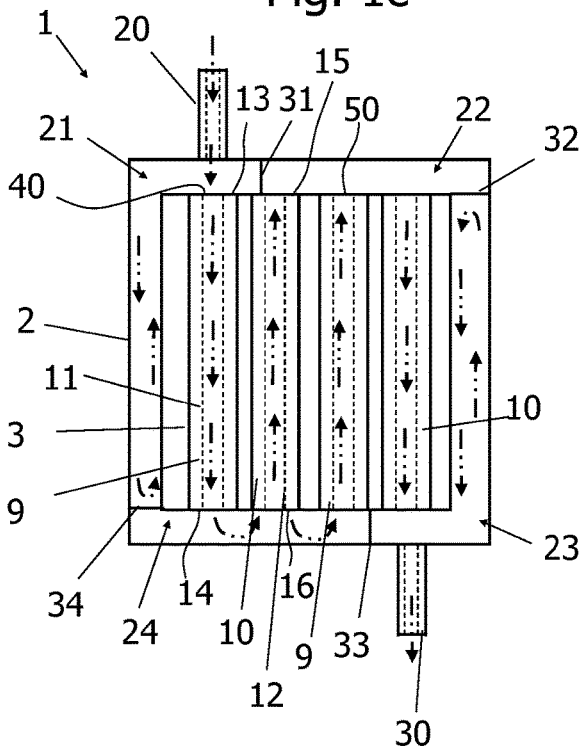

FIG. 1*c* shows a section through a heat exchanger 1 according to FIG. 1*a* or FIG. 1*b*. The cutting plane is arranged in a right angle with respect to the direction of flow of the fluid and positioned between the inlet opening 5 and the feed 20. The jacket element 2 comprises four chambers 21, 22, 23, 24. The chambers are formed by the inner jacket element wall, the outer jacket element wall and the partitions 31, 32, 33, 34, which extend between the inner jacket element wall and the outer jacket element wall. According to this embodiment, the first chamber 21 is delimited by the inner jacket element wall, the outer jacket element wall and the first partition 31 and the fourth partition 34 and two side walls, not shown, which can be located in the area of the inlet opening 5 (see FIG. 1*a* or FIG. 1*b*) or the outlet opening 8, respectively. The first chamber 21 is in fluid-conducting connection with the inlet 20 and via the web element channels 11 (only one of which is shown in this illustration)

with the fourth chamber 24, so that the heat transfer fluid can flow from the inlet 20 into the first chamber 21 in the operating state and can reach the fourth chamber 24 via the web element passages 11. According to the present embodiment, the inner jacket element wall contains a plurality of inlet openings 40, through which the heat transfer fluid can enter the corresponding web element passages 11 of the web elements 9 and from there can enter the fourth chamber 24 via outlet openings 50 on the inner jacket element wall. At their first end 13, the web elements 9 form a fluid-tight connection with the inner jacket element wall, which connection forms one of the boundaries of the first chamber 21. At their second end 14, the web elements 9 form a fluid-tight connection with the inner jacket element wall, which connection forms one of the boundaries of the fourth chamber 24. The heat transfer fluid can therefore not come into contact with the fluid flowing between the web elements 9, 10. The heat exchange between the fluid and the heat transfer fluid thus takes place via the inner jacket element walls of the jacket element 2 and via the web element walls of the web elements 9, 10 of the insert element 3.

According to an exemplary embodiment not shown, the fourth partition 34 could be omitted. According to this exemplary embodiment, not shown, the heat transfer fluid can flow both through the web element passages 11 and through the chamber formed in the jacket element. Instead of the first and fourth chambers, according to this embodiment, there would be provided only a single chamber.

According to a further exemplary embodiment, not shown, the fourth partition 34 could be configured as an intermediate wall which contains recesses or openings for the heat transfer fluid, which according to this exemplary embodiment can flow from the first chamber 21 into the fourth chamber 24.

The inner jacket element wall of the fourth chamber 24 contains a plurality of outlet openings 50 for the web element passages 11 of the web elements 9, which are in communication with the first chamber 21. The inner jacket element wall of the fourth chamber 24 contains a plurality of inlet openings 40 for the web element passages 12 of the web elements 10, which form the connection between the fourth chamber 24 and the second chamber 22. The inner jacket element wall of the fourth chamber 24 contains a plurality of inlet openings 40 for the web element passages 11 of the web elements 9, which form the connection between the fourth chamber 24 and the second chamber 22. The fourth chamber 24 thus contains a plurality of inlet openings 40 and a plurality of outlet openings 50.

The inner jacket element wall of the second chamber 22 contains a plurality of outlet openings 50 for the web element passages 11 of the web elements 9, which are in communication with the fourth chamber 24. The inner jacket element wall of the second chamber 22 contains a plurality of outlet openings 50 for the web element passages 11 of the web elements 9 and the web element passages 12 of the web elements 10, which form the connection between the fourth chamber 24 and the second chamber 22. The inner jacket element wall of the second chamber 22 contains a plurality of inlet openings 40 for the web element passages 12 of the web elements 10, which form the connection between the second chamber 22 and the third chamber 23. The second chamber 22 thus contains a plurality of inlet openings 40 and a plurality of outlet openings 50.

The inner jacket element wall of the third chamber 23 contains a plurality of inlet openings 40 for the web element passages 12 of the web elements 10, which are in communication with the second chamber 22. The outer jacket element wall of the third chamber 23 contains at least one outlet opening 50 for the discharge channel of the discharge 30. The third chamber 23 thus contains a plurality of outlet openings 50 and at least one inlet opening 40.

Figure 1D:
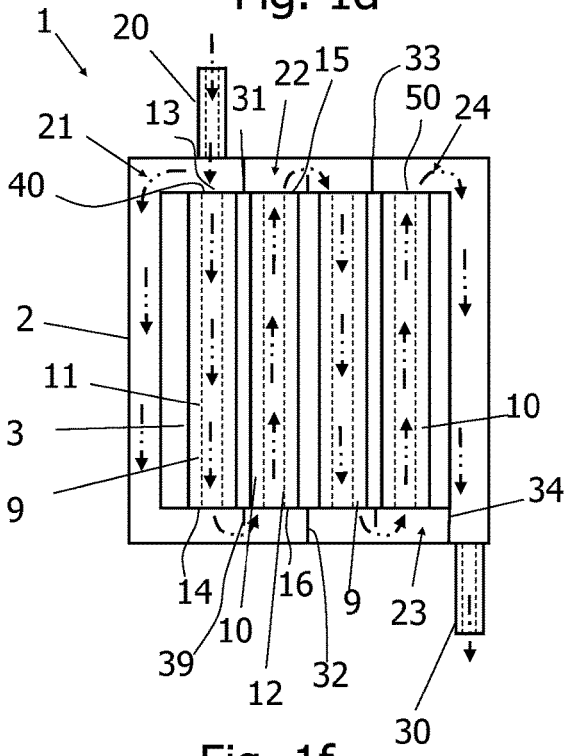

FIG. 1*d* shows a variant of a heat exchanger 1 according to the embodiment shown in FIG. 1*a* to 1*c*. For the description of this heat exchanger, reference is therefore made to the description relating to FIG. 1*a* to FIG. 1*c*, insofar as it is applicable to this variant.

The jacket element 2 comprises four chambers 21, 22, 23, 24. The chambers are delimited by the inner jacket element wall, the outer jacket element wall and the partitions 31, 32, 33, 34, which extend between the inner jacket element wall and the outer jacket element wall. According to this embodiment, the first chamber 21 is delimited by the inner jacket element wall, the outer jacket element wall and the first partition 31 and the second partition 32 and two side walls, not shown, which can be located in the area of the inlet opening 5 (see FIG. 1*a* or FIG. 1*b*) or the outlet opening 8, respectively. The first chamber 21 is in fluid-conducting connection with the feed 20 and via the web element passages 11 (only one of which is shown in this illustration) and the web element passages 12 with the second chamber 22, so that in the operating state the heat transfer fluid can flow from the feed 20 into the first chamber 21 and can reach the second chamber 22 via the web element passages 12. According to the present exemplary embodiment, there are a plurality of inlet openings 40 on the inner jacket element wall, through which the heat transfer fluid can enter the corresponding web element passages 11 of the web elements 9 and flows from there via outlet openings 50 on the inner jacket element wall into the inlet openings 40 of the web element passages 12 of the web elements 10 and can enter the second chamber 22 via outlet openings. At their first end 13, the web elements 9 form a fluid-tight connection with the inner jacket element wall, which connection forms one of the boundaries of the first chamber 21. At their second end 14, the web elements 9 form a fluid-tight connection with the inner jacket element wall, which connection forms one of the boundaries of the first chamber 21. The heat transfer fluid can therefore not come into contact with the fluid flowing between the web elements 9, 10. The heat exchange between the fluid and the heat transfer fluid thus takes place via the inner jacket element walls of the jacket element 2 and via the web element walls of the web elements 9, 10 of the insert element 3.

According to the illustrated embodiment, an intermediate wall is arranged in the first chamber 21 between the web elements 9, whose center axes span a common plane, and the web elements 10, whose central axes span a common plane. The heat transfer fluid can flow around or through the partition if it contains recesses or openings.

The heat transfer fluid can flow both through the web element passages 11, 12 and through the first chamber 21 formed in the jacket element.

The inner jacket element wall of the second chamber 22 contains a plurality of outlet openings 50 for the web element passages 12 of the web elements 10, which are in communication with the first chamber 21. The inner jacket element wall of the second chamber 22 contains a plurality of inlet openings 40 for the web element passages 11 of the web elements 9, which form the connection between the second chamber 22 and the third chamber 23. The second chamber 22 thus contains a plurality of inlet openings 40 and a plurality of outlet openings 50.

The inner jacket element wall of the third chamber 23 contains a plurality of outlet openings 50 for the web element passages 11 of the web elements 9, which are in communication with the fourth chamber 24. The inner jacket element wall of the second chamber 22 contains a plurality of outlet openings 50 for the web element passages 11 of the web elements 9, which form the connection between the second chamber 22 and the third chamber 23. The inner jacket element wall of the third chamber 23 contains a plurality of inlet openings 40 for the web element passages 12 of the web elements 10, which form the connection between the third chamber 23 and the fourth chamber 24. The third chamber 23 thus contains a plurality of inlet openings 40 and a plurality of outlet openings 50. According to this exemplary embodiment, the third chamber 23 also contains an intermediate wall 39 around which the heat transfer fluid can flow or through which the heat transfer fluid can flow if it contains openings or recesses.

The inner jacket element wall of the fourth chamber 24 contains a plurality of outlet openings 50 for the web element passages 12 of the web elements 10, which are in communication with the third chamber 23. The outer jacket element wall of the fourth chamber 24 contains at least one outlet opening 50 for the discharge channel of the discharge 30. The fourth chamber 24 thus contains a plurality of outlet openings 50 and at least one inlet opening 40.

According to the variant shown in FIG. 1*d*, the first chamber 21, the second chamber 22, and the third chamber 23 contain partitions 39. In contrast to the partitions 31, 32, 33, 34, the partitions 39 do not extend over the total height of the chamber and/or not over the entire length of the chamber. The use of the partitions 39 enables a deflection of the flow of the heat transfer fluid within the chambers, according to the present example within the first, second and third chambers. The partitions 39 shown represent, of course, only one of several possible arrangements of partitions 39, the partitions 39 can thus differ in length, height, position, and number from the representation selected in FIG. 1*d*.

Figure 1E:
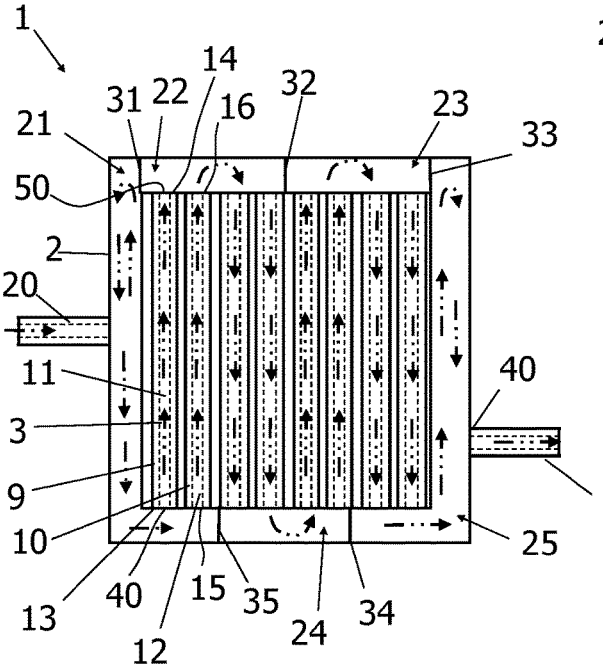

FIG. 1*e* shows a variant of a heat exchanger 1 according to the embodiment shown in FIG. 1*a* to FIG. 1*d*. For the description of this heat exchanger, the same reference symbols are used as for the description of FIG. 1*a* to FIG. 1*c*, provided that the reference symbols relate to elements of the heat exchanger that are the same or have the same or a corresponding effect. The number of web elements 9, 10 located in the fluid channel is greater than in the previous exemplary embodiments. The number of web elements 9, 10 can thus differ from the number shown in FIG. 1*a* to FIG. 1*c*. Furthermore, the number of chambers of the jacket element 2 can also differ from the number shown in FIG. 1*a* to FIG. 1*c*. Both the number of web elements 9, 10 and the number of chambers of the jacket element 2 are to be regarded as an exemplary embodiment. A heat exchanger 1 with a number of web elements 9, 10 and/or a number of chambers that differs from the number shown is therefore expressly included in the scope of protection of the claims.

The sectional plane according to FIG. 1*e* is aligned in a right angle with respect to the direction of flow of the fluid and lies between the inlet opening 5 and the feed 20. According to this exemplary embodiment, the jacket element 2 comprises five chambers 21, 22, 23, 24, 25. The chambers are formed by the inner jacket element wall, the outer jacket element wall and the partitions 31, 32, 33, 34, 35, which extend between the inner jacket element wall and the outer jacket element wall. According to this embodiment, the first chamber 21 is bounded by the inner jacket element wall, the outer jacket element wall and the first partition 31 and the fifth partition 35 and two side walls (not shown), which are located in the area of the inlet opening 5 (see FIG. 1*a* or FIG. 1*b*) or the outlet opening 8, respectively. The first chamber 21 is in fluid-conducting connection with the inlet 20 and via the web element passages 11, 12 (only one of which is shown in this illustration) with the second chamber 22, so that in the operating state the heat transfer fluid can flow from the feed 20 into the first chamber 21 and can reach the second chamber 22 via the web element passages 11, 12. According to the present exemplary embodiment, a plurality of inlet openings 40 is provided in the inner jacket element wall through which the heat transfer fluid can enter the corresponding web element passages 11, 12 of the web elements 9, 10 and from there it can enter the second chamber 22 via outlet openings 50 in the inner jacket element wall. At their first end 13, the web elements 9 form a fluid-tight connection with the inner jacket element wall, wherein the connection is configured as one of the boundaries of the first chamber 21. At their second end 14, the web elements 9 form a fluid-tight connection with the inner jacket element wall, which connection is configured as one of the boundaries of the second chamber 22. At their first end 15, the web elements 10 form a fluid-tight connection with the inner jacket element wall, which connection is configured as one of the boundaries of the first chamber 21. At their second end 16, the web elements 10 form a fluid-tight connection with the inner jacket element wall, wherein the connection is configured as one of the boundaries of the second chamber 22. The heat transfer fluid can therefore not come into contact with the fluid flowing between the web elements 9, 10. The heat exchange between the fluid and the heat transfer fluid thus takes place via the inner jacket element walls of the jacket element 2 and via the web element walls of the web elements 9, 10 of the insert element 3.

The inner jacket element wall of the second chamber 22 contains a plurality of outlet openings 50 for the web element passages 10, 11 of the web elements 9, 10, which are in communication with the first chamber 21. The inner jacket element wall of the second chamber 22 contains a plurality of inlet openings 40 for the web element passages 11, 12 of the web elements 9, 10, which form the connection between the second chamber 22 and the fourth chamber 24. The second chamber 22 thus contains a plurality of inlet openings 40 and a plurality of outlet openings 50.

The inner jacket element wall of the fourth chamber 24 contains a plurality of outlet openings 50 for the web element passages 10, 11 of the web elements 9, 10, which are in communication with the second chamber 22. The inner jacket element wall of the fourth chamber 24 contains a plurality of inlet openings 40 for the web element passages 11, 12 of the web elements 9, 10, which form the connection between the fourth chamber 24 and the third chamber 23. The fourth chamber 24 thus contains a plurality of inlet openings 40 and a plurality of outlet openings 50.

The inner jacket element wall of the third chamber 23 contains a plurality of outlet openings 50 for the web element passages 10, 11 of the web elements 9, 10, which are in communication with the fourth chamber 24. The inner jacket element wall of the third chamber 23 contains a plurality of inlet openings 40 for the web element passages 11, 12 of the web elements 9, 10, which form the connection between the third chamber 23 and the fifth chamber 25. The third chamber 23 thus contains a plurality of inlet openings 40 and a plurality of outlet openings 50.

The inner jacket element wall of the fifth chamber 25 contains a plurality of outlet openings 50 for the web element passages 10, 11 of the web elements 9, 10, which are in communication with the third chamber 23. The outer jacket element wall of the fifth chamber 25 contains at least one inlet opening for the discharge channel of the discharge 30. The fifth chamber 25 thus contains a plurality of outlet openings 50 and at least one inlet opening 40.

Figure 1F:
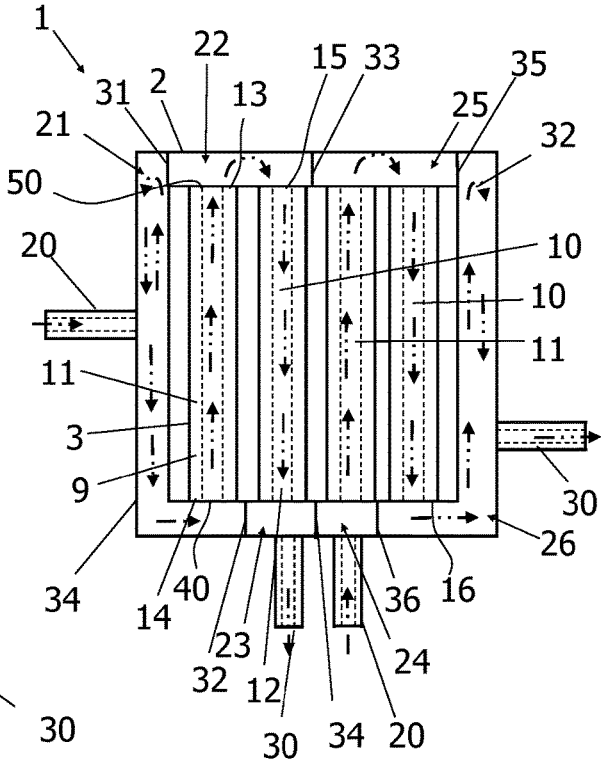

FIG. 1*f* shows a variant of a heat exchanger 1 according to the embodiment shown in FIG. 1*a* to FIG. 1*e*. For the description of this heat exchanger, the same reference symbols are used as for the description of FIG. 1*a* to FIG. 1*c*, provided that the reference symbols relate to elements of the heat exchanger that are the same or have the same effect. FIG. 1*f* thus shows a section through a variant of the heat exchanger 1 according to FIG. 1*a* or FIG. 1*b*. The sectional plane is aligned in a right angle to the direction of flow of the fluid and is positioned between the inlet opening 5 and the feed 20. The jacket element 2 comprises six chambers 21, 22, 23, 24, 25, 26. The chambers are formed by the inner jacket element wall, the outer jacket element wall and the partitions 31, 32, 33, 34, 35, 36, which extend between the inner jacket element wall and the outer jacket element wall. According to this embodiment, the first chamber 21 is delimited by the inner jacket element wall, the outer jacket element wall and the first partition 31 and the second partition 32 and two side walls, not shown, which are located in the area of the inlet opening 5 and the outlet opening 8 (see FIG. 1*a* or FIG. 1*b*). The first chamber 21 is in fluid-conducting connection with the feed 20 and via the web element passages 11 (only one of which is shown in this illustration) with the second chamber 22, so that the heat transfer fluid can flow from the feed 20 into the first chamber 21 in the operating state and can reach the second chamber 22 via the web element passages 11. According to the present embodiment, a plurality of inlet openings 40 are provided in the inner jacket element wall, through which the heat transfer fluid can enter the corresponding web element passages 11 of the web elements 9 and from there it can enter the second chamber 22 via outlet openings 50 in the inner jacket element wall. The web elements 9 form a fluid-tight connection with the inner jacket element wall at their first end 13, wherein the connection is configured as one of the boundaries of the first chamber 21. At their second end 14, the web elements 9 form a fluid-tight connection with the inner jacket element wall, wherein the connection is configured one of the boundaries of the second chamber 22. The heat transfer fluid can therefore not come into contact with the fluid flowing between the web elements 9, 10. The heat exchange between the fluid and the heat transfer fluid thus takes place via the inner jacket element walls of the jacket element 2 and via the web element walls of the web elements 9, 10 of the insert element 3.

The inner jacket element wall of the second chamber 22 contains a plurality of outlet openings 50 for the web element passages 11 of the web elements 9, which are in communication with the first chamber 21. The inner jacket element wall of the second chamber 22 contains a plurality of inlet openings 40 for the web element passages 12 of the web elements 10, which form the connection between the second chamber 22 and the third chamber 23. The second chamber 22 thus contains a plurality of inlet openings 40 and a plurality of outlet openings 50.

The inner jacket element wall of the third chamber 23 contains a plurality of inlet openings 40 for the web element passages 12 of the web elements 10, which form the connection between the third chamber 23 and the second chamber 22. The outer jacket element wall of the third chamber 23 contains at least one outlet opening 50 for the discharge channel of the discharge 30. The third chamber 23 thus contains a plurality of inlet openings 40 and at least one outlet opening 50.

The fourth chamber 24 is in fluid-conducting connection with a further feed 20 and via the web element passages 11 (only one of which is shown in this illustration) with the fifth chamber 25, so that in the operating state the heat transfer fluid can flow from the feed 20 into the fourth chamber 24 and can reach the fifth chamber 25 via the web element passages 11. According to the present embodiment, a plurality of inlet openings 40 is provided in the inner jacket element wall, through which the heat transfer fluid can enter the corresponding web element passages 11 of the web elements 9 and from there can enter the second chamber 22 via outlet openings 50 in the inner jacket element wall. The inlet openings and outlet openings are not designated in FIG. 1*f*, since they correspond to the previously described inlet openings and outlet openings for the first and second chambers 21, 22, respectively. The inner jacket element wall of the fourth chamber 24 contains a plurality of outlet openings 50 for the web element passages 11 of the web elements 9, which are in communication with the fifth chamber 25. The fourth chamber 24 thus contains at least one inlet opening 40 and a plurality of outlet openings 50.

The inner jacket element wall of the fifth chamber 25 contains a plurality of outlet openings 50 for the web element passages 12 of the web elements 10, which form the connection between the fifth chamber 25 and the fourth chamber 24. The inner jacket element wall of the fifth chamber 25 contains a plurality of inlet openings 40 for the web element passages 12 of the web elements 10, which are in connection with the sixth chamber 26. The fifth chamber 25 thus contains a plurality of inlet openings 40 and a plurality of outlet openings 50.

The inner jacket element wall of the sixth chamber 26 contains a plurality of outlet openings 50 for the web element passages 12 of the web elements 10, which are in connection with the fifth chamber 25. The outer jacket element wall of the sixth chamber 26 contains at least one outlet opening 50 for a further discharge channel of the discharge 30. The sixth chamber 26 thus contains a plurality of inlet openings 40 and at least one outlet opening 50. This variant is particularly suitable when the heat to be supplied to the fluid via the heat transfer fluid or the heat that is to be extracted from the fluid by means of the heat transfer fluid is greater than in the variants according to one of FIG. 1*a* to FIG. 1*e*.

Figure 2A:
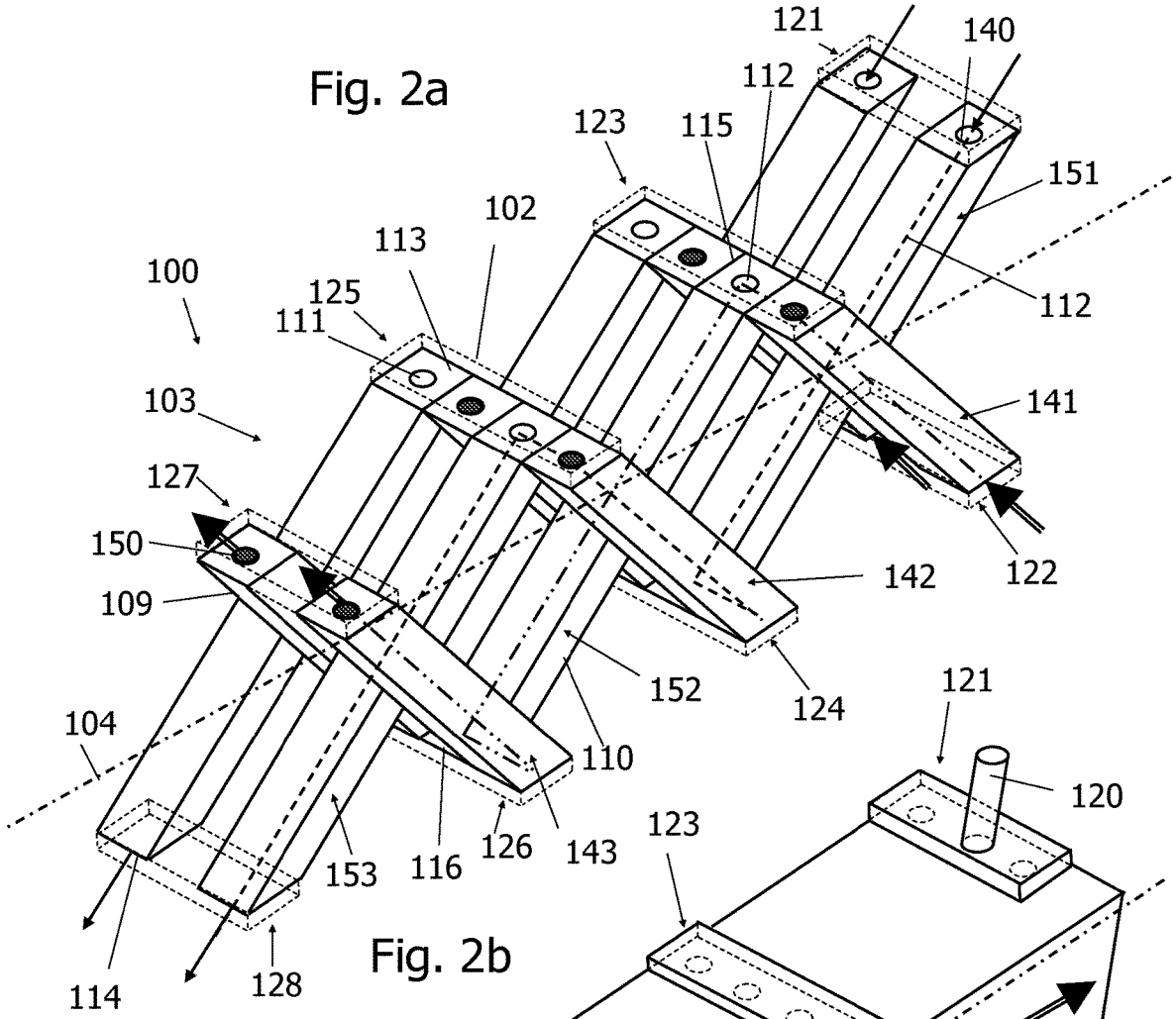

FIG. 2*a* shows a view of a heat exchanger 100 according to a second exemplary embodiment of the invention. The heat exchanger 100 according to FIG. 2*a* comprises a jacket element 102 and an insert element 103. In FIG. 2*a* the jacket element is not shown in its entirety, only the chambers of the jacket element 102 are shown, the entire jacket element 102 can be seen from FIG. 2*b*. In the illustration according to FIG. 2*a*, the jacket element 102 is shown as a transparent part, so that the insert element 103 is visible which is located in the interior of the jacket element 102. The heat exchanger 100 for static mixing and heat exchange according to FIG. 2*a* thus contains a jacket element 102 and an insert element 103, the insert element 103 being arranged in the interior of the jacket element 102 in the installed state. The jacket element 102 is partially configured as a hollow body. The insert element 103 is received in the jacket element. The jacket element 102 has a longitudinal axis 104 which extends essentially in the main direction of flow of the flowable medium or fluid or fluid mixture which flows through the jacket element 102 in the operating state. The longitudinal axis 104 runs through the center point of the opening cross section of the jacket element. According to the present illustration, the jacket element 102 has a rectangular opening cross section. The longitudinal axis 104 thus runs through the intersection of the diagonals of the rectangle analogously to the arrangement shown in FIG. 2*b*.

The insert element 103 contains a plurality of web elements 109, 110. According to the present exemplary embodiment, the web elements 109 and the web elements 110 include a different angle of inclination with respect to the longitudinal axis 104. For the sake of simplicity, the reference numerals 109, 110 each designate only one of the web elements of the web element sets. All of the other web elements of the web element sets belonging to the web element 109 are arranged parallel to the web element 109. All of the other web elements of the web element sets belonging to the web element 110 are arranged parallel to the web element 110.

Each of the web elements 109 has a first end 113 and a second end 114, the first end 113 and the second end 114 of the web element 109 being connected to the jacket element 102 at different locations. The web element 109 contains a web element passage 111. Only the inlet opening of the web element passage 111 is shown in the present illustration. Such web element passages are already known from EP 2851118 A1 and EP 3489603 A1. The web elements disclosed in these documents are to be regarded as examples of a large number of other possible web shapes. The jacket element 102 according to the invention can be used for any number, arrangement, or shape of the web elements.

The web element passage 111 extends from the first end 113 of the web element 109 to the second end 114 of the web element 109.

Each of the web elements 110 has a first end 115 and a second end 116, wherein the first end 115 and the second end 116 of the web element 110 are connected to the jacket element 102 at different locations. The web element 110 contains a web element passage 112. Only the inlet opening of the web element passage 112 is shown in the present illustration. Such web element passages are already known from EP 2851118 A1 and EP 3489603 A1. The web elements disclosed in these documents are to be regarded as examples of a large number of other possible web shapes. The web element passage 112 extends from the first end 115 of the web element 110 to the second end 116 of the web element 110.

The jacket element 102 is partially designed as a hollow body. The insert element 103 is received in the jacket element. The jacket element 102 has a longitudinal axis 104 which extends essentially in the main direction of flow of the flowable medium or fluid or fluid mixture which flows through the jacket element 102 in the operating state. The longitudinal axis 104 runs through the center point of the opening cross section of the jacket element and is better visible in FIG. 2*b*. According to the present illustration, the jacket element 102 has a rectangular opening cross section. The longitudinal axis 104 thus runs through the intersection of the diagonals of the rectangle.

According to the exemplary embodiment shown in FIG. 2*a*, first, second and third of web element sets are shown, which consist of web elements 109. Furthermore, first, second and third web element sets are shown, which consist of web elements 110. According to this exemplary embodiment, each of the web element sets consists of two web elements. This arrangement is only to be regarded as an example. Each of the web element sets can contain more than two web elements. Each of the web element sets can have a different number of web elements. The number of web element sets can differ from the illustration according to FIG. 2*a*.

Figure 2B:
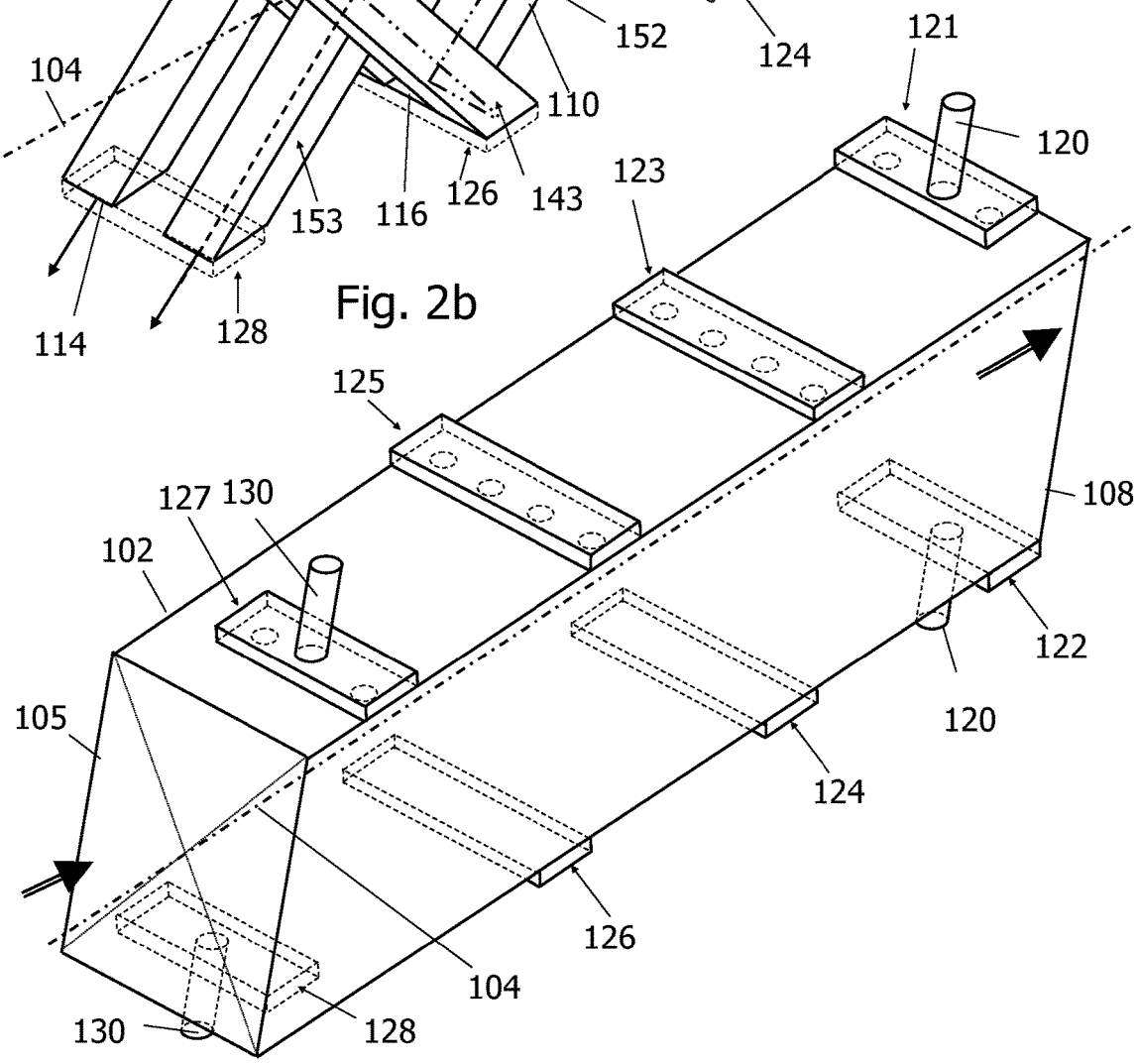

FIG. 2*b* shows the jacket element 102 without the insert element 103 located therein. The jacket element 102 has an inlet opening 105 and an outlet opening 108 for a fluid, flowable medium or fluid mixture which flows through the heat exchanger in the operating state. The jacket element 102 is at least partially designed as a hollow body, for example as a double jacket, that is, the jacket element 102 contains a plurality of chambers. A heat transfer fluid flows through these chambers in the operating state. The flow of the heat transfer fluid is shown in FIG. 2*a* by dash-dotted lines with two points between two adjacent lines or shown as dashed lines. The jacket element is formed by an outer jacket and an inner jacket at those locations at which the jacket element is designed as a double jacket. The outer and inner shells are only shown transparent for the chambers in FIG. 2*a* to show the position of the chambers of the jacket element 102 in the installed state.

The jacket element 102 according to FIG. 2*b* contains at least two feeds 120 and two discharges 130. The jacket element 102 according to FIG. 2*a* or FIG. 2*b* comprises eight chambers. The first chamber 121 contains the feed 120, comprising a tubular element containing an inlet channel for a heat transfer fluid. The second chamber 122 contains the further feed 120, comprising a tubular element, containing a further inlet channel for the heat transfer fluid. Each of the third, fourth, fifth, sixth chambers 123, 124, 125, 126 contains inlet openings and outlet openings of the web elements 109, 110. The seventh chamber 127 contains the discharge 130, which comprises a tubular element containing an outlet channel for the heat transfer fluid. The eighth chamber 128 contains a further discharge 130, which comprises a tubular element containing an outlet channel for the heat transfer fluid.

According to the present embodiment, each of the third, fourth, fifth, sixth chambers 123, 124, 125, 126 is larger than the first, second, seventh and eighth chambers 121, 122, 127, 128. In particular, the width of each of the third, fourth, fifth, sixth chambers 123, 124, 125, 126 can amount to 10% up to and including 25% of the circumference of the jacket element 102. The width of these chambers is measured in a plane which is arranged in a right angle with respect to the longitudinal axis 104.

According to FIG. 2*b*, the first chamber 121 does not extend from the inlet opening 105 to the outlet opening 108 for the fluid which flows through the jacket element 102 in the operating state. The first chamber 121 is only in fluid-conducting connection with the inlet openings 140 of the web elements 110 belonging to the web element set 151 and the feed 120. According to this exemplary embodiment, the first chamber 121 does not extend over the entire length or width of the jacket element 102. The first chamber 121 forms part of the top surface of the jacket element 102 according to the position shown in FIG. 2*b*.

The second chamber 122 comprises the part of the bottom surface of the jacket element 102. The second chamber 122 is only in fluid-conducting connection with the inlet openings 140 of the web elements 109 belonging to the web element set 141 and the feed 120. According to this exemplary embodiment, the second chamber 122 does not extend over the entire length or width of the jacket element 102. The second chamber 122 forms part of the bottom surface of the jacket element 102 according to the position shown in FIG. 2*b*.

According to the present exemplary embodiment, the third chamber 123 is arranged on the top surface of the jacket element 102. The third chamber 123 contains the outlet openings 150 of the web elements 109, which belong to the web element set 141, and the inlet openings 140 of the web elements 110, which belong to the web element set 152.

All of the inlet openings 140 are shown as circular openings in FIG. 2*a*. This representation of the inlet openings 140 as circular openings is only to be viewed as an example and should not be interpreted as a restriction with respect to the shape of the opening cross section. The opening cross-section of the inlet openings can deviate from the circular shape, in particular, rectangular, polygonal, elliptical, or other opening cross-sections are possible. All of the outlet openings 150 are shown as circular openings in FIG. 2*a*. In order to be able to easily distinguish the outlet openings 150 from the inlet openings 140, the opening cross-sections have been blackened. This representation of the outlet openings 150 as circular openings is only to be viewed as an example and should not be interpreted as a restriction with respect to the shape of the opening cross section. The opening cross-section of the outlet openings 150 can deviate from the circular shape, in particular rectangular, polygonal, elliptical, or other opening cross-sections are possible.

According to the present exemplary embodiment, the fourth chamber 124 is arranged on the bottom surface of the jacket element 102. The fourth chamber 124 contains the inlet openings 140 of the web elements 109, which belong to the web element set 142, as well as the outlet openings 150 of the web elements 110, which belong to the web element set 151.

According to the present exemplary embodiment, the fifth chamber 125 is arranged on the top surface of the jacket element 102. The fifth chamber 125 contains the outlet openings 150 of the web elements 109, which belong to the web element set 142, as well as the inlet openings 140 of the web elements 110 which belong to the web element set 153.

According to the present exemplary embodiment, the sixth chamber 126 is arranged on the bottom surface of the jacket element 102. The sixth chamber 126 contains the inlet openings 140 of the web elements 109, which belong to the web element set 143, and the outlet openings 150 of the web elements 110 which belong to the web element set 152.

The seventh chamber 127 is only in fluid-conducting connection with the outlet openings 150 of the web elements 109 belonging to the web element set 143 and the discharge 130. According to this exemplary embodiment, the seventh chamber 127 does not extend over the entire length or width of the jacket element 102. The seventh chamber 127 forms part of the top surface of the jacket element 102 according to the position shown in FIG. 2*b*.

The eighth chamber 128 is only in fluid-conducting connection with the outlet openings 150 of the web elements 110 belonging to the web element set 153 and the discharge 130. According to this exemplary embodiment, the eighth chamber 128 does not extend over the entire length or width of the jacket element 102. The eighth chamber 128 forms part of the bottom surface of the jacket element 102 according to the position shown in FIG. 2*b*.

According to the exemplary embodiment shown in FIG. 2*a* and FIG. 2*b*, the heat transfer fluid is fed to the web elements 110 of the web element set 151 via an inlet 120 through the first chamber 121. The heat transfer fluid is also fed to the web elements 109 of the web element set 141 via a feed 120 through the second chamber 122. The first chamber 121 and the second chamber 122 therefore have the function of distributing the heat transfer fluid to the corresponding inlet openings 140 of the corresponding web element passages 111, 112 of the web elements 109, 110. The web element passages 111, 112, which run within the web elements 109, 110, are not shown, their course can be seen from the flow course of the heat transfer medium, which is represented by dash-dotted lines with two points between two adjacent lines or dashed lines.

The heat transfer fluid which flows from the first chamber 121 into the web element passages 112 of the web elements 110 of the web element set 151 passes through outlet openings 150 into the fourth chamber 124 and from there flows into the inlet openings 140 of the web element passages 111 of the web element set 142.

The fourth chamber 124 contains the outlet openings 150 of the web element passages 112 of the web elements 110 of the web element set 151 and the inlet openings 140 of the web element passages 111 of the web elements 109 of the web element set 142. The heat transfer fluid can flow through the outlet openings 150 into the inlet openings and reaches the web element passages 111 of web elements 109 of web element set 142.

The fifth chamber 125 contains the outlet openings 150 of the web element passages 111 of the web elements 109 of the web element set 142 and the inlet openings 140 of the web element passages 112 of the web elements 110 of the web element set 153. The heat transfer fluid can flow through the outlet openings 150 into the inlet openings and reaches the web element passages 112 of web elements 110 of web element set 153.

The outlet openings of the web element passages 112 of the web elements 110 of the web element set 153 are located in the eighth chamber 128. The eighth chamber 128 contains an outlet opening 150 for a discharge 130.

According to the exemplary embodiment shown in FIG. 2*a* and FIG. 2*b*, the heat transfer fluid is also fed to the web elements 109 of the web element set 141 via a feed 120 through the second chamber 122. The heat transfer fluid which flows from the second chamber 122 into the web element passages 111 of the web elements 109 of the web element set 141 passes through outlet openings 150 into the third chamber 123 and from there flows into the inlet openings 140 of the web element passages 112 of the web element set 152.

The outlet openings 150 of the web element passages 111 of the web elements 109 of the web element set 141 as well as the inlet openings 140 of the web element passages 112 of the web elements 110 of the web element set 152 are located in the third chamber 123. The heat transfer fluid can flow through the outlet openings 150 into the inlet openings and reaches the web element passages 112 of web elements 110 of web element set 152.

The sixth chamber 126 contains the outlet openings 150 of the web element passages 112 of the web elements 110 of the web element set 152 and the inlet openings 140 of the web element passages 111 of the web elements 109 of the web element set 143. The heat transfer fluid can flow through the outlet openings 150 into the inlet openings and enters the web element passages 111 of the web elements 109 of the web element set 143.

The outlet openings of the web element passages 111 of the web elements 109 of the web element set 143 are located in the seventh chamber 127. The seventh chamber 127 contains an outlet opening 150 for a discharge 130.

The heat transfer fluid thus flows crosswise in the opposite direction to the fluid, wherein the main direction flow runs in the direction of the longitudinal axis 104 and is indicated by an arrow with a double line.

Figure 3A:
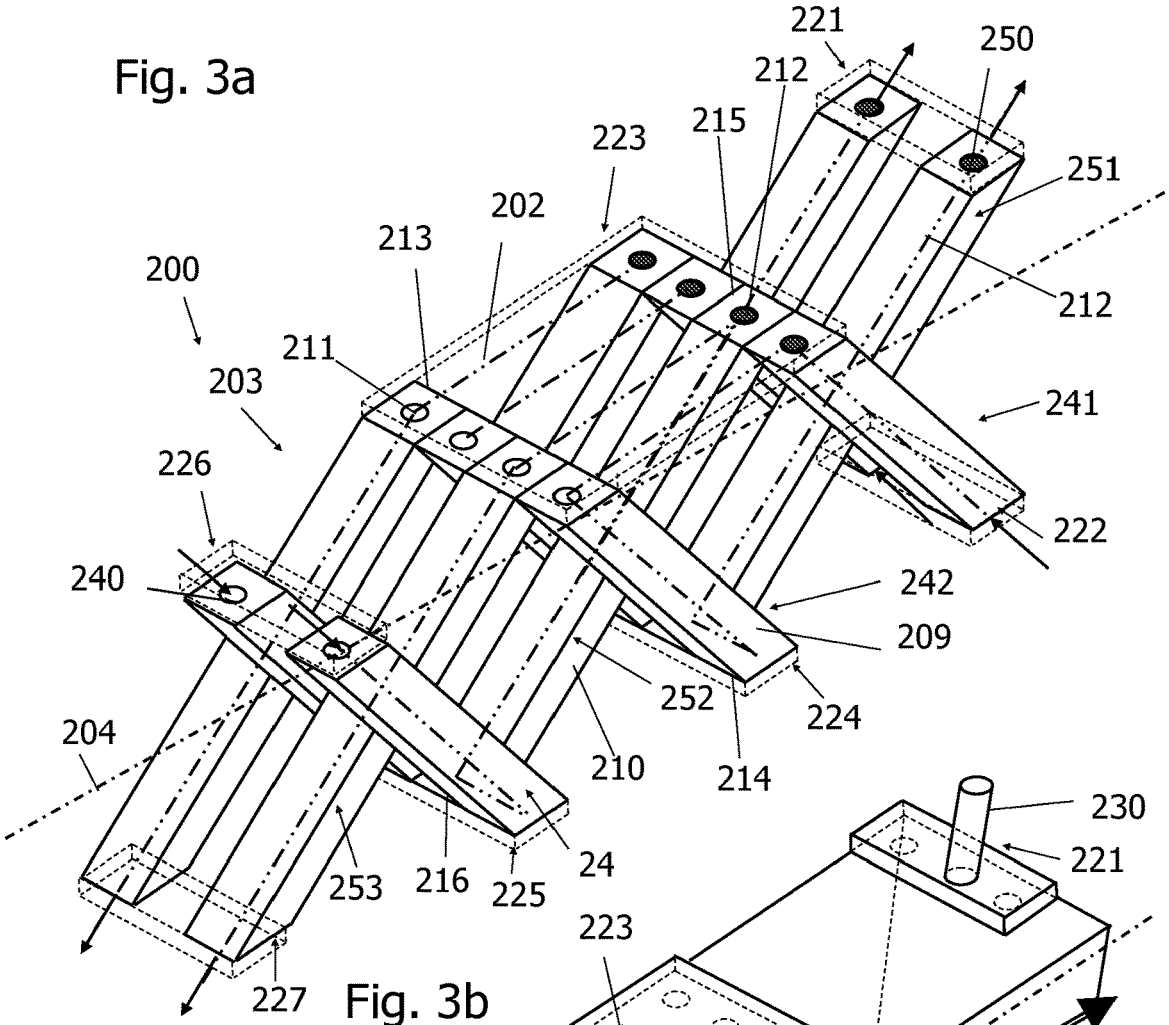

FIG. 3*a* shows a view of a heat exchanger 200 according to a third exemplary embodiment of the invention. The heat exchanger 200 according to FIG. 3*a* comprises a jacket element 202 and an insert element 203. In FIG. 3*a*, the jacket element is not shown in full, only the chambers of the jacket element 202 are shown, the entire jacket element 202 can be seen from FIG. 3*b*. In the illustration according to FIG. 3*a*, the jacket element 202 is shown as a transparent component, so that the insert element 203 located in the interior of the jacket element 202 is visible. The heat exchanger 200 for static mixing and heat exchange according to FIG. 3*a* thus contains a jacket element 202 and an insert element 203, the insert element 203 being arranged in the interior of the jacket element 202 in the installed state. The jacket element 202 is partially designed as a hollow body. The insert element 203 is received in the jacket element. The jacket element 202 has a longitudinal axis 204 which extends essentially in the main direction of flow of the flowable medium or fluid or fluid mixture which flows through the jacket element 202 in the operating state. The longitudinal axis 204 runs through the center of the opening cross section of the jacket element and is better visible in FIG. 3*b*. According to the present illustration, the jacket element 202 has a rectangular opening cross section. The longitudinal axis 204 thus runs through the intersection of the diagonals of the rectangle.

The insert element 203 contains a plurality of web elements 209, 210. According to the present exemplary embodiment, the web elements 209 and the web elements 210 have a different angle of inclination with respect to the longitudinal axis 204. For the sake of simplicity, the reference numerals 209, 210 each designate only one of the web elements of the corresponding web element set. All of the other web elements of the web element sets corresponding to the web element 209 are arranged parallel to the web element 209. All of the other web elements of the web element sets corresponding to the web element 210 are arranged parallel to the web element 210.

Each of the web elements 209 has a first end 213 and a second end 214, the first end 213 and the second end 214 of the web element 209 being connected to the jacket element 202 at different locations. The web element 209 contains a web element passage 211. Only the inlet opening of the web element passage 211 is shown in the present illustration. Such web element passages are already known from EP 2851118 A1 and EP 3489603 A1. The web elements disclosed in these documents are to be regarded as examples of a large number of other possible web shapes. The jacket element 202 according to the invention can be used for any number, arrangement, or shape of the web elements.

The web element passage 211 extends from the first end 213 of the web element 209 to the second end 214 of the web element 209.

Each of the web elements 210 has a first end 215 and a second end 216, the first end 215 and the second end 216 of the web element 210 being connected to the jacket element 202 at different locations. The web element 210 contains a web element passage 212. Only the inlet opening of the web element passage 212 is shown in the present illustration. Such web element passages are already known from EP 2851118 A1 and EP 3489603 A1. The web elements disclosed in these documents are to be regarded as examples of a large number of other possible web shapes. The web element passage 212 extends from the first end 215 of the web element 210 to the second end 216 of the web element 210.

According to the embodiment shown in FIG. 3*a*, a first, second and third web element set are shown, which consist of web elements 209. Furthermore, a first, second and third web element set are shown, which consist of web elements 210. According to this exemplary embodiment, each of the web element sets consists of two web elements. This arrangement is only to be regarded as an example. Each of the web element sets can contain more than two web elements. Each of the web element sets can have a different number of web elements. The number of web element sets can differ from the illustration according to FIG. 3*a*.

Figure 3B:
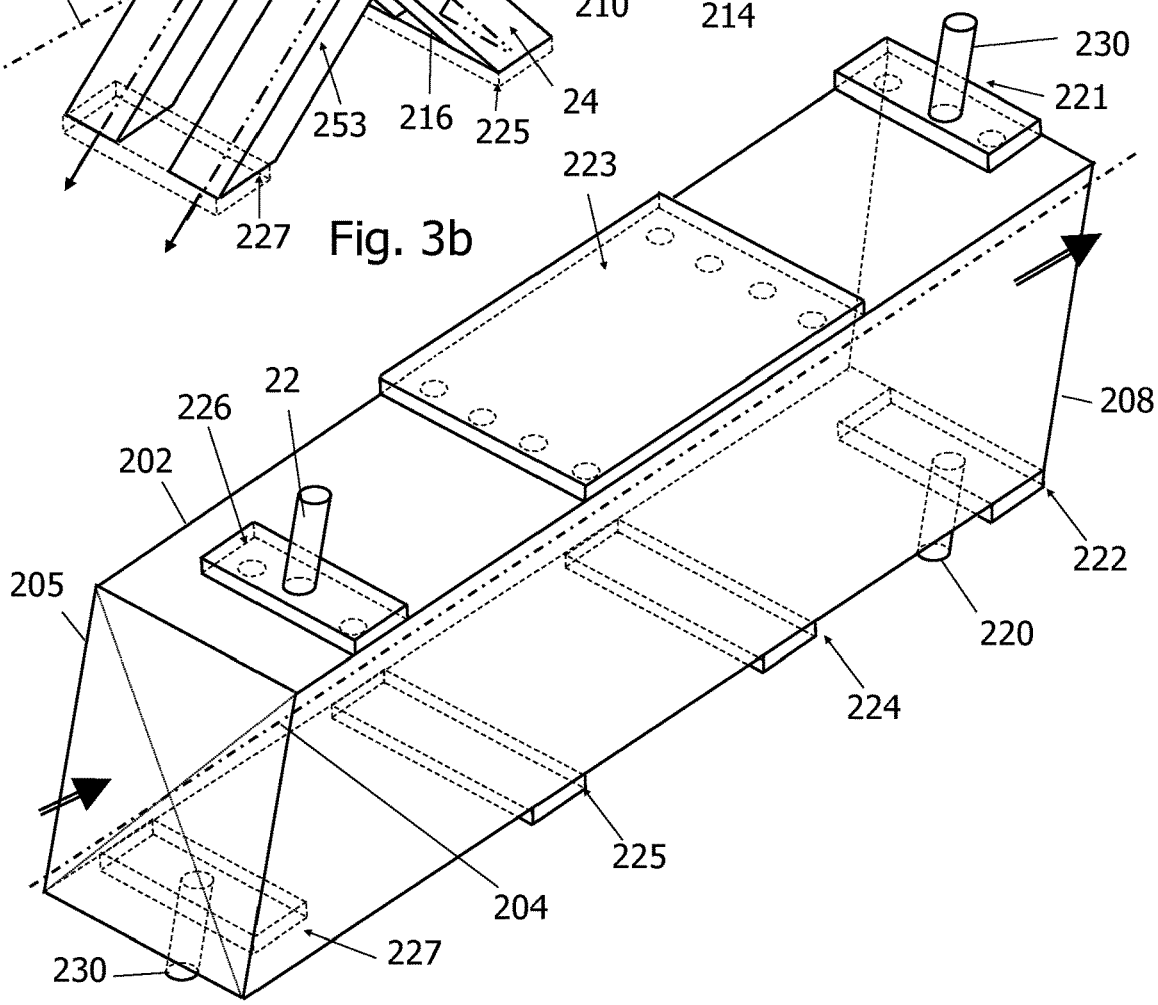

FIG. 3*b* shows the jacket element 202 without the insert element 203 located therein. The jacket element 202 has an inlet opening 205 and an outlet opening 208 for a fluid, flowable medium or fluid mixture which flows through the heat exchanger in the operating state. The direction of flow of the fluid is indicated by two arrows, which are shown with double lines. The jacket element 202 is at least partially designed as a hollow body, for example as a double jacket, in the sense that the jacket element 202 contains a plurality of chambers. A heat transfer fluid flows through these chambers in the operating state. The flow of the heat transfer fluid is shown in FIG. 3*a* by dash-dotted lines with two points between two adjacent lines. At the points at which the jacket element is designed as a double jacket, the jacket element is formed by an outer jacket and an inner jacket. The outer and inner shells are only shown transparent for the chambers in FIG. 3*a* to show the position of the chambers of the jacket element 202 in the installed state.

The jacket element 202 according to FIG. 3*b* contains at least two feeds 220 and two discharges 230. The jacket element 202 according to FIG. 3*a* or FIG. 3*b* comprises seven chambers. The first chamber 221 contains a discharge 230 comprising a tubular element containing an outlet channel for a heat transfer fluid. The second chamber 222 contains a feed 220 comprising a tubular element containing a further inlet channel for the heat transfer fluid. Each of the third, fourth, fifth chambers 223, 224, 225 contains inlet openings and outlet openings of the web elements 209, 210. The sixth chamber 226 contains a further inlet 220 which comprises a tubular element containing an inlet channel for the heat transfer fluid. The seventh chamber 227 contains a further discharge 230 which comprises a tubular element containing an outlet channel for the heat transfer fluid.

According to the present embodiment, each of the third, fourth, fifth chambers 223, 224, 225 is larger than the first, second, sixth and seventh chambers 221, 222, 226, 227. In particular, the width of each of the third, fourth, fifth chambers 223, 224, 225 can amount to 10% up to and including 25% of the circumference of the jacket element 202. The width of these chambers is measured in a plane which is arranged in a right angle with respect to the longitudinal axis 204.

According to FIG. 3*b*, the first chamber 221 does not extend from the inlet opening 205 to the outlet opening 208 for the fluid which flows through the jacket element 202 in the operating state. The first chamber 221 is only in fluid-conducting connection with the outlet openings 250 of the web elements 210 belonging to the web element set 251 and the discharge 230. According to this exemplary embodiment, the first chamber 221 does not extend over the entire length or width of the jacket element 202. The first chamber 221 forms part of the top surface of the jacket element 202 according to the position shown in FIG. 3*b*.

The second chamber 222 comprises the part of the bottom surface of the jacket element 202. The second chamber 222 is in fluid-conducting connection with the inlet openings 240 of the web elements 209 belonging to the web element set 241 and the feed 220. According to this exemplary embodiment, the second chamber 222 does not extend over the entire length or width of the jacket element 202. The second chamber 222 forms part of the bottom surface of the jacket element 202 according to the position shown in FIG. 3*b*.

According to the present exemplary embodiment, the third chamber 223 is arranged on the top surface of the jacket element 202. The third chamber 223 contains the outlet openings 250 of the web elements 209, which belong to the web element set 241, as well as the inlet openings 240 of the web elements 209 which belong to the web element set 242. The third chamber 223 contains the outlet openings 250 of the web elements 210, which belong to the web element set 252, as well as the inlet openings 240 of the web elements 210 which belong to the web element set 253.

All of the inlet openings 240 are shown as circular openings in FIG. 3*a*. This representation of the inlet openings 240 as circular openings is only to be viewed as an example and should not be interpreted as a restriction with respect to the shape of the opening cross section. The opening cross-section of the inlet openings can deviate from the circular shape, in particular, rectangular, polygonal, elliptical, or other opening cross-sections are possible. All of the outlet openings 250 are shown as circular openings in FIG. 3*a*. In order to be able to easily distinguish the outlet openings 250 from the inlet openings 240, their opening cross-sections have been blackened. This representation of the outlet openings 250 as circular openings is only to be viewed as an example and should not be interpreted as a restriction with respect to the shape of the opening cross section. The opening cross section of the outlet openings 250 can deviate from the circular shape; in particular, rectangular, polygonal, elliptical, or other opening cross sections are possible.

According to the present exemplary embodiment, the fourth chamber 224 is arranged on the bottom surface of the jacket element 202. The fourth chamber 224 contains the inlet openings 240 of the web element passages 212 of the web elements 210, which belong to the web element set 251, as well as the outlet openings 250 of the web element passages 211 of the web elements 209, which belong to the web element set 242.

According to the present exemplary embodiment, the fifth chamber 225 is arranged on the bottom surface of the jacket element 202. The fifth chamber 225 contains the inlet openings 240 of the web element passages 212 of the web elements 210, which belong to the web element set 252, and the outlet openings 250 of the web element passages 211 of the web elements 209, which belong to the web element set 243.

The sixth chamber 226 is only in fluid-conducting connection with the inlet openings 240 of the web elements 209 belonging to the web element set 243 and the feed 220. According to this exemplary embodiment, the sixth chamber 226 does not extend over the entire length or width of the jacket element 202. The sixth chamber 226 forms part of the top surface of the jacket element 202 in the position shown in FIG. 3*b*.

The seventh chamber 227 is only in fluid-conducting connection with the outlet openings 250 of the web elements 210 belonging to the web element set 253 and the discharge 230. According to this exemplary embodiment, the seventh chamber 227 does not extend over the entire length or width of the jacket element 202. The seventh chamber 227 forms part of the bottom surface of the jacket element 202 in the position shown in FIG. 3*b*.

According to the exemplary embodiment shown in FIG. 3*a* and FIG. 3*b*, the heat transfer fluid is fed to the web elements 209 of the web element set 243 via a feed 220 through the sixth chamber 226. The heat transfer fluid is also fed to the web elements 209 of the web element set 241 via a feed 220 through the second chamber 222. The sixth chamber 226 and the second chamber 222 therefore have the function of distributing the heat transfer fluid to the corresponding inlet openings 240 of the corresponding web element passages 211 of the web elements 209. The web element passages 211, 212, which run within the web elements 209, 210 are not shown, their course can be seen from the flow course of the heat transfer medium, which is shown by dash-dotted lines with two points between two adjacent lines.

The heat transfer fluid which flows from the second chamber 222 into the web element passages 211 of the web elements 209 of the web element set 241 passes through outlet openings 250 into the third chamber 223 and from there flows into the inlet openings 240 of the web element passages 211 of the web element set 242. The heat transfer fluid, which flows from of the fifth chamber 225 into the web element passages 212 of the web elements 210 of the web element set 252, passes through outlet openings 250 into the third chamber 223 and from there flows into the inlet openings 240 of the web element passages 212 of the web element set 252. From the third chamber 223 the heat transfer fluid flows through the corresponding inlet openings 240 either into the web element passages 211 of the web elements 209 of the web element set 242 to the fourth chamber 224 or into the web element passages 212 of the web elements 210 of the web element set 253 to the seventh chamber 227. In the seventh chamber 227, the heat transfer fluid coming from the web elements 210 of the web element set 253 is collected and fed to the discharge 230 in order to leave the heat exchanger.

The outlet openings 250 of the web element passages 211 of the web elements 209 of the web element set 242 and the inlet openings 240 of the web element passages 212 of the web elements 210 of the web element set 251 are located in the fourth chamber 224. The heat transfer fluid can flow through the outlet openings 250 into the inlet openings 240 and enters the web element passages 212 of the web elements 210 of the web element set 251 to the first chamber 221. The heat transfer fluid coming from the web element passages 212 of the web elements 210 of the web element set 251 is collected in the first chamber 221 and fed to the discharge 230 to exit the heat exchanger.

The outlet openings 250 of the web element passages 211 of the web elements 209 of the web element set 243 and the inlet openings 240 of the web element passages 212 of the web elements 210 of the web element set 252 are located in the fifth chamber 225. The heat transfer fluid can flow through the outlet openings 250 into the inlet openings 240 and reaches the web element passages 212 of the web elements 210 of the web element set 252 and reaches the third chamber 223. The outlet openings of the web element passages 212 of the web elements 210 of the web element set 252 are located in the third chamber 223.

The heat transfer fluid, which flows from the sixth chamber 226 into the web element passages 211 of the web elements 209 of the web element set 243, passes through outlet openings 250 into the fifth chamber 225 and from there flows into the inlet openings 240 of the web element passages 212 of the web element set 252 of the fifth chamber 225 flows into the web element passages 212 of the web elements 210 of the web element set 252, passes through outlet openings 250 into the third chamber 223 and from there flows into the inlet openings 240 of the web element passages 211 of the web element set 242, from there into the fourth chamber 224 and then into the first chamber 221.

According to the present exemplary embodiment, two different streams of heat transfer fluid are thus conducted in countercurrent flow to one another. The two heat transfer fluid streams, which otherwise have separate flow paths, are joined in the third chamber 223. A temperature equalization can take place in the third chamber 223 if the temperatures of the two different streams differ from one another.

The outlet openings of the web element passages 212 of the web elements 210 of the web element set 253 are located in the seventh chamber 227. The seventh chamber 227 contains an outlet opening 250 for a discharge 230.

The heat transfer fluid thus flows partly in the opposite direction with respect to the fluid, partly in the direction of the fluid, wherein the main direction of flow runs in the direction of the longitudinal axis 204 and is indicated by an arrow with a double line.

Figure 4A:
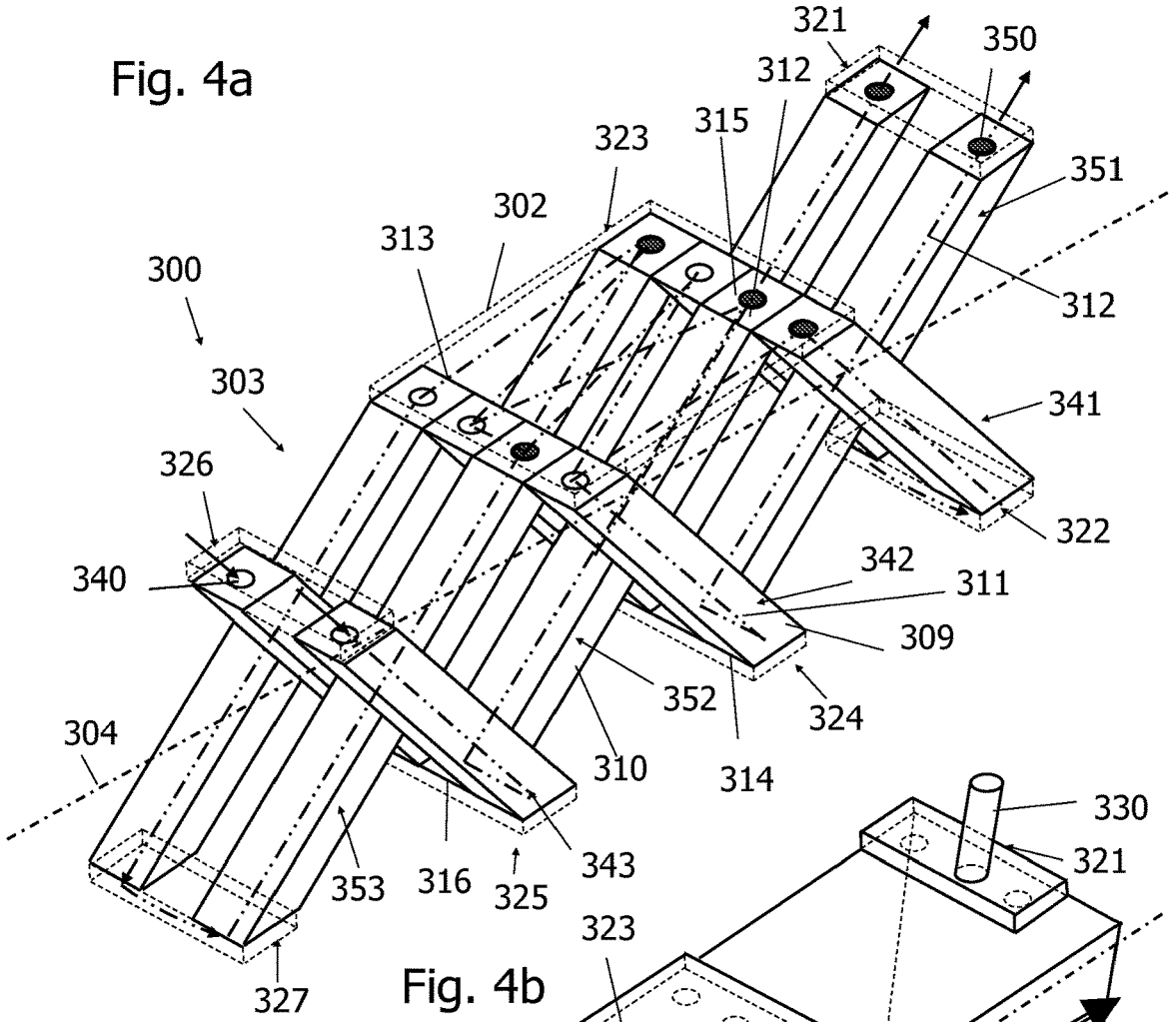

FIG. 4*a* shows a view of a heat exchanger 300 according to a fourth exemplary embodiment of the invention. The heat exchanger 300 according to FIG. 4*a* comprises a jacket element 302 and an insert element 303. In FIG. 4*a*, the jacket element is not shown in its entirety, only the chambers of the jacket element 302 are shown, the entire jacket element 302 can be seen from FIG. 4*b*. In the illustration according to FIG. 3*a*, the jacket element 302 is shown as a transparent component, so that the insert element 303 located in the interior of the jacket element 302 is visible. The heat exchanger 300 for static mixing and heat exchange according to FIG. 4*a* thus contains a jacket element 302 and an insert element 303, the insert element 303 being arranged inside the jacket element 302 in the installed state. The jacket element 302 is partially designed as a hollow body. The insert element 303 is received in the jacket element. The jacket element 302 has a longitudinal axis 304 which extends essentially in the main direction of flow of the flowable medium or fluid which flows through the jacket element 302 in the operating state. The longitudinal axis 304 runs through the center of the opening cross section of the jacket element and is better visible in FIG. 4*b*. According to the present illustration, the jacket element 302 has a rectangular opening cross section. The longitudinal axis 304 thus runs through the intersection of the diagonals of the rectangle.

The insert element 303 contains a plurality of web elements 309, 310. According to the present exemplary embodiment, the web elements 309 and the web elements 310 have a different angle of inclination with respect to the longitudinal axis 304. For the sake of simplicity, the reference symbols 309, 310 each designate only one of the web elements of the web element set. All of the other web elements of the web element sets belonging to the web element 309 are arranged parallel to the web element 309. All of the other web elements of the web element sets belonging to the web element 310 are arranged parallel to the web element 310.

Each of the web elements 309 has a first end 313 and a second end 314, the first end 313 and the second end 314 of the web element 309 being connected to the jacket element 302 at different locations. The web element 309 contains a web element passage 311. Only the inlet opening of the web element passage 311 is shown in the present illustration. Such web element passages are already known from EP 2851118 A1 and EP 3489603 A1. The web elements disclosed in these documents are to be regarded as examples of a large number of other possible web shapes. The jacket element 302 according to the invention can be used for any number, arrangement, or shape of the web elements.

The web element passage 311 extends from the first end 313 of the web element 309 to the second end 314 of the web element 309.

Each of the web elements 310 has a first end 315 and a second end 316, the first end 315 and the second end 316 of the web element 310 being connected to the jacket element 302 at different locations. The web element 310 contains a web element passage 312. Only the outlet opening of the web element passage 312 is shown in the present illustration. Such web element passages are already known from EP 2851118 A1 and EP 3489603 A1. The web elements disclosed in these documents are to be regarded as examples of a large number of other possible web shapes. The web element passage 312 extends from the first end 315 of the web element 310 to the second end 316 of the web element 310.

According to the exemplary embodiment shown in FIG. 4*a*, a first, second and third set of web elements are shown which consist of web elements 309. Furthermore, a first, second and third set of web elements are shown, which consist of web elements 310. According to this exemplary embodiment, each of the web element sets consists of two web elements. This arrangement is only to be regarded as an example. Each of the web element sets can contain more than two web elements. Each of the web element sets can have a different number of web elements. The number of web element sets can differ from the illustration according to FIG. 4*a*.

Figure 4B:
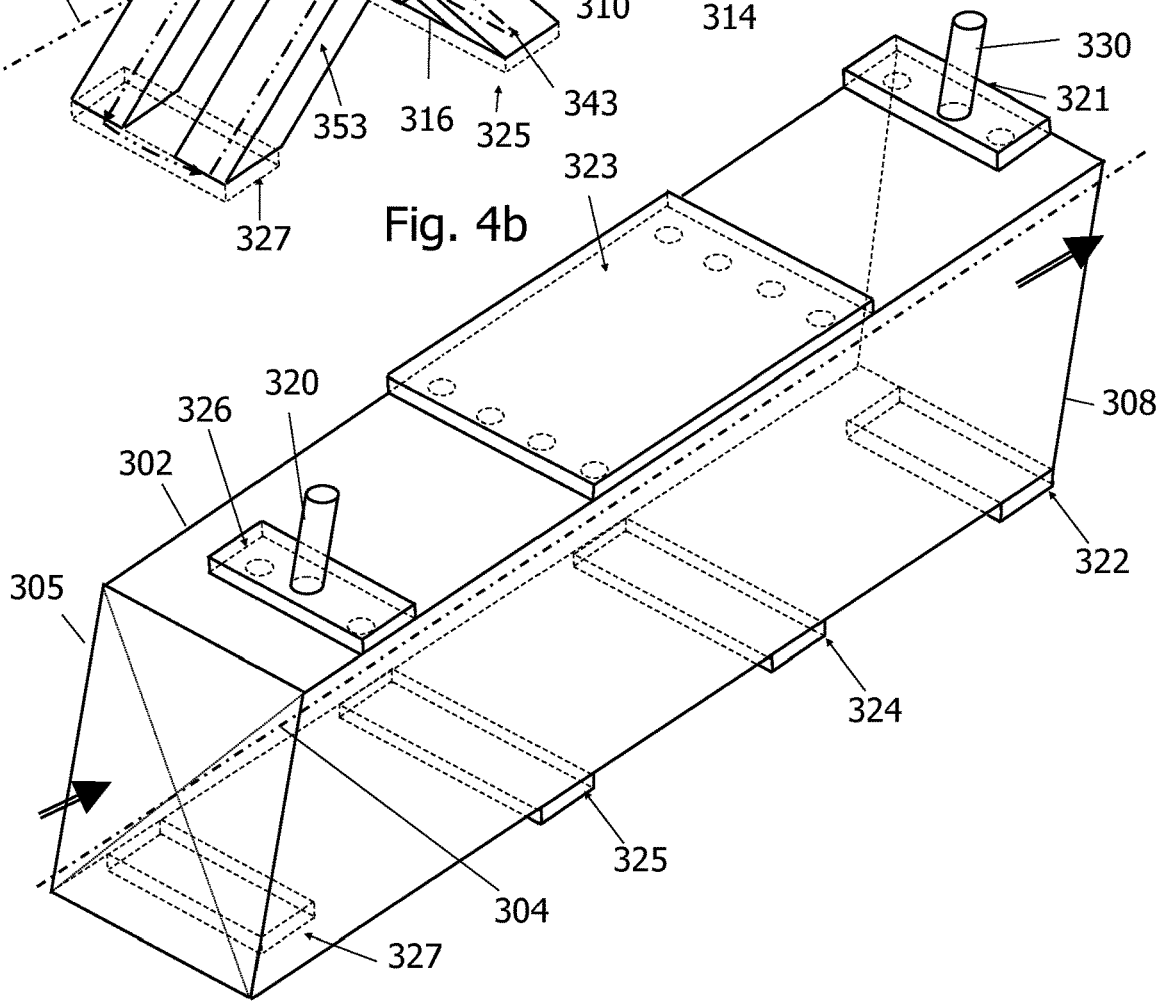

FIG. 4*b* shows the jacket element 302 without the insert element 303 located therein. The jacket element 302 has an inlet opening 305 and an outlet opening 308 for a fluid, flowable medium or fluid mixture which flows through the heat exchanger in the operating state. The direction of flow of the fluid is indicated by two arrows, which are shown with double lines. The jacket element 302 is at least partially designed as a hollow body, for example as a double jacket, in the sense that the jacket element 302 contains a plurality of chambers. A heat transfer fluid flows through these chambers in the operating state. The flow of the heat transfer fluid is shown in FIG. 4*a* by dash-dotted lines with two points between two adjacent lines. At the points at which the jacket element is designed as a double jacket, the jacket element is formed by an outer jacket and an inner jacket. The outer and inner shells are shown in FIG. 4*a* as transparent only for the chambers to show the position of the chambers of the jacket element 302 in the installed state.

The jacket element 302 according to FIG. 4*b* contains a feed 320 and a discharge 330. The jacket element 302 according to FIG. 4*a* or FIG. 4*b* comprises seven chambers. The first chamber 321 contains a discharge 330 comprising a tubular element containing an outlet channel for a heat transfer fluid. The second chamber 322 contains an inlet opening 340 and an outlet opening 350 for the heat transfer fluid that flows from one of the web element passages 311 of one of the web elements 309 into another web element passage 311 of another web element 309 of the web element set 341.

Each of the third, fourth, fifth chambers 323, 324, 325 contains inlet openings and outlet openings of the web elements 309, 310. The sixth chamber 326 contains a feed 320 which comprises a tubular element containing an inlet channel for the heat transfer fluid. The seventh chamber 227 contains an inlet opening 340 and an outlet opening 350 for the heat transfer fluid that flows from one of the web element passages 312 of one of the web elements 310 into another web element passage 312 of another web element 310 of the web element set 353.

Each of the third, fourth, fifth chambers 323, 324, 325 contains inlet openings and outlet openings of the web elements 309, 310. The sixth chamber 326 contains a feed 320 which comprises a tubular element containing an inlet channel for the heat transfer fluid. The seventh chamber 227 contains an inlet opening 340 and an outlet opening 350 for the heat transfer fluid that flows from one of the web element passages 312 of one of the web elements 310 into another web element passage 312 of another web element 310 of the web element set 353.

According to the present embodiment, each of the third, fourth, fifth chambers 323, 324, 325 is larger than the first, second, sixth and seventh chambers 321, 322, 326, 327. In particular, the width of each of the third, fourth, fifth chambers 323, 324, 325 can amount to 10% up to and including 25% of the circumference of the jacket element 302. The width of these chambers is measured in a plane which is arranged in a right angle with respect to the longitudinal axis 304.

According to FIG. 4*b*, the first chamber 321 does not extend from the inlet opening 305 to the outlet opening 308 for the fluid which flows through the jacket element 302 in the operating state. The first chamber 321 is only in fluid-conducting connection with the outlet openings 350 of the web elements 310 belonging to the web element set 351 and the discharge 330. According to this exemplary embodiment, the first chamber 221 does not extend over the entire length or width of the jacket element 302. The first chamber 321 forms part of the top surface of the jacket element 302 according to the position shown in FIG. 4*b*.

The second chamber 322 comprises the part of the bottom surface of the jacket element 202. The second chamber 322 is in fluid-conducting connection with an inlet opening 340 of a web element 309 belonging to the web element set 341 and with an outlet opening 350 of a web element 309 belonging to the web element set 341. According to this exemplary embodiment, the second chamber 322 does not extend over the entire length or width of the jacket element 302. The second chamber 322 forms part of the bottom surface of the jacket element 302 in the position shown in FIG. 4*b*.

According to the present exemplary embodiment, the third chamber 323 is arranged on the top surface of the jacket element 302. The third chamber 323 contains at least one outlet opening 350 of a web element 309 which belongs to the web element set 341. The third chamber 323 contains at least one outlet opening 350 of the web elements 310, which belong to the web element set 352, and an outlet opening 350 of a web element 310 which belongs to the web element set 353. The third chamber 323 contains at least one inlet opening 340 to a web element passage 311 of the web elements 309 which belong to the web element set 342. The third chamber 323 contains at least one inlet opening 340 to a web element passage 311 of the web elements 309 which belong to the web element set 341. The third chamber 323 contains at least one inlet opening 340 to a web element passage 312 of the web elements 310 which belong to web element set 353.

All of the inlet openings 340 are shown as circular openings in FIG. 4*a*. This representation of the inlet openings 340 as circular openings is only to be viewed as an example and should not be interpreted as a restriction with respect to the shape of the opening cross section. The opening cross-section of the inlet openings can deviate from the circular shape, in particular, rectangular, polygonal, elliptical, or other opening cross-sections are possible. All of the outlet openings 350 are shown as circular openings in FIG. 4*a*. In order to be able to easily distinguish the outlet openings 350 from the inlet openings 340, their opening cross-sections have been blackened. This representation of the inlet openings 340 or the outlet openings 350 as circular openings is only to be viewed as an example and should not be interpreted as a restriction with respect to the shape of the opening cross section. The opening cross-section of the inlet openings 340 and/or the outlet openings 350 can deviate from the circular shape, in particular, rectangular, polygonal, elliptical, or other opening cross-sections are possible.

According to the present exemplary embodiment, the fourth chamber 324 is arranged on the bottom surface of the jacket element 302. The fourth chamber 324 contains the inlet openings 340 of the web element passages 312 of the web elements 310, which belong to the web element set 351, and the outlet openings 350 of the web element passages 311 of the web elements 309, which belong to the web element set 342.

According to the present exemplary embodiment, the fifth chamber 325 is arranged on the bottom surface of the jacket element 302. The fifth chamber 325 contains the inlet openings 340 of the web element passages 312 of the web elements 310, which belong to the web element set 352, and the outlet openings 350 of the web element passages 311 of the web elements 309, which belong to the web element set 343.

The sixth chamber 326 is only in fluid-conducting connection with the inlet openings 340 of the web element passages 311 of the web elements 309 belonging to the web element set 343 and the feed 320. According to this exemplary embodiment, the sixth chamber 326 does not extend over the entire length or width of the jacket element 302. The sixth chamber 326 forms part of the top surface of the jacket element 302 according to the position shown in FIG. 4*b*.

The seventh chamber 327 is only in fluid-conducting connection with the outlet opening 350 of one of the web element passages 312 of the web elements 210 belonging to the web element set 353 and the inlet opening 340 of one of the web element passage 312 of the web elements 210 belonging to the web element set 353. According to this exemplary embodiment, the seventh chamber 327 does not extend over the entire length or width of the jacket element 302. The seventh chamber 327 forms part of the bottom surface of the jacket element 302 according to the position shown in FIG. 4*b*.

According to the exemplary embodiment shown in FIG. 4*a* and FIG. 4*b*, the heat transfer fluid is fed via a feed 320 through the sixth chamber 326 to the web element passages 311 of the web elements 309 of the web element set 343. The sixth chamber 326 therefore has the function of distributing the heat transfer fluid to the corresponding inlet openings 340 of the corresponding web element passages 311 of the web elements 309. The web element passages 311, 312, which run within the web elements 309, 310, are not shown, their course can be seen from the flow course of the heat transfer medium, which is shown by dash-dotted lines with two points between two adjacent lines.

The heat transfer fluid which flows from the sixth chamber 326 into the web element passages 311 of the web elements 309 of the web element sets 343 passes through outlet openings 350 into the fifth chamber 325 and flows from there into the inlet openings 340 of the web element passages 312 of the web elements 310 of the web element set 352. The heat transfer fluid passes through outlet openings 350 into the third chamber 323 and flows from there into the inlet openings 340 of the web element passages 311 of the web elements 309 of the web element set 342 or the inlet opening 340 of the web element passage 312 of the web elements 310 of the web element set 353. The heat transfer fluid flows into the web element passages 309 of the web element set 342 to the fourth chamber 324. From the fourth chamber 324 the heat transfer fluid flows into the web element passages 312 of the web elements 310 of the web element set 351 and enters the first chamber 312 via corresponding outlet openings 350, and from the fourth chamber, an inlet opening leads into the discharge 330, through which the heat transfer fluid leaves the heat exchanger.

The heat transfer fluid which flows from the third chamber 323 through the inlet opening 340 into the web element passage 312 of one of the web elements 310 of the web element set 353 reaches an outlet opening 350 which opens into the seventh chamber 327. The seventh chamber contains an inlet opening 340 into the further web element passage 312 of the other web element 310 of the web element set 353, through which the heat transfer fluid can in turn flow into the third chamber 323. The heat transfer fluid can flow to discharge 330 in one of the ways described in the previous paragraph.

The heat transfer fluid can also enter from the third chamber 323 into an inlet opening 340 which is connected to one of the web element passages 311 of one of the web elements 309 of the web element set 341. This heat transfer fluid can flow into the second chamber 322, and can enter the second chamber 322 via an outlet opening 350 and reach this second chamber 322 via an inlet opening 340 in the other of the web element passages 311 of the web elements 309 of the web element set 341 and flow back from there into the third chamber 323.

The outlet openings 350 of the web element passages 311 of the web elements 309 of the web element set 342 and the inlet openings 340 of the web element passages 312 of the web elements 310 of the web element set 351 are arranged in the fourth chamber 324. The heat transfer fluid can flow through the outlet openings 250 into the inlet openings 240 and reaches the web element passages 312 of the web elements 310 of the web element set 351 leading to the first chamber 321. The heat transfer fluid from the web element passages 312 of the web elements 310 of the web element set 351 is fed to the discharge 330 to leave the heat exchanger.

The outlet openings 350 of the web element passages 311 of the web elements 309 of the web element set 343 and the inlet openings 340 of the web element passages 312 of the web elements 310 of the web element set 352 are located in the fifth chamber 325. The heat transfer fluid can flow through the outlet openings 350 into the inlet openings 340 and reaches the web element passages 312 of the web elements 310 of the web element set 351 leading to the third chamber 323. The outlet openings of the web element passages 312 of the web elements 310 of the web element set 352 are located in the third chamber 323.

The heat transfer fluid which flows from the sixth chamber 326 into the web element passages 311 of the web elements 309 of the web element set 343 passes through outlet openings 350 into the fifth chamber 325 and from there flows into the inlet openings 340 of the web element passages 312 of the web elements 310 of the web element set 352. The heat transfer fluid, which flows from the fifth chamber 325 into the web element passages 312 of the web elements 310 of the web element set 352, passes through outlet openings 350 into the third chamber 323 and from there flows into the inlet openings 340 of the web element passages 311 of the web element set 342, from there into the fourth chamber 324 and then into the first chamber 321.

According to the present exemplary embodiment, a heat transfer fluid flow is divided in the third chamber 323 and can be returned to the third chamber 323 via the second chamber 322 or the seventh chamber 327 and passed from the third chamber 323 via the fourth chamber 324 to the first chamber 321, which contains the discharge 330. If the heat exchange surface is to be reduced, the corresponding inlet opening 340 and outlet opening 350 to the second chambers 322 and/or seventh chambers 327 in the third chamber 323 can be closed so that the flow does not flow through all of the web element passages 311, 312. According to this variant, the available heat exchange area can thus be adjusted by providing shut-off devices are provided in only one chamber, namely the third chamber 323.

According to this exemplary embodiment, the heat transfer fluid flows crosswise co-currently with respect to the fluid, wherein the main direction of flow runs in the direction of the longitudinal axis 304 and is indicated by an arrow with a double line.

Figure 5A:
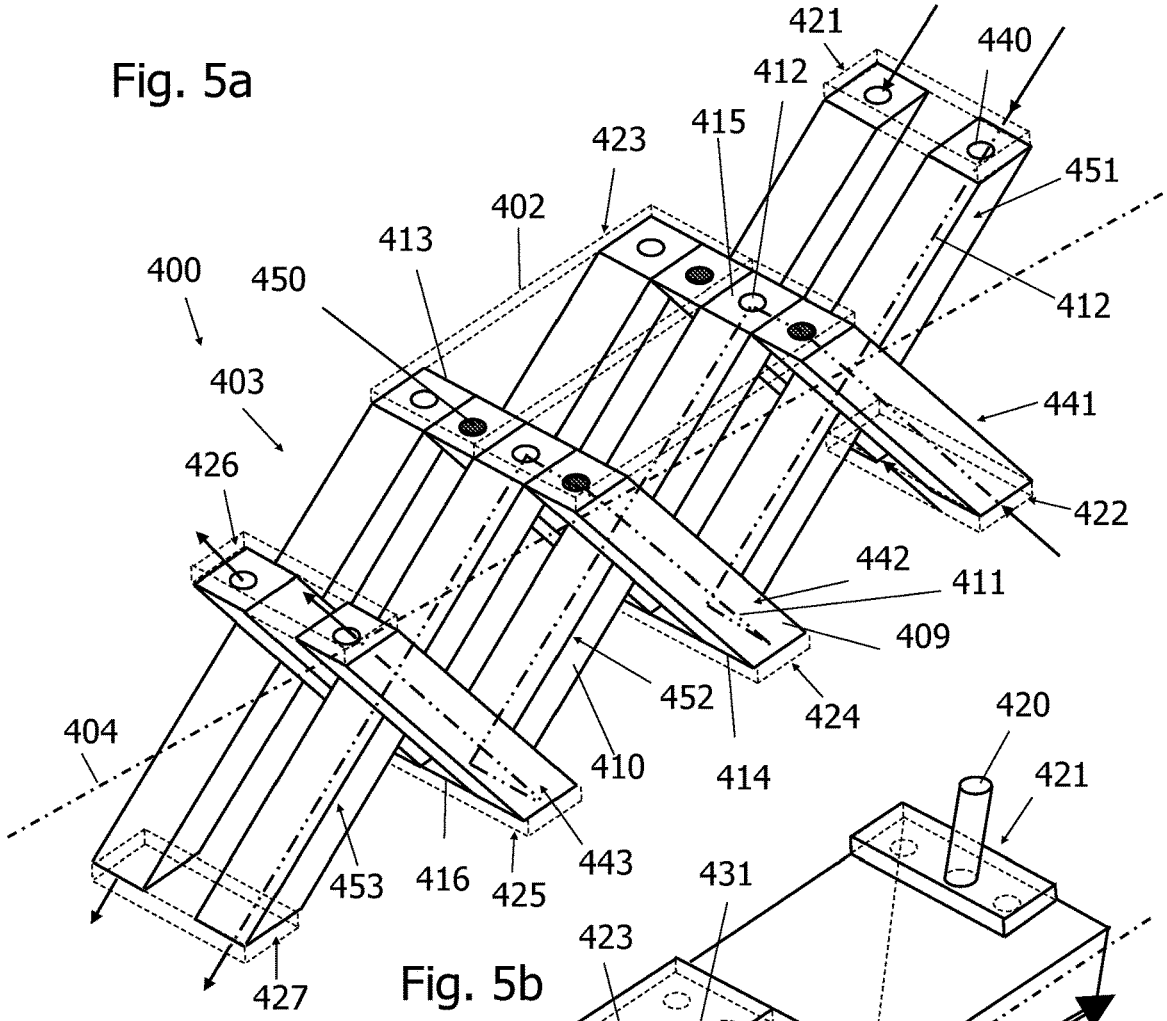

FIG. 5*a* shows a view of a heat exchanger 400 according to a fifth exemplary embodiment of the invention. The heat exchanger 400 according to FIG. 5*a* comprises a jacket element 402 and an insert element 403. In FIG. 5*a*, the jacket element is not shown completely, only the chambers of the jacket element 402 are shown, the entire jacket element 402 can be seen from FIG. 5*b*. In the illustration according to FIG. 5*a*, the jacket element 402 is shown as a transparent component, so that the insert element 403 located in the interior of the jacket element 402 is visible. The heat exchanger 400 for static mixing and heat exchange according to FIG. 5*a* thus contains a jacket element 402 and an insert element 403, the insert element 403 being arranged in the interior of the jacket element 402 in the installed state. The jacket element 402 is partially designed as a hollow body. The insert element 403 is received in the jacket element. The jacket element 402 has a longitudinal axis 404, which extends essentially in the main direction of flow of the flowable medium or fluid or fluid mixture which flows through the jacket element 402 in the operating state. The longitudinal axis 404 runs through the center of the opening cross section of the jacket element and is better visible in FIG. 5*b*. According to the present illustration, the jacket element 402 has a rectangular opening cross section. The longitudinal axis 404 thus runs through the intersection of the diagonals of the rectangle.

The insert element 403 contains a plurality of web elements 409, 410. According to the present exemplary embodiment, the web elements 409 and the web elements 410 have a different angle of inclination with respect to the longitudinal axis 404. For the sake of simplicity, the reference numerals 409, 410 each designate only one of the web elements of the web element set. All of the other web elements of the web element sets belonging to the web element 409 are arranged parallel to the web element 409. All of the other web elements of the web element sets belonging to the web element 410 are arranged parallel to the web element 410.

Each of the web elements 409 has a first end 413 and a second end 414, the first end 413 and the second end 414 of the web element 409 being connected to the jacket element 402 at different locations. The web element 409 contains a web element passage 411. Only the inlet opening of the web element passage 411 is shown in the present illustration. Such web element passages are already known from EP 2851118 A1 and EP 3489603 A1. The web elements disclosed in these documents are to be regarded as examples of a large number of other possible web shapes. The jacket element 202 according to the invention can be used for any number, arrangement, or shape of the web elements.

The web element passage 411 extends from the first end 413 of the web element 409 to the second end 414 of the web element 409.

Each of the web elements 410 has a first end 415 and a second end 416, the first end 415 and the second end 416 of the web element 410 being connected to the jacket element 402 at different locations. The web element 410 contains a web element passage 412. Only the outlet opening of the web element passage 412 is shown in the present illustration. Such web element passages are already known from EP 2851118 A1 and EP 3489603 A1. The web elements disclosed in these documents are to be regarded as examples of a large number of other possible web shapes. The web element passage 412 extends from the first end 415 of the web element 410 to the second end 416 of the web element 410.

According to the exemplary embodiment shown in FIG. 5*a*, a first, second and third set of web elements are shown which consist of web elements 409. Furthermore, a first, second and third set of web elements are shown, which consist of web elements 410. According to this exemplary embodiment, each of the web element sets consists of two web elements. This arrangement is only to be regarded as an example. Each of the web element sets can contain more than two web elements. Each of the web element sets can have a different number of web elements. The number of web element sets can differ from the illustration according to FIG. 5*a*.

Figure 5B:
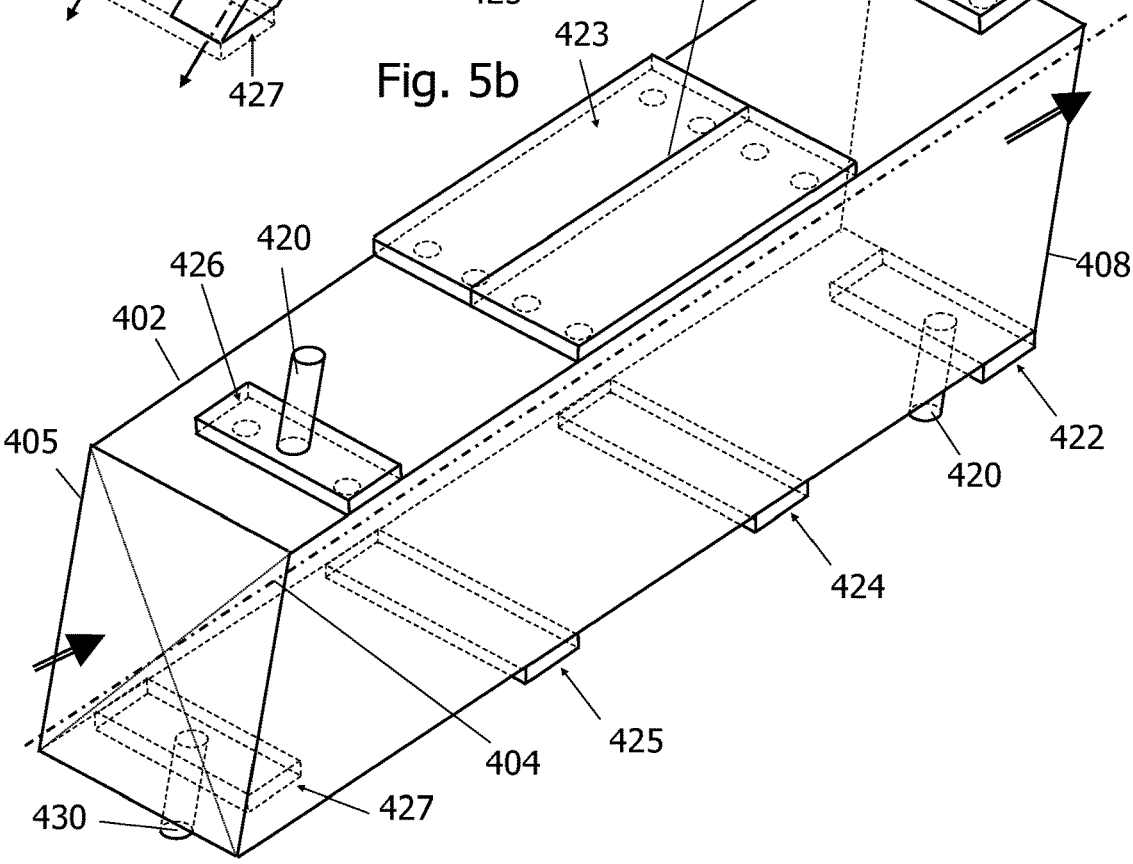

FIG. 5*b* shows the jacket element 402 without the insert element 403 located therein. The jacket element 402 has an inlet opening 405 and an outlet opening 408 for a fluid, flowable medium or fluid mixture which flows through the heat exchanger in the operating state. The direction of flow of the fluid is indicated by two arrows, which are shown with double lines. The jacket element 402 is at least partially designed as a hollow body, for example as a double jacket, in the sense that the jacket element 402 contains a plurality of chambers. A heat transfer fluid flows through these chambers in the operating state. The flow of the heat transfer fluid is shown in FIG. 5*a* by dash-dotted lines with two points between two adjacent lines. At the points at which the jacket element is designed as a double jacket, the jacket element is formed by an outer jacket and an inner jacket. The outer and inner shells are shown in FIG. 5*a* as transparent only for the chambers to show the position of the chambers of the jacket element 402 in the installed state.

The jacket element 402 according to FIG. 5*b* contains at least two feeds 420 and two discharges 430. The jacket element 402 according to FIG. 5*a* or FIG. 5*b* comprises seven chambers. The first chamber 421 contains a feed 420, comprising a tubular element, containing an inlet channel for a heat transfer fluid. The second chamber 422 contains a feed 420, comprising a tubular element, containing a further inlet channel for the heat transfer fluid. Each of the third, fourth, fifth chambers 423, 424, 425 contains inlet openings and outlet openings of the web elements 409, 410. The sixth chamber 426 contains a discharge 430 which comprises a tubular element containing an outlet channel for the heat transfer fluid. The seventh chamber 427 contains a further discharge 430 which comprises a tubular element containing an outlet channel for the heat transfer fluid.

According to the present embodiment, each of the third, fourth, fifth chambers 423, 424, 425 is larger than the first, second, sixth and seventh chambers 421, 422, 426, 427. In particular, the width of each of the third, fourth, fifth chambers 423, 424, 425 can amount to 10% up to and including 25% of the circumference of the jacket element 402. The width of these chambers is measured in a plane which is arranged in a right angle with respect to the longitudinal axis 404.

According to FIG. 5*b*, the first chamber 421 does not extend from the inlet opening 405 to the outlet opening 408 for the fluid which flows through the jacket element 402 in the operating state. The first chamber 421 is only in fluid-conducting connection with the inlet openings 440 of the web elements 410 belonging to the web element set 451 and the inlet 420. According to this exemplary embodiment, the first chamber 421 does not extend over the entire length or width of the jacket element 402. The first chamber 421 forms part of the top surface of the jacket element 402 according to the position shown in FIG. 5*b*.

The second chamber 422 comprises the part of the bottom surface of the jacket element 402. The second chamber 422 is in fluid-conducting connection with the inlet openings 440 of the web elements 409 belonging to the web element set 441 and the feed 420. According to this exemplary embodiment, the second chamber 422 does not extend over the entire length or width of the jacket element 402. The second chamber 422 forms part of the bottom surface of the jacket element 402 according to the position shown in FIG. 5*b*.

According to the present exemplary embodiment, the third chamber 423 is arranged on the top surface of the jacket element 402. The third chamber 423 contains the outlet openings 450 of the web elements 409, which belong to the web element set 441, and the outlet openings 450 of the web elements 409 which belong to the web element set 442. The third chamber 423 contains the inlet openings 440 of the web elements 410, which belong to the web element set 452, as well as the inlet openings 440 of the web elements 410 which belong to the web element set 453.

All of the inlet openings 440 are shown as circular openings in FIG. 5*a*. This representation of the inlet openings 440 as circular openings is only to be viewed as an example and should not be interpreted as a restriction with respect to shape of the opening cross section. The opening cross-section of the inlet openings can deviate from the circular shape, in particular, rectangular, polygonal, elliptical, or other opening cross-sections are possible. All of the outlet openings 450 are shown as circular openings in FIG. 5*a*. In order to be able to easily distinguish the outlet openings 450 from the inlet openings 440, their opening cross-sections have been blackened. This representation of the outlet openings 450 as circular openings is only to be viewed as an example and should not be interpreted as a restriction with respect to the shape of the opening cross section. The opening cross-section of the outlet openings 450 can deviate from the circular shape, in particular, rectangular, polygonal, elliptical, or other opening cross-sections are possible.

According to the present exemplary embodiment, the fourth chamber 424 is arranged on the bottom surface of the jacket element 402. The fourth chamber 424 contains the outlet openings 450 of the web element passages 412 of the web elements 410, which belong to the web element set 451, and the inlet openings 440 of the web element passages 411 of the web elements 409, which belong to the web element set 442.

According to the present exemplary embodiment, the fifth chamber 425 is arranged on the bottom surface of the jacket element 402. The fifth chamber 425 contains the outlet openings 450 of the web element passages 412 of the web elements 410, which belong to the web element set 452, and the inlet openings 440 of the web element passages 411 of the web elements 409, which belong to the web element set 443.

The sixth chamber 426 is only in fluid-conducting connection with the outlet openings 450 of the web elements 409 belonging to the web element set 443 and the discharge 430. According to this exemplary embodiment, the sixth chamber 426 does not extend over the entire length or width of the jacket element 402. The sixth chamber 426 forms part of the top surface of the jacket element 402 according to the position shown in FIG. 5*b*.

The seventh chamber 427 is only in fluid-conducting connection with the outlet openings 450 of the web elements 410 belonging to the web element set 453 and the discharge 430. According to this exemplary embodiment, the seventh chamber 427 does not extend over the entire length or width of the jacket element 402. The seventh chamber 427 forms part of the bottom surface of the jacket element 402 according to the position shown in FIG. 5*b*.

According to the embodiment shown in FIG. 5*a* and FIG. 5*b*, the heat transfer fluid is fed via a feed 420 through the first chamber 421 to the web elements 410 of the web element set 451 and via a feed 420 through the second chamber 422 to the web elements 409 of the web element set 441. The first chamber 421 and the second chamber 422 therefore have the function of distributing the heat transfer fluid to the corresponding inlet openings 440 of the corresponding web element passages 411 of the web elements 409. The web element passages 411, 412, which run within the web elements 409, 410, are not shown, their course can be seen from the flow course of the heat transfer medium, which is shown by dash-dotted lines with two points between two adjacent lines.

The heat transfer fluid which flows from the second chamber 422 into the web element passages 411 of the web elements 409 of the web element set 441 passes through outlet openings 450 into the third chamber 423 and from there flows into the inlet openings 440 of the web element passages 412 of the web element set 452. The heat transfer fluid, which flows from of the first chamber 421 into the web element passages 412 of the web elements 410 of the web element set 451, passes through outlet openings 450 into the fourth chamber 424 and from there flows into the inlet openings 440 of the web element passages 411 of the web elements 409 of the web element set 442 and enters the third chamber 423 the via outlet openings 450. The heat transfer fluid flows from the third chamber 423 through the corresponding inlet openings 440 either into the web element passages 412 of the web elements 410 of the web element set 452 to the fifth chamber 425 or into the web element passages 412 of the web elements 410 of the web element set 453 to the seventh chamber 427, the heat transfer fluid coming from the web element passages of the web elements 410 of the web element set 453 is collected in the seventh chamber 427 and fed to the discharge 430 in order to leave the heat exchanger.

The outlet openings 450 of the web element passages 412 of the web elements 410 of the web element set 452 and the inlet openings 240 of the web element passages 411 of the web elements 409 of the web element set 443 are arranged in the fifth chamber 425. The heat transfer fluid can flow through the outlet openings 250 into the inlet openings 240 and passes through the web element passages 411 of the web elements 409 of the web element set 443 to reach the sixth chamber 426. The heat transfer fluid coming from the web element passages 411 of the web elements 409 of the web element set 443 is collected in the sixth chamber 426 and fed to the discharge 430 to leave the heat exchanger.

According to the present exemplary embodiment, two partial flows of the heat transfer fluid are thus guided parallel to one another. A partition 431 is provided in the third chamber 423 so that the heat transfer fluid of the two partial flows cannot be merged. A temperature equalization can take place in the third chamber 423 via the partition 431 if the temperatures of the two different flows differ significantly from one another, which would only be expected with different dimensions of the web element passages of at least one of the web element sets. As a rule, however, the web element passages of each web element set will have essentially the same opening cross section, so that the flow velocity of the heat transfer fluid in each of the web element passages of each web element set is the same. Therefore, a heat exchanger according to the exemplary embodiment shown in FIG. 5*a* or FIG. 5*b* is particularly advantageous in order to obtain an essentially homogeneous temperature distribution in each cross-sectional area through which the fluid flows.

The heat transfer fluid thus flows in the opposite direction to the fluid, wherein the main direction of flow runs in the direction of the longitudinal axis 404 and is indicated by an arrow with a double line.

Figure 6A:
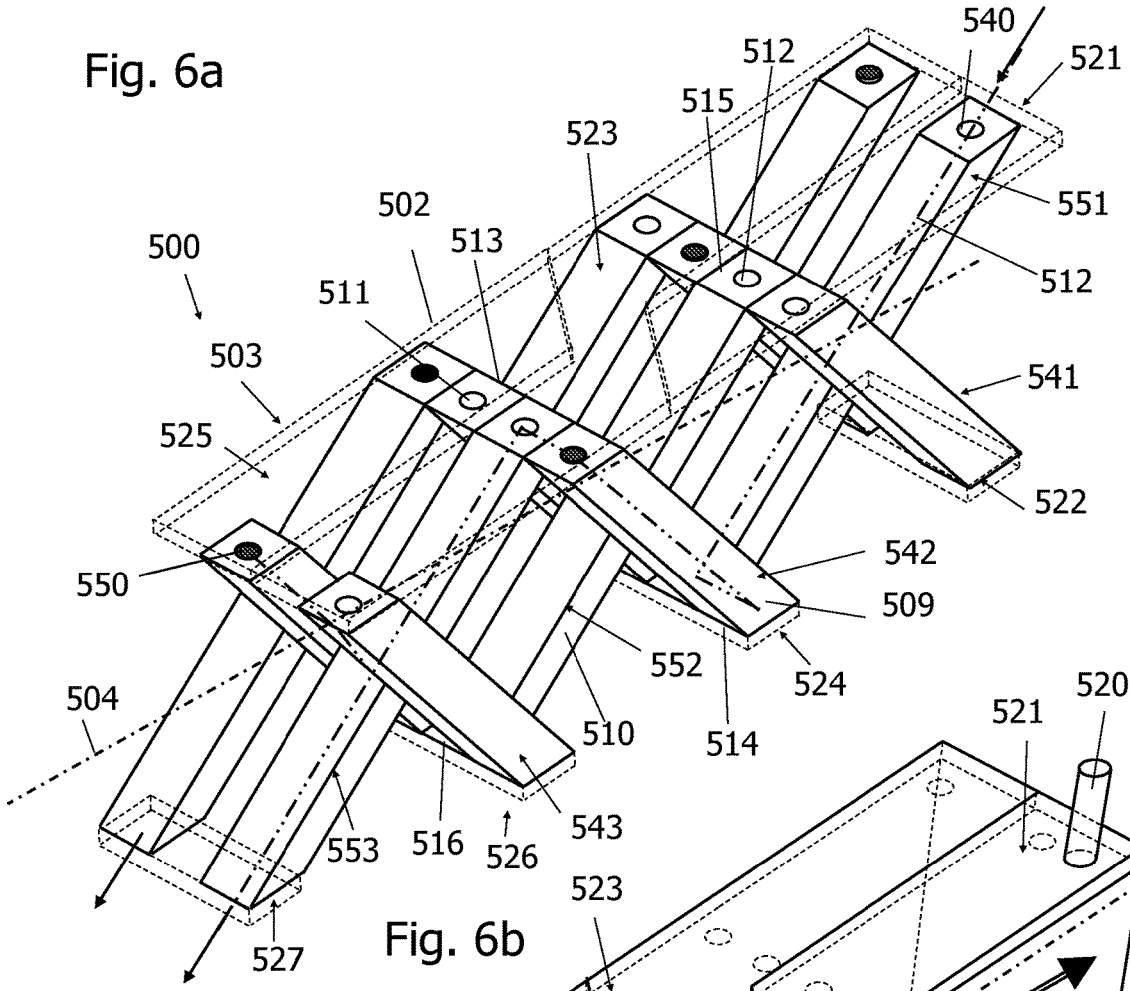

FIG. 6*a* shows a view of a heat exchanger 500 according to a sixth exemplary embodiment of the invention. The heat exchanger 500 according to FIG. 6*a* comprises a jacket element 502 and an insert element 503. In FIG. 6*a*, the jacket element 502 is not shown completely, only the chambers of the jacket element 502 are shown, the entire jacket element 502 can be seen from FIG. 6*b*. In the illustration according to FIG. 6*a*, the jacket element 502 is shown as a transparent component, so that the insert element 503 located in the interior of the jacket element 502 is visible. The heat exchanger 500 for static mixing and heat exchange according to FIG. 6*a* thus contains a jacket element 502 and an insert element 503, the insert element 503 being arranged in the interior of the jacket element 502 in the installed state. The jacket element 502 is partially designed as a hollow body. The insert element 503 is received in the jacket element. The jacket element 502 has a longitudinal axis 504, which extends essentially in the main flow direction of the flowable medium or fluid or fluid mixture which flows through the jacket element 502 in the operating state. The longitudinal axis 504 runs through the center of the opening cross section of the jacket element and is better visible in FIG. 6*b*. According to the present illustration, the jacket element 502 has a rectangular opening cross section. The longitudinal axis 504 thus runs through the intersection of the diagonals of the rectangle.

The insert element 503 contains a plurality of web elements 509, 510. According to the present exemplary embodiment, the web elements 509 and the web elements 510 have a different angle of inclination with respect to the longitudinal axis 504. For the sake of simplicity, the reference numerals 509, 510 each designate only one of the web elements of the web element set. All of the other web elements of the web element sets belonging to the web element 509 are arranged parallel to the web element 509. All of the other web elements of the web element sets belonging to the web element 510 are arranged parallel to the web element 510.

The insert element 503 contains a plurality of web elements 509, 510. According to the present exemplary embodiment, the web elements 509 and the web elements 510 have a different angle of inclination with respect to the longitudinal axis 504. For the sake of simplicity, the reference numerals 509, 510 each designate only one of the web elements of the web element set. All of the other web elements of the web element sets belonging to the web element 509 are arranged parallel to the web element 509. All of the other web elements of the web element sets belonging to the web element 510 are arranged parallel to the web element 510.

Each of the web elements 509 has a first end 513 and a second end 514, the first end 513 and the second end 514 of the web element 509 being connected to the jacket element 502 at different locations. The web element 509 contains a web element passage 511. Only the inlet opening of the web element passage 511 is shown in the present illustration. Such web element passages are already known from EP 2851118 A1 and EP 3489603 A1. The web elements disclosed in these documents are to be regarded as examples of a large number of other possible web shapes. The jacket element 502 according to the invention can be used for any number, arrangement, or shape of the web elements.

The web element passage 511 extends from the first end 513 of the web element 509 to the second end 514 of the web element 509.

Each of the web elements 510 has a first end 515 and a second end 516, the first end 515 and the second end 516 of the web element 510 being connected to the jacket element 502 at different locations. The web element 510 contains a web element passage 512. Only the outlet opening of the web element passage 512, is shown in the present illustration. Such web element passages are already known from EP 2851118 A1 and EP 3489603 A1. The web elements disclosed in these documents are to be regarded as examples of a large number of other possible web shapes. The web element passage 512 extends from the first end 515 of the web element 510 to the second end 516 of the web element 510.

According to the exemplary embodiment shown in FIG. 6*a*, a first, second and third set of web elements are shown which consist of web elements 509. Furthermore, a first, second and third set of web elements are shown, which consist of web elements 510. According to this exemplary embodiment, each of the web element sets consists of two web elements. This arrangement is only to be regarded as an example. Each of the web element sets can contain more than two web elements. Each of the web element sets can have a different number of web elements. The number of web element sets can differ from the illustration according to FIG. 6*a*.

Figure 6B:
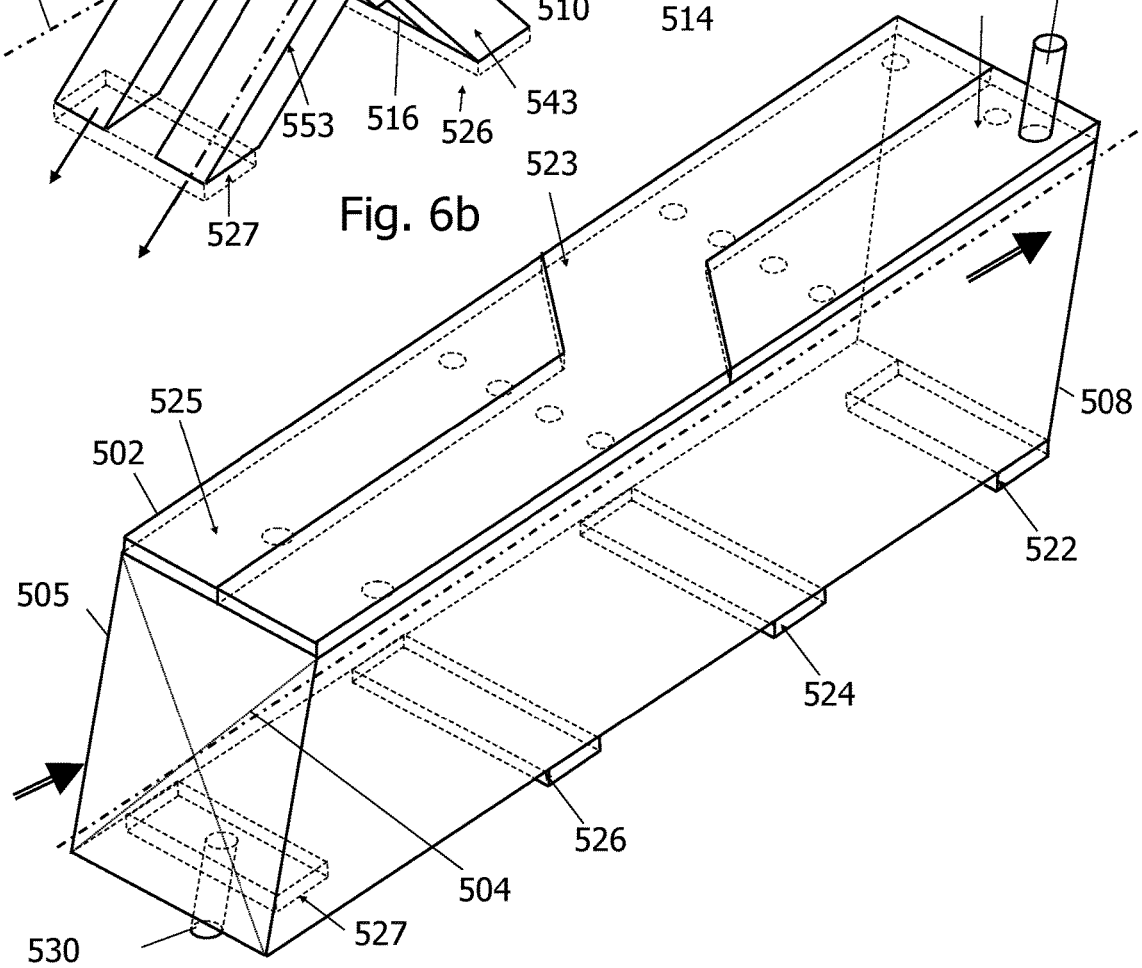

FIG. 6*b* shows the jacket element 502 without the insert element 503 located therein. The jacket element 502 has an inlet opening 505 and an outlet opening 508 for a fluid, flowable medium or fluid mixture which flows through the heat exchanger in the operating state. The direction of flow of the fluid is indicated by two arrows, which are shown with double lines. The jacket element 502 is at least partially designed as a hollow body, for example as a double jacket, in the sense that the jacket element 502 contains a plurality of chambers. A heat transfer fluid flows through these chambers in the operating state. The flow of the heat transfer fluid is shown in FIG. 6*a* by dash-dotted lines with two points between two adjacent lines. At the points at which the jacket element is designed as a double jacket, the jacket element is formed by an outer jacket and an inner jacket. The outer and inner shells are shown in FIG. 6*a* as transparent only for the chambers to show the position of the chambers of the jacket element 502 in the installed state.

The jacket element 502 according to FIG. 6*b* contains at least one feed 520 and one discharge 530. The jacket element 502 according to FIG. 6*a* or FIG. 6*b* comprises seven chambers. The first chamber 521 contains a feed 520, comprising a tubular element, containing an inlet channel for a heat transfer fluid. Each of the third, fourth, fifth, and sixth chambers 523, 524, 526 contains inlet openings and outlet openings of the web elements 509, 510. The seventh chamber 527 contains a discharge 530 which comprises a tubular element containing an outlet channel for the heat transfer fluid.

According to the present embodiment, each of the first, third, fourth, fifth, sixth chambers 521, 523, 524, 525, 526 is larger than the second and seventh chambers 522, 227. In particular, the width of each of the first, third, fourth, fifth, sixth chambers 521, 523, 524, 525, 526 can amount to 10% up to and including 25% of the circumference of the jacket element 502. The width of these chambers is measured in a plane which is arranged in a right angle with respect to the longitudinal axis 504.

According to FIG. 6*b*, the first chamber 521 does not extend from the inlet opening 505 to the outlet opening 508 for the fluid which flows through the jacket element 502 in the operating state. The first chamber 521 is in fluid-conducting connection with the inlet openings 540 of the web elements 510 belonging to the web element set 551, the inlet openings 540 of the web elements 510 belonging to the web element set 552, the inlet openings 540 of the web elements 509 belonging to the web element set 541 and the feed 520. According to this exemplary embodiment, the first chamber 521 does not extend over the entire length or width of the jacket element 502. The first chamber 521 forms part of the top surface of the jacket element 502 according to the position shown in FIG. 6*b*.

The second chamber 522 comprises the part of the bottom surface of the jacket element 502. The second chamber 522 is in fluid-conducting connection with an inlet opening 540 and an outlet opening 550 of the web elements 509 belonging to the web element set 541. According to this exemplary embodiment, the second chamber 522 does not extend over the entire length or width of the jacket element 502. The second chamber 522 forms part of the bottom surface of the jacket element 502 according to the position shown in FIG. 6*b*.

According to the present exemplary embodiment, the third chamber 523 is arranged on the top surface of the jacket element 502. The third chamber 523 contains an outlet opening 550 of the web elements 509, which belong to the web element set 541, and an outlet opening 550 of the web elements 509 which belong to the web element set 542. The third chamber 523 contains an outlet opening 550 of the web elements 510, which belong to the web element set 551, as well as inlet openings 540 of the web elements 510, which belong to the web element sets 552 or 553. The third chamber 523 contains an inlet opening 540 of the web elements 509, which belong to the web element set 543. According to this exemplary embodiment, the third chamber 523 extends over the entire length, but not the entire width of the jacket element 502. The third chamber 523 forms part of the top surface of the jacket element 502 according to the position shown in FIG. 6*b*.

All of the inlet openings 540 are shown as circular openings in FIG. 6*a*. This representation of the inlet openings 540 as circular openings is only to be viewed as an example and not as restricting the shape of the opening cross section. The opening cross-section of the inlet openings can deviate from the circular shape, in particular, rectangular, polygonal, elliptical, or other opening cross-sections are possible. All of the outlet openings 550 are shown as circular openings in FIG. 6*a*. All of the outlet openings 550 are shown as circular openings in FIG. 6*a*. In order to be able to easily distinguish the outlet openings 550 from the inlet openings 540, their opening cross-sections have been blackened. This representation of the outlet openings 550 as circular openings is only to be viewed as an example and should not be interpreted as a restriction with respect to the shape of the opening cross section. The opening cross section of the outlet openings 550 can deviate from the circular shape; in particular, rectangular, polygonal, elliptical, or other opening cross sections are possible.

According to the present exemplary embodiment, the fourth chamber 524 is arranged on the bottom surface of the jacket element 502. The fourth chamber 524 contains inlet openings 540 and outlet openings 550 of the web element passages 512 of the web elements 510, which belong to the web element set 551, as well as inlet openings 540 and outlet openings 550 of the web element passages 511 of the web elements 509, which belong to the web element set 542.

The fifth chamber 525 is in fluid-conducting connection with an inlet opening 540 of the web elements 509 belonging to the web element set 542 and with an inlet opening 540 of the web elements 510 belonging to the web element set 553. According to this exemplary embodiment, the fifth chamber 525 does not extend over the entire length or width of the jacket element 502. The fifth chamber 525 forms part of the top surface of the jacket element 502 according to the position shown in FIG. 6*b*.

According to the present exemplary embodiment, the sixth chamber 526 is arranged on the bottom surface of the jacket element 502. The sixth chamber 526 contains outlet openings 550 of the web element passages 512 of the web elements 510, which belong to the web element set 552, as well as inlet openings 540 and/or outlet openings 550 of web element passages 511 of the web elements 509, which belong to the web element set 543.

The seventh chamber 527 is only in fluid-conducting connection with the outlet openings 550 of the web elements 510 belonging to the web element set 553 and the discharge 530. According to this exemplary embodiment, the seventh chamber 527 does not extend over the entire length or width of the jacket element 502. The seventh chamber 527 forms part of the bottom surface of the jacket element 502 according to the position shown in FIG. 6*b*.

According to the exemplary embodiment illustrated in FIG. 6*a* and FIG. 6*b*, the heat transfer fluid is fed via a feed 520 through the first chamber 521 to at least one of the web elements 509 of the web element set 541. The heat transfer fluid is also fed via this feed 520 through the first chamber 521 to the web elements 510 of the web element sets 551, 552. The first chamber 521 therefore has the function of distributing the heat transfer fluid to the corresponding inlet openings 540 of the corresponding web element passages 511, 512 of the web elements 509, 510 of the web element sets 541, 551, 552. The web element passages 511, 512, which run within the web elements 509, 510, are not shown, their course can be seen from the flow course of the heat transfer medium, which is shown by dash-dotted lines with two points between two adjacent lines, wherein only a single one of a large number of possible flow paths for the heat transfer fluid is shown in FIG. 6*a*. An illustration of all flow paths of the heat transfer fluid has been omitted for reasons of clarity.

The heat transfer fluid that flows from the first chamber 521 into the web element passages 511 of the web elements 509 of the web element set 541 passes through outlet openings 550 into the third chamber 523 and from there flows into the inlet openings 540 of the web element passages 511 of the web element set 543, into the inlet openings 540 of the web element passages 512 of web element set 553 and web element set 552. The heat transfer fluid that flows from third chamber 523 into web element passages 512 of web elements 510 of web element set 553 passes through outlet openings 550 into the seventh chamber 527 and from there into the discharge 530 to leave the heat exchanger.

The heat transfer fluid can also flow from the third chamber 523 into the inlet openings 540 of the web element passages 511 of the web element set 543. The heat transfer fluid thus flows from the third chamber 523 through the corresponding inlet openings 540 either into the web element passages 511 of the web elements 509 of the web element set 543 to the sixth chamber 526 or into the web element passages 512 of the web elements 510 of the web element set 553 to the seventh chamber 527 or into the web element passages the web element set 552 to the fifth chamber 525, wherein in particular the heat transfer fluid can also flow from the outlet openings 550 of the web element passages 511 of the web element set 541 and web element passages 512 of the web element set 551 into the fifth chamber 525.

The heat transfer fluid coming from the first chamber 521 or the fifth chamber 525 flows from the fourth chamber 524 into the third chamber 523. The heat transfer fluid is fed to the fourth chamber 524 from the first chamber 521 via a web element passage 512 of one of the web elements 510 of the web element set 551. Heat transfer fluid also reaches the fourth chamber 524 from the fifth chamber 525 via a web element passage 511 of one of the web elements 509 of the web element set 542. Heat transfer fluid is passed via another web element passage 511 of one of the web elements 509 of the web element set 542 into the third chamber 523. Heat transfer fluid also reaches the third chamber 523 via a web element passage 512 of a web element 510 of the web element set 551.

In the fifth chamber 525 there is at least one outlet opening 550 of the web element passages 511 of the web elements 509 of the web element set 543 and an outlet opening 550 of the web element passages 512 of the web elements 510 of the web element set 553. The heat transfer fluid can pass through the outlet opening 550 in the interior of the fifth chamber 525 into the inlet openings 540 and arrives in at least one of the web element passages 512 of the web elements 510 of the web element set 553 to the seventh chamber 527. In the seventh chamber 527, the heat transfer fluid coming from the web element passages 512 of the web elements 510 of the web element set 553 is collected and fed to the discharge 530 to leave the heat exchanger. The heat transfer fluid can also flow in the fifth chamber 525 into the inlet opening 540 of the web element passages 511 of the web elements 509 of the web element set 542 into the fourth chamber 524.

the outlet openings 550 of one of the web element passages 511 of the web elements 509 of the web element set 543 and the outlet openings 550 of the web element passages 512 of the web elements 510 of the web element set 552 are arranged in the sixth chamber 526. The heat exchange fluid can enter the web element passages 511 of the web elements 509 of the web element set 543 through the inlet opening 540 and pass through this web element passage 511 into the fifth chamber 525.

The heat transfer fluid coming from web element passages of the web elements 510 of the web element set 553 is collected in the seventh chamber 527 and fed to the discharge 530 in order to leave the heat exchanger.

According to the present exemplary embodiment, the heat transfer fluid that enters the heat exchanger via the first chamber 521 will circulate in the web elements of the individual web element sets so that a temperature compensation can take place transversely to the flow direction of the fluid. A particularly uniform temperature profile of the fluid flowing through the heat exchanger can therefore be obtained with an arrangement according to FIG. 6*a* or FIG. 6*b*.

Figure 7A:
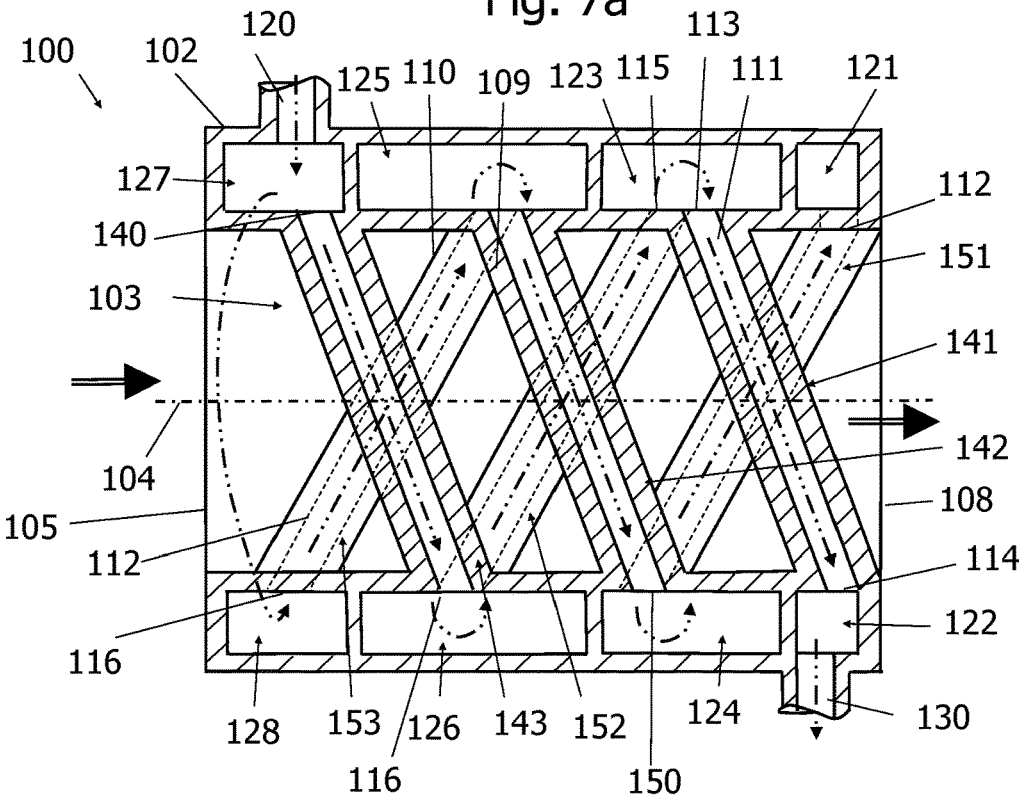

FIG. 7*a* shows a section through a first variant of a heat exchanger 100 according to the second exemplary embodiment of the invention according to FIG. 2*a* or FIG. 2*b*. The heat exchanger 100 according to FIG. 7*a* comprises a jacket element 102 and an insert element 103.

The insert element 103 contains a plurality of web elements 109, 110. According to the present exemplary embodiment, the web elements 109 and the web elements 110 have a different angle of inclination with respect to the longitudinal axis 104. For the sake of simplicity, the reference numerals 109, 110 each designate only one of the web elements of the web element sets. All of the other web elements of the web element sets belonging to the web element 109 are arranged parallel to the web element 109. All of the other web elements of the web element sets belonging to the web element 110 are arranged parallel to the web element 110.

Each of the web elements 109 has a first end 113 and a second end 114, the first end 113 and the second end 114 of the web element 109 being connected to the jacket element 102 at different locations. The web element 109 contains a web element passage 111, which is shown in section in FIG. 7*a*. Such web element passages are already known from EP 2851118 A1 and EP 3489603 A1. The web elements disclosed in these documents are to be regarded as examples of a large number of other possible web shapes. The jacket element 102 according to the invention can be used for any number, arrangement, or shape of the web elements.

The web element passage 111 extends from the first end 113 of the web element 109 to the second end 114 of the web element 109.

Each of the web elements 110 has a first end 115 and a second end 116, wherein the first end 115 and the second end 116 of the web element 110 are connected to the jacket element 102 at different locations. The web element 110 contains a web element passage 112, which is not visible in the present illustration and is therefore only shown by a dashed line in one of the web elements 110. Such web element passages are already known from EP 2851118 A1 and EP 3489603 A1. The web elements disclosed in these documents are to be regarded as examples of a large number of other possible web shapes. The web element passage 112 extends from the first end 115 of the web element 110 to the second end 116 of the web element 110.

The jacket element 102 is partially designed as a hollow body. The insert element 103 is received in the jacket element. The jacket element 102 has a longitudinal axis 104 which extends essentially in the main direction of flow of the flowable medium or fluid or fluid mixture which flows through the jacket element 102 in the operating state. The longitudinal axis 104 runs through the center point of the opening cross section of the jacket element. According to the present illustration, the jacket element 102 has a rectangular opening cross section. The longitudinal axis 104 thus runs through the intersection of the diagonals of the rectangle.

In FIG. 7*a*, the cutting plane is placed in such a way that it intersects the web elements 109 of the web element sets 141, 142, 143.

According to the exemplary embodiment shown in FIG. 7*a*, a first, second and third web element set 141, 142, 143 is shown, which consists of web elements 109. Furthermore, a first, second and third web element set 151, 152, 153 is shown, which consists of web elements 110. According to this exemplary embodiment, each of the web element sets consists of at least two web elements.

The jacket element 102 contains an inlet opening 105 and an outlet opening 108 for a fluid, flowable medium or fluid mixture which flows through the heat exchanger in the operating state. The jacket element 102 is at least partially designed as a hollow body, for example as a double jacket, that is, the jacket element 102 contains a plurality of chambers. A heat transfer fluid flows through these chambers in the operating state. The direction of flow and the course of the flow of the heat transfer fluid are shown in FIG. 7*a* by dash-dotted lines with two points each between two adjacent lines and corresponding arrows. At the points at which the jacket element is designed as a double jacket, the jacket element is formed by an outer shell and an inner shell. The outer and inner shells form an outer jacket and an inner jacket.

The jacket element 102 according to FIG. 7*a* contains at least one feed 120 and one discharge 130. The jacket element 102 comprises eight chambers. The second chamber 122 contains a discharge 130 comprising a tubular element containing an outlet channel for the heat transfer fluid. The first and second chambers 121, 122 are connected to one another according to FIG. 7*a*, because the heat transfer fluid has to pass from the first chamber 121 into the second chamber 122 in order to be able to leave the heat exchanger 100 through the discharge 130. As in FIG. 1*a* or FIG. 1*b*, the chambers can have partitions running in the longitudinal direction, so that the chambers 123, 124, 125, 126 extend only on the base surface or the top surface of the jacket element 102. According to this exemplary embodiment, these partitions are optional; the side surfaces, not shown, of the jacket element 102 can also be designed as hollow bodies, as shown in FIGS. 1*a*-1*f*.

Each of the third, fourth, fifth, sixth chambers 123, 124, 125, 126 contains inlet openings and outlet openings of the web elements 109, 110. The seventh chamber 127 contains a feed 120 which comprises a tubular element containing an inlet channel for the heat transfer fluid. The eighth chamber 128 is connected to the seventh chamber via a chamber which runs in the jacket element.

According to the present embodiment, each of the third, fourth, fifth, sixth chambers 123, 124, 125, 126 is longer than the first, second, seventh and eighth chambers 121, 122, 127, 128. In particular, the width of each of the third, fourth, fifth, sixth chambers 123, 124, 125, 126 can amount to 10% up to and including 100% of the circumference of the jacket element 102. The width of these chambers is measured in a plane which is arranged normally with respect to the longitudinal axis 104, that is to say the plane is arranged at a right angle with respect to the longitudinal axis 104.

According to FIG. 7*a*, the first chamber 121 does not extend from the inlet opening 105 to the outlet opening 108 for the fluid which flows through the jacket element 102 in the operating state. The first chamber 121 is only in fluid-conducting connection with the outlet openings 150 of the web elements 110 belonging to the web element set 151 and the discharge 130 via the second chamber 122.

The second chamber 122 comprises at least part of the bottom surface of the jacket element 102. The second chamber 122 is only in fluid-conducting connection with the outlet openings 150 of the web elements 109 belonging to the web element set 141, the first chamber 121 and the discharge 130. According to this exemplary embodiment, the second chamber 122 does not extend over the entire length of the jacket element 102.

According to the present exemplary embodiment, the third chamber 123 is arranged at least on the top surface of the jacket element 102. The third chamber 123 contains the outlet openings 150 of the web elements 110, which belong to the web element set 152, and the inlet openings 140 of the web elements 109, which belong to the web element set 141.

According to the present exemplary embodiment, the fourth chamber 124 is arranged at least on the bottom surface of the jacket element 102. The fourth chamber 124 contains the inlet openings 140 of the web elements 110, which belong to the web element set 151, as well as the outlet openings 150 of the web elements 109, which belong to the web element set 142.

According to the present exemplary embodiment, the fifth chamber 125 is arranged at least on the top surface of the jacket element 102. The fifth chamber 125 contains the outlet openings 150 of the web elements 110, which belong to the web element set 153, as well as the inlet openings 140 of the web elements 109, which belong to the web element set 142.

According to the present exemplary embodiment, the sixth chamber 126 is arranged at least on the bottom surface of the jacket element 102. The sixth chamber 126 contains the inlet openings 140 of the web elements 110, which belong to the web element set 152, as well as the outlet openings 150 of the web elements 109, which belong to the web element set 143.

The seventh chamber 127 is only in fluid-conducting connection with the inlet openings 140 of the web elements 109 belonging to the web element set 143 and the feed 120. According to this exemplary embodiment, the seventh chamber 127 does not extend over the entire length of the jacket element 102. The seventh chamber 127 forms at least a part of the top surface of the jacket element 102.

The eighth chamber 128 is only in fluid-conducting connection with the inlet openings 140 of the web elements 110 belonging to the web element set 153 and the seventh chamber 127. According to this exemplary embodiment, the eighth chamber 128 does not extend over the entire length of the jacket element 102. The eighth chamber 128 forms at least a part of the bottom surface of the jacket element 102.

According to the exemplary embodiment shown in FIG. 7*a*, the heat transfer fluid is fed to the web elements 109 of the web element set 143 via an inlet 120 through the seventh chamber 127. The heat transfer fluid can also be fed into the eighth chamber 128 and to the web elements 110 of the web element set 153 via a feed, wherein this feed is not shown in the drawing. The seventh chamber 127 and the eighth chamber 128 therefore have the function of distributing the heat transfer fluid to the corresponding inlet openings 140 of the corresponding web element passages 111, 112 of the web elements 109, 110. The web element passages 111, which run within the web elements 109, are shown in section, the web element passages 112 of the web elements 110 lying behind them are indicated with dashed lines. The flow path of the heat transfer medium is shown by dash-dotted lines with two points each between two adjacent lines. The seventh and eighth chambers 127, 128 can be configured as a common chamber.

The heat transfer fluid that flows from the seventh chamber 127 into the web element passages 111 of the web elements 109 of the web element set 143 passes through outlet openings 150 into the sixth chamber 126 and flows from there into the inlet openings 140 of the web element passages 112 of the web element set 152.

The heat transfer fluid which flows from the eighth chamber 128 into the web element passages 112 of the web elements 110 of the web element set 153 passes through outlet openings 150 into the fifth chamber 125 and flows from there into the inlet openings 140 of the web element passages 111 of the web element set 142.

The outlet openings 150 of the web element passages 112 of the web elements 110 of the web element set 153 as well as the inlet openings 140 of the web element passages 111 of the web elements 109 of the web element set 142 are located in the fifth chamber 125. The heat transfer fluid can flow through the outlet openings 150 into the inlet openings and reaches the web element passages 111 of the web elements 109 of the web element set 142 and flows into the fourth chamber 124.

The outlet openings 150 of the web element passages 111 of the web elements 109 of the web element set 142 and the inlet openings 140 of the web element passages 112 of the web elements 110 of the web element set 151 are located in the fourth chamber 124. The heat transfer fluid can flow through the outlet openings 150 into the inlet openings and reaches the web element passages 112 of the web elements 110 of the web element set 151 and flows into the first chamber 121.

The outlet openings 150 of the web element passages 112 of the web elements 110 of the web element set 152 and the inlet openings 140 of the web element passages 111 of the web elements 109 of the web element set 141 are located in the third chamber 123. The heat transfer fluid can flow through the outlet openings 150 into the inlet openings and reaches the web element passages 111 of the web elements 109 of the web element set 141 and flows into the second chamber 122.

The outlet openings of the web element passages 111 of the web elements 110 of the web element set 141 are located in the second chamber 122. The second chamber 122 contains an outlet opening 150 for a discharge 130.

The heat transfer fluid thus flows crosswise with respect to the direction of the fluid, the main flow direction of which runs in the direction of the longitudinal axis 104 and is indicated by an arrow with a double line.

Figure 7B:
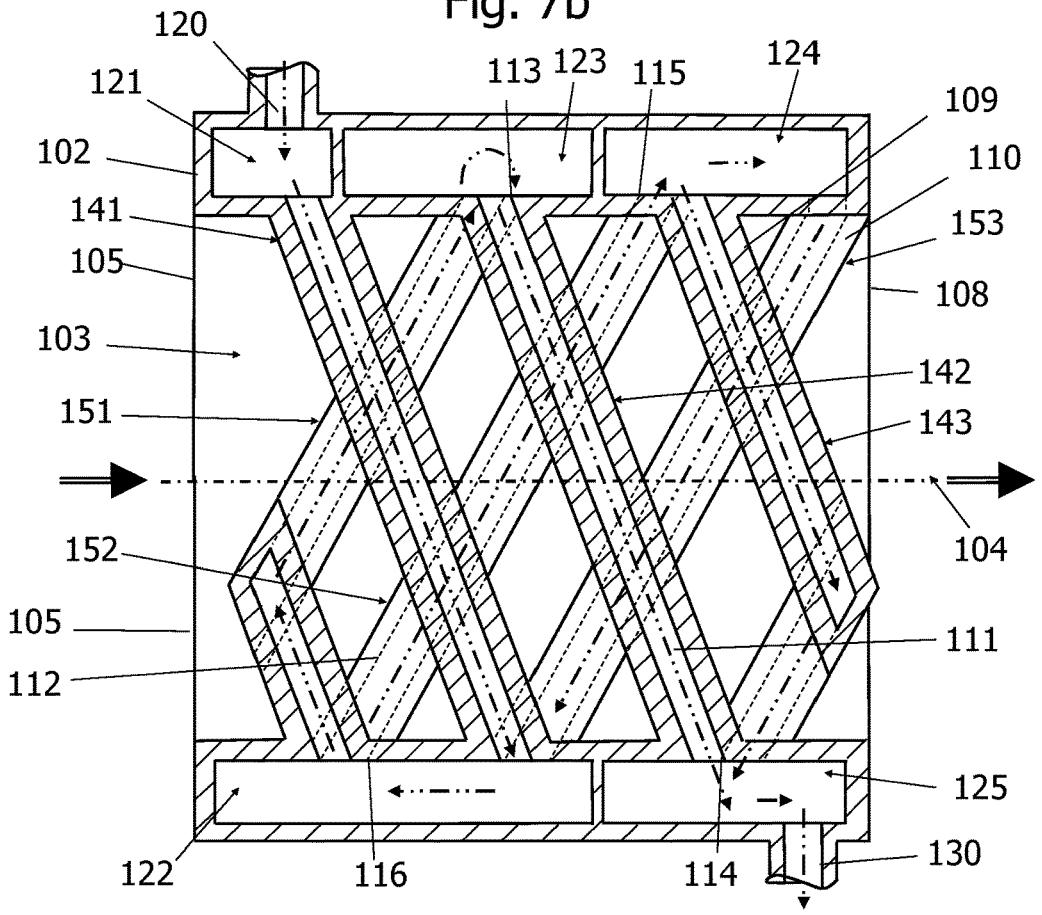

FIG. 7*b* shows a second variant of a heat exchanger 100 according to the second embodiment in longitudinal section. The heat exchanger 100 comprises a jacket element 102 and an insert element 103. The jacket element 102 has a longitudinal axis 104 which extends essentially in the main direction of flow of the flowable medium or fluid or fluid mixture which flows through the jacket element 102 in the operating state. The jacket element 102 comprises a plurality of chambers 121, 122, 123, 124, 125. The insert element 103 comprises a plurality of web element sets 141, 142, 143, 151, 152, 153, which are arranged in such a way that they include at least partially different angles of inclination with respect to the longitudinal axis 104. In the installed state, the insert element 103 is arranged in the interior of the jacket element 102, or in other words, the insert element 103 is received in the jacket element. The jacket element 102 is partially designed as a hollow body. The longitudinal axis 104 runs through the center point of the opening cross section of the jacket element 102. According to the present illustration, the jacket element 102 has a rectangular opening cross section. The longitudinal axis 104 thus runs through the intersection of the diagonals of the rectangle analogously to the arrangement shown in FIG. 2*b*.

The insert element 103 contains a plurality of web elements 109, 110. According to the present exemplary embodiment, the web elements 109 and the web elements 110 at least partially include a different angle of inclination with respect to the longitudinal axis 104. For the sake of simplicity, the reference numerals 109, 110 each designate only one of the web elements of the web element set. All of the other web elements of the web element sets belonging to the web element 109 are arranged at least partially parallel to the web element 109. All of the other web elements of the web element sets belonging to the web element 110 are arranged at least partially parallel to the web element 110.

Each of the web elements 109 has a first end 113 and a second end 114, the first end 113 and the second end 114 of the web element 109 being connected to the jacket element 102 at different locations. The web element 109 contains a web element passage 111. The web element passages 111 of the web elements 109 of the web element sets 141, 142, 143 lying in the sectional plane are shown in section in the present illustration. Such web element passages are already known from EP 2851118 A1 and EP 3489603 A1. The web elements disclosed in these documents are to be regarded as examples of a large number of other possible web shapes. The jacket element 102 according to the invention can be used for any number, arrangement, or shape of the web elements. The web element passage 111 extends from the first end 113 of the web element 109 to the second end 114 of the web element 109.

Each of the web elements 110 has a first end 115 and a second end 116, wherein the first end 115 and the second end 116 of the web element 110 are connected to the jacket element 102 at different locations. The web element 110 contains a web element passage 112. The web element passage 112 is not visible in the present illustration and is therefore only shown with dashed lines. Such web element passages are already known from EP 2851118 A1 and EP 3489603 A1. The web elements disclosed in these documents are to be regarded as examples of a large number of other possible web shapes. The web element passage 112 extends from the first end 115 of the web element 110 to the second end 116 of the web element 110.

According to the exemplary embodiment shown in FIG. 7*b*, a first, second and third set of web elements 141, 142, 143 are shown, which consist of web elements 109. Furthermore, a first, second and third web element set 151, 152, 153 are shown, which consist of web elements 110. Each of the web element sets can contain any number of web elements, but mostly 2 to 12 web elements, in particular, 2 to 8 web elements. Each of the web element sets can thus contain more than two web elements. Each of the web element sets can have a different number of web elements. The number of web element sets can differ from the illustration according to FIG. 7*b*.

The jacket element 102 has an inlet opening 105 and an outlet opening 108 for a fluid, flowable medium or fluid mixture which flows through the heat exchanger in the operating state. The jacket element 102 is at least partially designed as a hollow body, for example as a double jacket, that is, the jacket element 102 contains a plurality of chambers 121, 122, 123, 124, 125. A heat transfer fluid flows through these chambers in the operating state. The flow of the heat transfer fluid is shown in FIG. 7*b* by dash-dotted lines with two points between two adjacent lines. At the points at which the jacket element is designed as a double jacket, the jacket element is formed by an outer shell and an inner shell.

The jacket element 102 according to FIG. 7*b* contains at least one feed 120 and at least one discharge 130. The jacket element 102 contains five chambers. The first chamber 121 contains the feed 120, comprising a tubular element containing an inlet channel for a heat transfer fluid. Each of the second, third, fourth chambers 122, 123, 124 contains inlet openings and outlet openings of the web elements 109, 110. The fifth chamber 125 contains the discharge 130, which comprises a tubular element containing an outlet channel for the heat transfer fluid.

According to the present embodiment, each of the second, third, fourth chambers 122, 123, 124 is larger than the first and fifth chambers 121, 125. In particular, the width of every second, third, fourth chambers 122, 123, 124 can amount to 10% up to and including 100% of the circumference of the jacket element 102. The width of these chambers is measured in a plane which is arranged in a right angle with respect to the longitudinal axis 104.

According to the present embodiment, each of the second, third, fourth chambers 122, 123, 124 is larger than the first and fifth chambers 121, 125. In particular, the width of every second, third, fourth chambers 122, 123, 124 can amount to 10% up to and including 100% of the circumference of the jacket element 102. The width of these chambers is measured in a plane which is arranged in a right angle with respect to the longitudinal axis 104.

According to FIG. 7*b*, the first chamber 121 does not extend from the inlet opening 105 to the outlet opening 108 for the fluid which flows through the jacket element 102 in the operating state. The first chamber 121 is only in fluid-conducting connection with the inlet openings 140 of the web elements 109 belonging to the web element set 141 and the feed 120. According to this exemplary embodiment, the first chamber 121 does not extend over the entire length of the jacket element 102. According to FIG. 7*b*, the first chamber 121 forms at least part of the top surface of the jacket element 102.

The second chamber 122 comprises at least part of the bottom surface of the jacket element 102. The second chamber 122 is in fluid-conducting connection with the inlet openings 140 of the web elements 109 belonging to the web element set 141 and the feed 120. According to this exemplary embodiment, the second chamber 122 does not extend over the entire length and/or width of the jacket element 102. According to the position shown in FIG. 7*b*, the second chamber 122 forms at least part of the bottom surface of the jacket element 102. The second chamber 122 thus contains the outlet openings 150 of the web elements 109, which belong to the web element set 141. The second chamber 122 contains the inlet openings 140 of the web elements 110, which belong to the web element set 151 and to the web element set 152. The second chamber 122 contains the outlet openings 150 of the web elements 110, which belong to the web element set 153.

According to the present exemplary embodiment, the third chamber 123 is arranged on the top surface of the jacket element 102. The third chamber 123 contains the outlet openings 150 of the web elements 110, which belong to the web element set 151, as well as the inlet openings 140 of the web elements 109, which belong to the web element set 142.

All of the web element channels can have circular opening cross-sections. The opening cross-section of the web element channels according to each of the exemplary embodiments can deviate from the circular shape, in particular, rectangular, polygonal, elliptical, or other opening cross-sections are possible.

According to the present exemplary embodiment, the fourth chamber 124 is arranged on the top surface of the jacket element 102. The fourth chamber 124 contains the inlet openings 140 of the web elements 109, which belong to the web element set 143, and the outlet openings 150 of the web elements 110 which belong to the web element set 152. The fourth chamber 124 contains the inlet openings 140 of the web elements 110, which belong to the web element set 153.

According to the present exemplary embodiment, the fifth chamber 125 is arranged on the bottom surface of the jacket element 102. The fifth chamber 125 contains the outlet openings 150 of the web elements 109, which belong to the web element set 142, as well as the outlet openings 150 of the web elements 109, which belong to the web element set 143. The fifth chamber 125 is in fluid-conducting connection with the discharge 130. According to this exemplary embodiment, the fifth chamber 125 does not extend over the entire length or width of the jacket element 102.

According to the exemplary embodiment shown in FIG. 7*b*, the heat transfer fluid is fed to the web elements 109 of the web element set 141 via a feed 120 through the first chamber 121. The heat transfer fluid, which flows from the first chamber 121 into the web element passages 111 of the web elements 109 of the web element set 141, passes through outlet openings 150 into the second chamber 122 and from there flows into the inlet openings 140 of the web element passages 112 of the web element set 152 and the web element set 151 The second chamber contains further outlet openings 150 for the web element passages 112 of the web elements 110 of the web element set 153, through which the heat transfer fluid can flow back from the fourth chamber 124 into the second chamber 122.

the inlet openings 140 of the web element passages 111 of the web elements 109 of the web element set 142 and the outlet openings 150 of the web element passages 112 of the web elements 110 of the web element set 151 are arranged in the third chamber 123. The heat transfer fluid can enter the third chamber 123 through the outlet openings 150 and can flow from the third chamber 123 into the inlet openings 140 and enters the web element passages 112 of the web elements 110 of the web element set 151, which lead into the fifth chamber 125.

The outlet openings 150 of the web element passages 112 of the web elements 110 of the web element set 152 as well as the inlet openings 140 of the web element passages 111 of the web elements 109 of the web element set 143 and the inlet openings 140 of the web element passages 112 of the web elements 110 of web element set 153 are arranged in the fourth chamber 124. The heat transfer fluid can flow through the outlet openings 150 into the fourth chamber 124 and flow within the fourth chamber 124 into the inlet openings 140 and enter the web element passages 111 of the web elements 109 of the web element set 143, which lead to the fifth chamber 125, and into the web element passages 112 of the web elements 110 of the web element set 153, which lead into the second chamber 122.

The outlet openings 150 of the web element passages 111 of the web elements 109 of the web element set 143 are located in the fifth chamber 125. The fifth chamber 125 contains an outlet opening 150 for a discharge 130.

The heat transfer fluid thus flows crosswise with respect to the flow direction of the fluid, the main flow direction of which runs in the direction of the longitudinal axis 104 and is indicated by an arrow with a double line.

The web elements 110 are arranged crosswise to the web elements 109. According to FIG. 7*b*, the crossing web elements each have a plurality of intersections. In addition, the web elements 109, 110 adjacent to the inlet opening 105 of the heat exchanger 100 are connected to one another via a deflection. The web elements 109, 110 adjacent to the outlet opening 108 of the heat exchanger 100 are also connected to one another via a deflection. This arrangement has the advantage that the installation space required for the insert element 103 is smaller with the same mixing effect, since the overall length of the heat exchanger is provided with web elements.

Figure 8A:
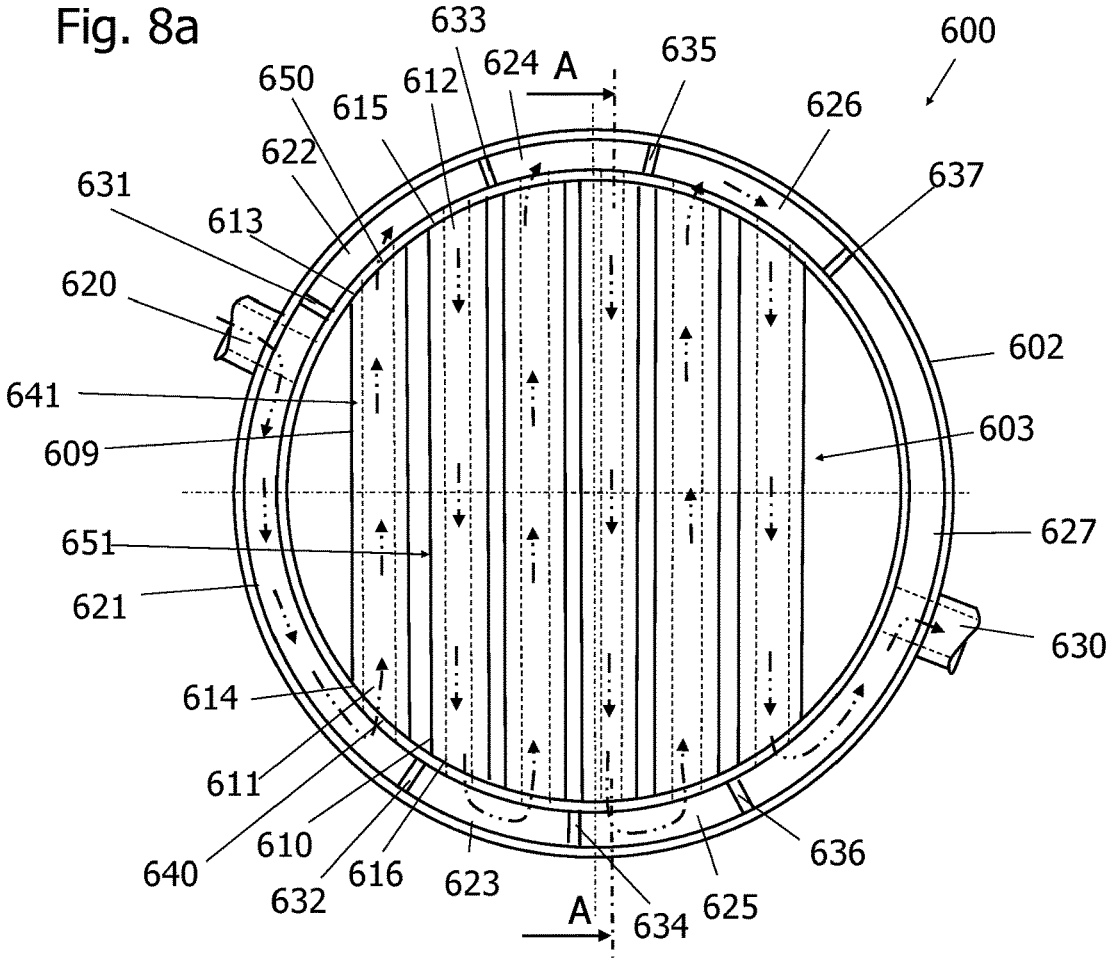

FIG. 8*a* shows a view of a heat exchanger 600 according to a seventh exemplary embodiment. The heat exchanger comprises a cylindrical jacket element 602 and an insert element 603. The insert element 603 is arranged in the interior of the jacket element 602 in the installed state. A flowable medium, a fluid or fluid mixture, flows around the insert element 603 in the operating state.

The jacket element 602 is designed as a hollow body. The insert element 603 is received in the hollow body. The jacket element 602 has a longitudinal axis 604 which extends essentially in the main direction of flow of the flowable medium which flows through the jacket element 602 in the operating state, that is, according to this illustration, in a right angle with respect to the plane of the drawing, i.e. out of the drawing plane. The longitudinal axis 604 is visible in FIG. 8*b*. The longitudinal axis 604 runs through the center point of the opening cross section of the jacket element 602.

The insert element 603 contains a plurality of web elements 609, 610. According to the present exemplary embodiment, the web elements 609 and the web elements 610 have a different angle of inclination with respect to the longitudinal axis 604, which can be seen from FIG. 8*b*. For the sake of simplicity, the reference numerals 609, 610 each designate only one of the web elements of the web element set. All of the other web elements of the web element sets belonging to the web element 609 are arranged essentially parallel to the web element 609. All of the other web elements of the web element sets belonging to the web element 610 are arranged parallel to the web element 610.

Each of the web elements 609 has a first end 613 and a second end 614, the first end 613 and the second end 614 of the web element 609 being connected to the jacket element 602 at different locations. The web element 609 contains a web element passage 611. The web element passage 611 is shown only by a line in the present illustration. Such web element passages are already known from EP 2851118 A1 and EP 3489603 A1. The web elements disclosed in these documents are to be regarded as examples of a large number of other possible web shapes. The jacket element according to the invention can be used for any number, arrangement, or shape of the web elements. The web element passage 611 extends from the first end 613 of the web element 609 to the second end 614 of the web element 609.

Each of the web elements 610 has a first end 615 and a second end 616, the first end 615 and the second end 616 of the web element 610 being connected to the jacket element 602 at different locations. The web element 610 contains a web element passage 612. The web element passage 612 is shown only by a line in the present illustration. Such web element passages are already known from EP 2851118 A1 and EP 3489603 A1. The webs disclosed in these documents are to be regarded as examples of a large number of other possible web shapes. The web element passage 612 extends from the first end 615 of the web element 610 to the second end 616 of the web element 610.

Figure 8B:
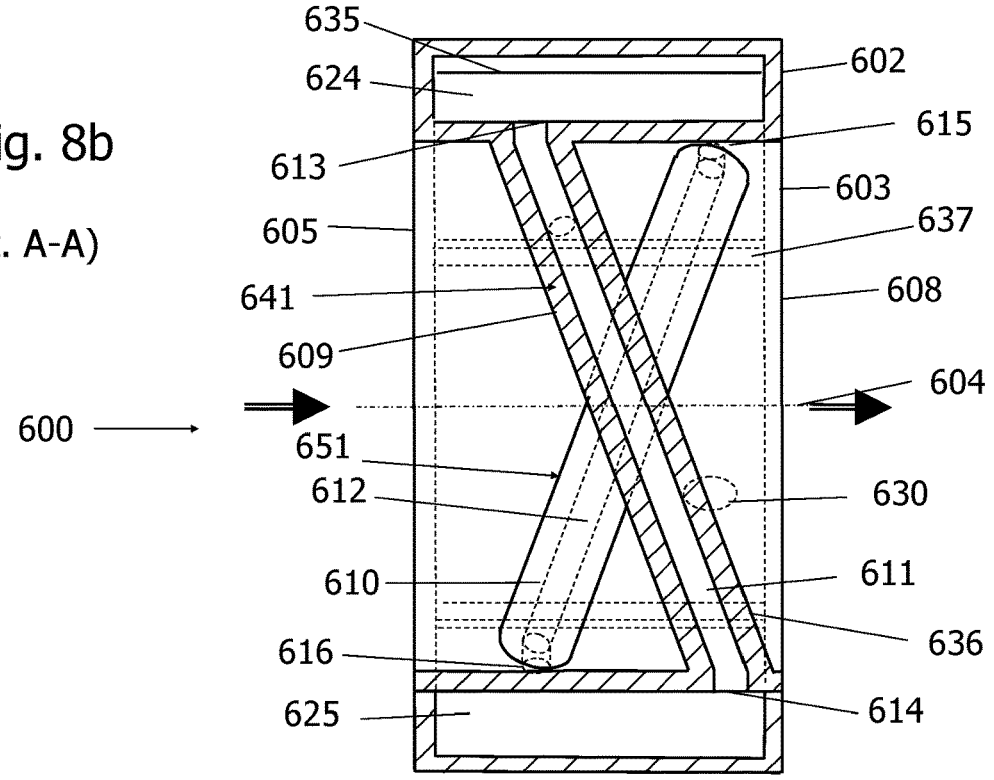

FIG. 8*b* is a section through the heat exchanger 600 shown in FIG. 8*a* along the section line designated by A-A. A plurality of the heat exchangers 600 according to FIG. 8*b* can be arranged one behind the other in the direction of flow of the fluid, that is to say before or after the heat exchanger shown in FIG. 8*b*, one or more further heat exchangers 600 can be connected. Adjacent heat exchangers 600 can be rotated about the longitudinal axis, that is to say the web elements shown vertically in FIG. 8*b* can run horizontally, for example, when the angle of rotation is 90 degrees, which is not shown in the drawing. An offset arrangement of a plurality of heat exchangers can not only improve the heat exchange and result in a more homogeneous temperature distribution in the fluid, but also improve the mixing effect in the fluid. As in the previous exemplary embodiments, the fluid can be a pure substance or a mixture of different components.

According to the exemplary embodiment shown in FIG. 8*b*, a first set of web elements 641 is shown, which consists of web elements 609. Furthermore, a first set of web elements is shown, which consists of web elements 610. As in the previous exemplary embodiments, further web element sets can be arranged downstream of these two web element sets 641, 651, thus each of the preceding exemplary embodiments can be combined with the present exemplary embodiment. According to this exemplary embodiment, each of the web element sets consists of three web elements. This arrangement is only to be regarded as an example. Each of the web element sets can contain two or more web elements. Each of the web element sets can be provided with a different number of web elements. The number of web element sets can differ from the illustration according to FIG. 8*b*.

FIGS. 8*a* and 8*b* show the jacket element 602 with the built-in insert element 603. The jacket element 602 is provided with an inlet opening 605 and an outlet opening 608 for the fluid, flowable medium or fluid mixture which flows through the heat exchanger 600 in the operating state. The jacket element 602 is designed as a hollow body, for example as a double jacket, that is to say there are a plurality of chambers in the interior of the jacket element 602. A heat transfer fluid flows through these chambers in the operating state. The flow of the heat transfer fluid is shown in the present illustration by dash-dotted lines with two points each between two adjacent lines. The double jacket is formed by an outer shell and an inner shell.

Each of the chambers is provided with two curved side walls that form segments of a cylinder that is formed by the outer shell or the inner shell of the jacket element. The curved side walls are delimited by two radially extending side walls each, so that the two curved side walls and the two radially extending side walls form a chamber. The chamber is intended to receive the heat transfer fluid.

The jacket element 602 contains at least one feed 620 and one discharge 630. The jacket element 602 according to FIG. 8*a* or FIG. 8*b* consists of seven chambers. The first chamber 621 contains the feed 620, comprising a tubular element containing an inlet channel for a heat transfer fluid. The seventh chamber 627 contains the discharge 630, which comprises a tubular element containing an outlet channel for the heat transfer fluid. A second, third, fourth, fifth and sixth chamber 622, 623, 624, 625, 626 are located between the first and seventh chambers 621, 627.

According to the present embodiment, the first and seventh chambers 621, 627 are larger than the second, third, fourth, fifth and sixth chambers 622, 623, 624, 625, 626. In particular, each of the first or seventh chambers 621, 627 can comprise more than 10%, in particular more than 25% each, of the circumference of the jacket element 602.

According to FIG. 8*b*, the first chamber 621 extends from the inlet opening 605 to the outlet opening 608 for the fluid which flows through the jacket element 602 in the operating state. According to this exemplary embodiment, the first chamber 621 extends over the entire length of the jacket element 602. The first chamber 621 forms a segment of the jacket element 602 according to the position shown in FIG. 8*b*. The second chamber 622 comprises a further segment of the jacket element 602, which is separated from the first chamber 621 by a first partition 631. The second chamber 622 extends from the inlet opening 605 to the outlet opening 608 for the fluid which flows through the jacket element 602 in the operating state.

According to this exemplary embodiment, the third chamber 623 extends over the entire length of the jacket element 602. In other words, the third chamber 623 extends from the inlet opening 605 to the outlet opening 608 for the fluid which flows through the jacket element 602 in the operating state. The third chamber 623 adjoins the first chamber 621. According to the position shown in FIG. 8*a*, the third chamber 623 extends over a segment of the jacket element 602 adjoining the segment of the first chamber 621. A second partition 632 is located between the first chamber 621 and the third chamber 623. Through the second partition 632 it is prevented that heat transfer fluid can pass from the first chamber 621 directly into the third chamber 623. In this context, directly means in the interior of the hollow body spanned by the jacket element 602.

A fourth chamber 624 adjoins the second chamber 622 and extends over a further segment of the jacket element 602. The fourth chamber 624 also adjoins the sixth chamber 626. A third partition 633 is located between the second chamber 622 and the fourth chamber 624. A fifth partition 635 is located between the fourth chamber 624 and the sixth chamber 626. In other words, the fourth chamber 624 extends from the inlet opening 605 to the outlet opening 608 for the fluid which flows through the jacket element 602 in the operating state.

A fifth chamber 625 adjoins the third chamber 623, which extends over a further segment of the jacket element 602. The fifth chamber 625 is also adjoins the seventh chamber 627. A fourth partition 634 is located between the third chamber 623 and the fifth chamber 625. A sixth partition 636 is located between the fifth chamber 625 and the seventh chamber 627. In other words, the fifth chamber 625 extends from the inlet opening 605 to the outlet opening 608 for the fluid which flows through the jacket element 602 in the operating state.

A sixth chamber 626 adjoins the fourth chamber 624, which extends over a further segment of the jacket element 602. The sixth chamber 626 also adjoins the seventh chamber 627. A fifth partition 635 is located between the fourth chamber 624 and the sixth chamber 626. A seventh partition 637 is located between the sixth chamber 626 and the seventh chamber 627. The sixth chamber 626 extends according to this embodiment over the entire length of the jacket element 602. In other words, the sixth chamber 626 extends from the inlet opening 605 to the outlet opening 608 for the fluid which flows through the jacket element 602 in the operating state.

A seventh chamber 627 adjoins the sixth chamber 626, which extends over a further segment of the jacket element 602. The seventh chamber 627 also adjoins the fifth chamber 625. The seventh partition 637 is located between the sixth chamber 626 and the seventh chamber 627. The sixth partition 636 is located between the fifth chamber 625 and the seventh chamber 627. The seventh chamber 627 extends according to this embodiment over the entire length of the jacket element 602. In other words, the seventh chamber 627 extends from the inlet opening 605 to the outlet opening 608 for the fluid which flows through the jacket element 602 in the operating state.

According to the present exemplary embodiment, the first chamber 621 is provided with at least one inlet opening 640 which is in fluid-conducting connection with at least one web element passage 611 which runs within the web element or the web elements 609, wherein the web element passage or the web element passages adjoin the first chamber 621. In the operating state, heat transfer fluid can flow through this inlet opening 640 into the web element or the web elements 609, which in the present illustration adjoin the inner wall of the chamber 621 and extend to the second chamber 622.

Figure 8C:
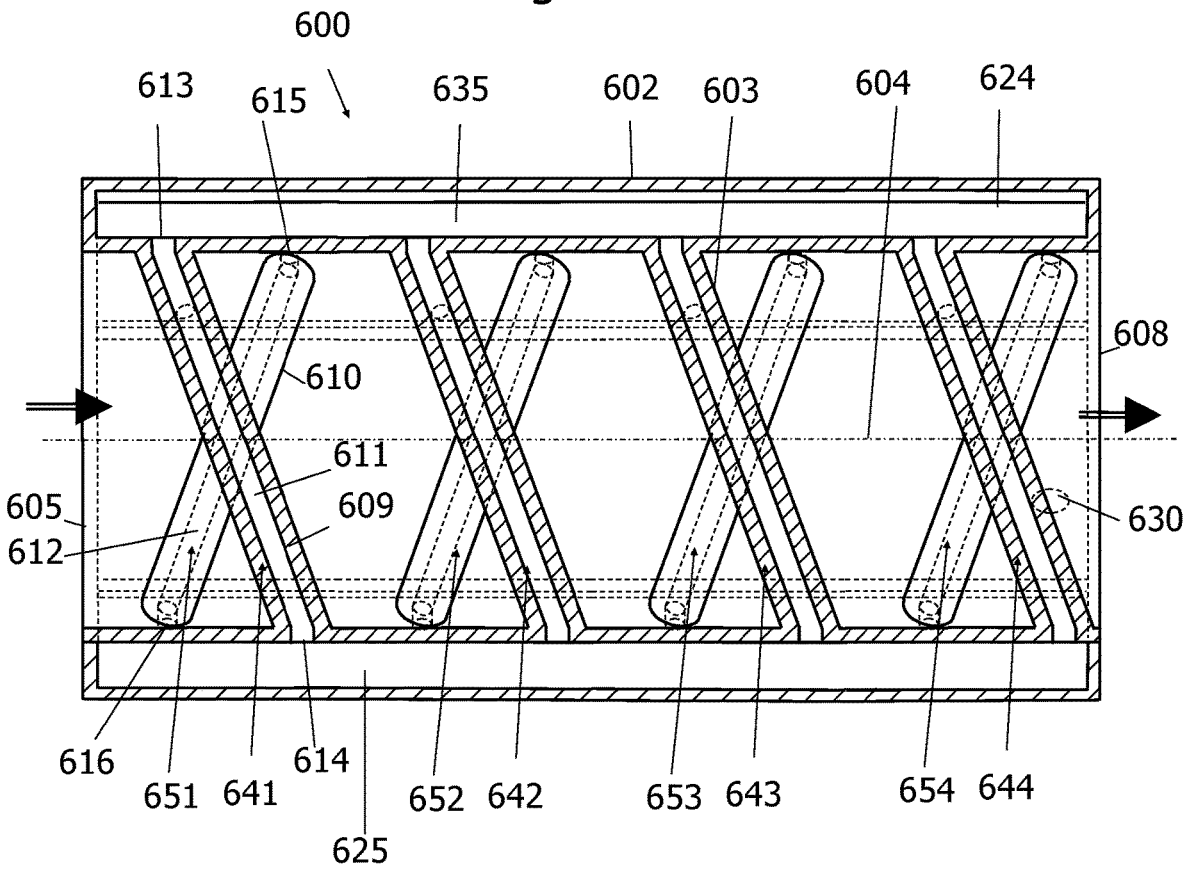

In FIG. 8*b* only a single set of web elements 641 is shown, which is arranged at a first angle with respect to the longitudinal axis 604 and a single set of web elements 651 is shown, which is arranged at a second angle with respect to the longitudinal axis 604, the first angle differing from the second angle. Further web element sets can be connected to each of the web element sets 641 and 651, which is shown in FIG. 8*c*. FIG. 8*c* shows a second, third and fourth web element set 642, 643, 644, which are each arranged parallel to the first web element set 641. FIG. 8*c* also shows a second, third and fourth web element set 652, 653, 654, which is each arranged parallel to the first web element set 651.

Therefore, the heat transfer fluid according to FIG. 8*b* can flow into a single web element passage 611 of the web element set 641 or into several web element passages 611 of the web element sets 641, 642, 643, 644 arranged one behind the other in the direction of flow of the fluid, as shown in FIG. 8*c*. In the following, the variants according to FIG. 8*b* and FIG. 8*c* are described together, so that the following description should always include a variant with a single web element passage or also a plurality of web element passages of different web element sets.

According to FIG. 8*a*, the heat transfer fluid enters the inlet opening or inlet openings 640 of the web element passage or the web element passages 611 of the web element set 641 or web element sets 642, 643, 644 and leaves through the outlet opening or outlet openings 650 from the web element passage or the web element passages 611 and passes into the second chamber 622. The heat transfer fluid flows through the second chamber 622 to the inlet opening or the inlet openings 640 which open into the web element passages 612 of the web elements 610 of the web element set 651 and/or the web element sets 652, 653, 654, which extend from the second chamber 622 to the third chamber 623.

From the third chamber 623, the heat transfer fluid enters the inlet opening or inlet openings 640 of the web element passage or the web element passages 611 of the web element set 641 or the web element sets 642, 643, 644 and leaves through the outlet opening or outlet openings 650 from the web element passage or the web element passages 611 and enters the fourth chamber 624. The heat transfer fluid flows through the fourth chamber 624 to the inlet opening or inlet openings 640, which open into the web element passages 612 of the web elements 610 of the web element set 651 and/or the web element sets 652, 653, 654 that extend from the fourth chamber 624 to the fifth chamber 625.

From the fifth chamber 625, the heat transfer fluid enters the inlet opening or inlet openings 640 of the web element passage or the web element passages 611 of the web element set 641 or the web element sets 642, 643, 644 and leaves through the outlet opening or outlet openings 650 from the web element passage or the web element passages 611 and enters the sixth chamber 626. The heat transfer fluid flows through the sixth chamber 626 to the inlet opening or inlet openings 640, which open into the web element passage or the web element passages 612 of the web elements 610 of the web element set 651 and/or the web element sets 652, 653, 654, which extend from the sixth chamber 626 to the seventh chamber 627.

An outlet opening 630 is located the seventh chamber 627 which is invisible in FIG. 8*b* and is shown in broken lines in FIG. 8*b*, through which the heat transfer fluid can exit from the seventh chamber 627 and leave the heat exchanger.

According to the present embodiment, a plurality of inlet openings 640 are located in the inner jacket element wall through which the heat transfer fluid can enter the corresponding web element passages 611 of the web elements 609 and the heat transfer fluid can enter therefrom via outlet openings 650 in the inner jacket element wall into the chambers 622, 623, 624, 625, 626. At their first end 613, the web elements 609 form a fluid-tight connection with the inner jacket element wall, which connection forms one of the boundaries of the second chamber 622, the fourth chamber 624 or the sixth chamber 626. At their second end 614, the web elements 609 form a fluid-tight connection with the inner jacket element wall, which connection forms one of the boundaries of the first chamber 621, the third chamber 623 or the fifth chamber 625.

The web elements 610 form a fluid-tight connection with the inner jacket element wall at their first end 615, wherein the inner jacket element wall forms one of the boundaries of the second chamber 622, the fourth chamber 624 or the sixth chamber 626. The web elements 610 form a fluid-tight connection with the inner jacket element wall at their second end 616, wherein the inner jacket element wall forms one of the boundaries of the first chamber 621, the third chamber 623 or the fifth chamber 625.

The heat transfer fluid can therefore not come into contact with the fluid flowing between the web elements 609, 610. The heat exchange between the fluid and the heat transfer fluid thus takes place via the inner jacket element walls of the jacket element 602 and via the web element walls of the web elements 609, 610 of the insert element 603.

The inner jacket element wall of the second, fourth or sixth chamber 622, 624, 626 contains one or a plurality of outlet openings 650 for the web element passages 611 of the web elements 609, which are in communication with the first chamber 621, the third chamber 623 or the fifth chamber 635. The inner jacket element wall of the second, fourth or sixth chamber 622, 624, 626 contains one or a plurality of inlet openings 640 for the web element passages 612 of the web elements 610, which form the connection with the third chamber 623 or the fifth chamber 635 or the seventh chamber 627. The second, third, fourth, fifth, sixth chamber 622, 623, 624, 625, 626 thus contains at least one inlet opening 640 and one outlet opening 650 or a plurality of inlet openings 640 and a plurality of outlet openings 650.

The arrows with the dash-dotted lines indicate the direction of flow of the heat transfer fluid in the operating state of the heat exchanger. The fluid flows through the jacket element 602 according to FIG. 8*a* in the direction of the drawing, the heat transfer fluid can flow transversely to the fluid, in the chambers it can also flow in or against the direction of flow of the fluid. The flow of the heat transfer fluid in the direction of the drawing, i.e. in or against the direction of flow of the fluid cannot be inferred from this schematic illustration.

According to each of the exemplary embodiments, partitions can be provided in the chambers as shown in FIG. 1*d*, wherein the heat transfer fluid can be at least partially deflected by the partitions within the chambers.

As shown in FIG. 7*b*, more than two sets of web elements can cross each other for each of the exemplary embodiments shown and can also be connected to one another via common connecting elements. The connecting elements can for example comprise transverse webs. A web element can also consist of a plurality of web element sections. For example, adjacent web element sections can enclose an angle with respect to one another. It would also be possible for the first web element section and the second web element section to be connected to one another via a curved section, wherein this variant is not shown in the drawing.

According to each of the preceding exemplary embodiments, the web elements can be connected to the jacket element by gluing, soldering, casting, an additive manufacturing method, welding, clamping, shrink-fitting, or combinations thereof. Gluing, soldering, or welding can take place from the inside and/or from the outside. In particular, the jacket element and the web elements can be configured as a single piece.

According to an embodiment, web element passage can be configured in a course without kinks. According to one embodiment, the web element passage can merge into the chamber without kinks.

The web element passages in the web elements extend from the first end to the second end of the web element, which directly adjoins the inner wall of the jacket element. According to one exemplary embodiment, there is an opening in the jacket element which can be configured as an inlet opening or an outlet opening. The opening has at least the same cross-sectional area as the cross-sectional area of the web element passage that adjoins the opening.

At least some of the web elements thus extend over the entire width dimension or the mean diameter of the jacket element. The mean diameter corresponds to the inside diameter of the jacket element if the jacket element is designed as a circular tube. The mean diameter for a square jacket element is defined as its circumference/$\pi$ (pi), thus the diameter is substituted by an equivalent diameter. The length of the web element passage can in particular be at least 10% greater than the mean diameter when the web element passage crosses the central axis. The length of this web element passage can in particular be at least 20% above the mean diameter, particularly preferably at least 30% above the mean diameter.

A web element is determined in terms of its dimensions by its length, width, and thickness. The length of the web element is measured from the first end of the web element to the second end of the web element. The length of the web element passage corresponds essentially to the length of the web element.

The width of the web element is measured essentially transversely to the direction of flow. That is, the width is determined essentially in a plane which extends in a right able with respect to the length of the web element and shows the cross section of the web element. The cross section of the web element is characterized by its width and its thickness. The length of at least the longest web element is at least 5 times as great as its width.

The width of the web element is 0.5 to 5 times as large as its thickness, advantageously 0.75 to 3 times as large as its thickness. If the width of the web element is 1 to 2 times as large as its thickness, a particularly preferred range results for which particularly good transverse mixing can be achieved. The width of the web element is defined as the normal distance which extends from the first edge and the second edge of the web element on the upstream side. The width of the web element on the upstream side can differ from the width measured on the downstream side of the web element.

The term edge is understood to mean the edge of the web element against which the fluid flows and around which it flows, which extends essentially parallel to the length of the web element. The thickness of the web element can be variable. The minimum thickness is less than 75% and advantageously less than 50% below the maximum thickness. The variations can be due, for example, to ribs, indentations, knobs, wedge-shaped webs, or some other unevenness.

The web element can be characterized in that there are planar surfaces, convex or concave surfaces in the direction of flow, which offer a contact surface for the flowing fluid. These surfaces aligned in the direction of flow cause an increased outflow resistance, in particular in comparison with a tubular element, which can result in an improved heat transfer.

The web element passage, which runs in the interior of the web element, preferably has an inside diameter which corresponds to a maximum of 75% of the thickness of the web element. In principle, a plurality of web element passage running essentially parallel can also be contained in a web element.

The transition from at least one of the first and second ends of the web element to the jacket element is advantageously free from gaps. According to one exemplary embodiment, the web elements and the jacket element therefore consist of a single part, which is preferably produced by a casting process. A smooth transition from the web element to the jacket element is characteristic of the property that the transition is free from gaps. In particular, rounded portions can be provided on the edges in the transition region from the web element to the jacket element, so that the flow of the pourable material is not impaired during the manufacturing process.

The web element passages are arranged inside the web elements, so that there is no connection between the passages inside the web elements and the space surrounding the web elements.

A monolithic structure consisting of web element sets arranged at an angle not equal to zero relative to the main direction of flow is manufactured in a casting process, at least in segments, and a jacket element is firmly connected to at least some of the web elements, wherein the jacket element can be configured as a jacket tube. Instead of a casting process, an additive manufacturing process can also be used.

Alternatively, there is also the possibility that the openings of the jacket element match the outer contour of the web element. According to this exemplary embodiment, the web element can be pushed through the opening of the jacket element and positioned in the interior of the jacket element in this way. According to this exemplary embodiment, the web element can be connected to the jacket element by gluing, soldering, welding, clamping, pressing, or shrinking.

The web element passages for the heat transfer fluid in the web elements can be produced by the casting process described earlier or an additive manufacturing method but can also be completed by subsequent processing such as eroding or drilling.

A heat transfer fluid can include any liquid such as water or oils, but also a gas such as air.

The web elements can be arranged at an angle of approximately 25 to 75 degrees, in particular at an angle of approximately 30 to 60 degrees, to the main direction of flow. The web elements can be configured as web element sets, wherein the web elements of each web element set can be arranged parallel to one another. The web elements of a web element set can be arranged in a common web element set plane. According to an embodiment, first and second web element set planes intersect. According to a further exemplary embodiment, a web element of the first web element set adjoins a web element of the second web element set. Adjacent web elements accordingly have a different orientation according to this exemplary embodiment, since they belong to different web element sets.

According to an embodiment, adjacent web elements cross since an improved heat exchange can be obtained in this way. The angle between two intersecting web elements is advantageously 25 to 75 degrees. Any number of elements can be arranged next to one another in a web element set. The web element set is characterized in that the center axes of all the web elements are arranged in the same or essentially the same web element set plane. In particular, 2 to 20 web elements, particularly preferably 4 to 12 web elements, are arranged in parallel in a web element set.

Any number of web element sets can be arranged one behind the other, viewed in the main direction of flow. The web element sets arranged one behind the other are advantageously arranged in such a way that they overlap in order to accommodate as much active heat exchange surface as possible in a small apparatus volume. Overlapping is understood to mean that at least some of the web elements of a first web element set and some of the web elements of a subsequent web element set and/or a preceding web element set are arranged in the same tubular section, viewed in the main direction of flow. The projection of the length of the web element on the longitudinal axis results in a length L1 and the projection of the overlapping part of the web elements of the adjacent web element set on the longitudinal axis results in a length L2, whereby L2 is less than L1 and L2 is greater than 0. The tubular section under consideration is defined in such a way that it has the length L1, that is to say it extends from a centrally arranged web element from its first end to its second end in the projection onto the longitudinal axis.

Since the mixing effect in identically aligned web element sets arranged one behind the other only takes place in one plane, after a certain number of web element sets the alignment can be changed in such a way that the web element sets are advantageously arranged offset from one another. In particular, two up to and including 20 web element sets are provided, particularly preferably 4 up to and including 8 web element sets. The offset between the identically aligned web element sets takes place advantageously at an angle of 80 to 100 degrees. This means that the second web element set is oriented around the longitudinal axis at an angle of 80 to 100 degrees with respect to the first web element set.

In addition to the web element sets of intersecting web elements described above, web element sets containing web elements that only extend from the inner wall of the jacket element to the intersection line with the other web element set can be arranged especially in the end area of identically aligned parallel web element sets. In the following, these web element sets are referred to as half intersecting web element sets. These web element sets lead to an additional increase in mixing performance. The better mixing effect and the additional heat conduction effects of the web element material also increase the heat exchange.

According to an embodiment, the web elements can form a first and a second web element set. Each of the first and second web element sets are arranged in a respective first and second web element set plane. In particular, the first web element set plane of the first web element set can intersect with the second web element set plane of the second web element set in such a way that a common intersection line is formed which has an intersection point with the longitudinal axis or runs essentially transversely to the longitudinal axis and/or in a plane in a right angle with respect to the intersection line, which contains the longitudinal axis or has a minimum distance from the longitudinal axis. According to an embodiment, at least one web element set can be provided, which extends essentially to the intersection line.

The web elements in a first and second web element set can touch one another, or gaps can be provided between these web elements. A connection of the intermediate spaces with connecting webs arranged transversely to the direction of fluid flow is also possible.

It is also possible for heat transfer fluid to flow through different sections or segments of the heat exchanger through separate jacket ducts, so that the heat exchanger contains different sections or segments through which heat transfer fluid can flow at different temperatures. This allows for an individual temperature control in the individual segments. It has been shown that for high heat transfer in a small apparatus volume with jacket element diameters of 60 mm and more, the heat transfer fluid should flow through at least half of all web elements.

It has been shown that a casting process, an additive manufacturing process, a soldering process, an adhesive process, a shrink-fit process, a clamping process and a welding process can be cost-effective manufacturing processes for web elements and a gap-free, monolithic jacket element connected to the web elements. The insert element, comprising the web element sets comprising the corresponding web elements, can be produced in a single piece. Alternatively, the insert element can consist of individual segments that are subsequently connected, for example, by welding or by making use of screwed flange connections or by bracing. Furthermore, the external geometry of the web elements and the web element geometry as well as the geometry of the web element passages can be easily decoupled for the heat transfer fluid both for a welding process and for a casting process. Thus, rectangular profiles can advantageously be used for the outer geometry of the web elements and the geometry of the web element passages can advantageously be configured as a round cross section, in particular a circular or oval cross section. Therefore, web elements with an ideal profile for cross-mixing and/or high inherent strength can be produced for high maximum fluid pressures. It has been shown that the web element passages for the heat transfer fluid in the web elements are advantageously produced after the casting process by erosion and even more advantageously by drilling, so that web also element passages with small diameters can be produced.

It has also been shown that with the web element sets according to the invention and especially with web element sets in which adjacent web elements intersect and/or especially with overlapping web element sets, very good heat transfer and/or mixing performance can be achieved. In particular, the arrangement of a second web element set, which is offset by 80 to 100 degrees from the first web element set, can be beneficial for good heat transfer. Surprisingly, it has also been shown that the attachment of additional chambers and especially in the case of viscous fluids a further improvement in the heat transfer and/or the mixing performance can be achieved.

The heat transfer and/or the mixing performance in the vicinity of the inner wall of the jacket element is also significantly improved by the direct transition of the web elements into the jacket element, since boundary layers of the flowable medium on the inner wall also contribute to achieving an optimal heat transfer or a homogeneous mixture. In particular, not only an optimal renewal of the boundary layers between the fluid and the jacket element, but also between the fluid and the web element surface can be generated. Optimal boundary layer renewal therefore leads to optimal use of the heat exchange surface. The optimal use of the heat exchange surface also means that the heat exchanger can be built for a given cooling or heating task with an even smaller apparatus volume and with a lower pressure loss.

As a consequence of the optimized heat transfer, the heat exchanger according to the invention shows a very narrow residence time spectrum of the flowable medium to be heated or cooled.

This way, deposits or decomposition of the fluid can be prevented in the best possible way. For cooling tasks that involve the cooling of a viscous fluid such as a polymer, a very low melt temperature close to the freezing point can be achieved as a consequence of the optimal renewal of the boundary layers. Thereby, it is in particular prevented that solidified polymer gets deposited on the heat exchange surfaces. The direct transition of the individual web elements into the jacket element and the use of the chambers for the heat transfer fluid over a large area as possible also leads to a stable construction which is also suitable for operation with high fluid operating pressures. As a result, the heat exchanger according to the invention can be made very compact, especially for operation with viscous fluids. The heat exchanger is basically suitable for mixing and cooling or heating any flowable media such as liquids and gases, but especially for viscous and very viscous fluids such as polymers.

The jacket element and the insert element can contain castable or weldable materials, for example metals, ceramics, plastics, or combinations of these materials can be used.

A method for producing a heat exchanger which contains an insert element and a jacket element, the insert element having at least one web element arranged at an angle not equal to zero with respect to the main flow direction and a jacket element firmly connected to the web element comprises the following method steps. The web element and the insert element jacket element are produced by a method involving the use of an adhesive, soldering method, a casting method, an additive manufacturing method, a welding method, a clamping method or a shrinking method or any combination thereof. The web element contains a web element passage which is produced by the casting method or an additive manufacturing method together with the insert jacket element or is produced in a further work step by means of a drilling method or an erosion method.

An intermediate jacket element can also be arranged between the insert element and the jacket element, as described in EP3489603 A1, which contains a first intermediate jacket element channel and a second intermediate jacket element channel, the intermediate jacket element being positioned in the jacket element in such a way and the insert element being positioned in the intermediate jacket element in such a way that the heat transfer fluid can flow from the jacket element channel through the first intermediate jacket element channel into the web element passage, can flow through the web element passage and can flow from the web element passage through the second intermediate jacket element channel into the jacket element channel.

The use of an intermediate jacket element has various advantages. The insert element can thus be made much thinner and lighter. Therefore, a different material, for example a higher quality material, can be used for the insert element than for the intermediate jacket element. In particular, the insert element can contain a material which has a high thermal conductivity or a high resistance to chemicals, for example corrosion resistance. The insert element can be manufactured in one piece together with the web elements by an additive manufacturing method or casting method. Since the production of the insert element is very complex, it can be stored as a semi-finished product and the intermediate jacket element can be adapted to the required wall thickness depending on the application and nominal pressure. The jacket element which surrounds the intermediate jacket element can be designed as a further double jacket through which the heat transfer fluid flows in the operating state. The heat transfer fluid reaches at least one of the web elements through the openings in the jacket element and in the intermediate jacket element as well as in the insert element jacket element, so that it can flow through the web element or the web elements.

The invention is not restricted to the present exemplary embodiments. The web elements can differ in their number and in their dimensions. Furthermore, the number of web element passages in the web elements can differ depending on the required heat for the heat transfer. The angles of inclination that the sets include with respect to the longitudinal axis can also vary depending on the application. More than two insert elements can also be arranged in sequential order.

It is obvious to a person skilled in the art that many further modifications in addition to the exemplary embodiments described are possible without departing from the inventive concept. The subject matter of the invention is therefore not restricted by the preceding description and is determined by the scope of protection which is defined by the claims. The broadest possible reading of the claims is authoritative for the interpretation of the claims or the description. In particular, the terms "contain" or "include" are to be interpreted in such a way that they refer to elements, components or steps in a non-exclusive sense, which is intended to indicate that the elements, components or steps can be present or are used that they can be combined with other elements, components or steps that are not explicitly mentioned. When the claims relate to an element or component from a group which may consist of A, B, C . . . N elements or components, this formulation should be interpreted in such a way that only a single element of that group is required, and not necessarily any combination of A and N, B and N, or any other combination of two or more elements or components of this group.

What is claimed is:

1. A heat exchanger comprising a jacket element and an insert element, the jacket element forming a fluid channel for a fluid, flowable medium or fluid mixture to be tempered, wherein the insert element is arranged in the fluid channel, wherein the insert element contains a plurality of web elements that are connected to the jacket element at different locations, wherein the web elements are arranged in at least two web element sets, the web elements of each web element set being arranged essentially parallel to one another, wherein angles which the web elements of different web element sets enclose with a longitudinal axis of the heat exchanger differ, wherein at least a portion of the web elements contains web element passages which are in fluid-conducting connection with the jacket element, so that in an operating state, a heat transfer fluid, which is fed to the jacket element, can flow through the web elements, wherein the jacket element contains a plurality of chambers for the heat transfer fluid, wherein at least one of the chambers is disposed with a plurality of inlet openings and at least two outlet openings or a plurality of outlet openings and at least two inlet openings for the heat transfer fluid, and wherein at least one of the web elements is provided with a web element passage which does not lead into the chamber.

2. The heat exchanger of claim 1, wherein at least some of the chambers are at least partially separated from one another by partitions.

3. The heat exchanger of claim 1, wherein at least one of the chambers contains a partition.

4. The heat exchanger of claim 1, wherein at least one of the chambers is connected to a further chamber via the web element passages.

5. The heat exchanger of claim 4, wherein at least one of the inlet openings or outlet openings of different chambers are at least partially connected to one another via web elements that run through the fluid channel.

6. The heat exchanger of claim 1, wherein each of the chambers extends over part of a circumference of the jacket element.

7. The heat exchanger of claim 1, wherein a width of the chamber which contains the plurality of inlet openings and the at least two outlet openings is at most equal to their length.

8. The heat exchanger of claim 1, wherein a width of the chamber which contains the plurality of outlet openings and the at least two inlet openings is at most equal to their length.

9. The heat exchanger of claim 1, wherein at least one of the chambers has at least two inlet openings and at least two outlet openings.

10. The heat exchanger of claim 1, wherein at least one of the chambers has at least four inlet openings or at least two outlet openings or wherein at least one of the chambers has at least two inlet openings or has at least four outlet openings.

11. The heat exchanger of claim 1, wherein at least one of the chambers spans at least 10 up to and including 80% of a surface of the jacket element.

12. The heat exchanger of claim 1, wherein at least one of the chambers has a width which is 10% up to and including 100% of a circumference of the jacket element.

13. The heat exchanger of claim 1, wherein the inlet openings and the outlet openings which are located in a same chamber belong at least partially to web elements of different web element sets.

14. A method for tempering a fluid, flowable medium or fluid mixture, wherein the fluid is tempered by a heat exchanger, wherein the heat exchanger comprises a jacket element and an insert element, the fluid flowing in a fluid channel enclosed by the jacket element, wherein the insert element is arranged in the fluid channel, wherein the insert element contains a plurality of web elements, which are connected to the jacket element at different locations, wherein the web elements are arranged in at least two web element sets, the web elements of each web element set being arranged essentially parallel to one another, wherein angles which the web elements of different web element sets enclose with a longitudinal axis of the heat exchanger differ, wherein at least some of the web elements contain web element passages which are in fluid-conducting connection with the jacket element, so that in an operating state, a heat transfer fluid which is supplied to the jacket element can flow through the web elements, wherein the jacket element comprises a plurality of chambers for the heat transfer fluid, wherein at least one of the chambers has a plurality of inlet openings and outlet openings for the heat transfer fluid, and wherein at least one of the web elements is provided with a web element passage which does not lead into the chamber.

15. The method of claim 14, wherein at least one of the inlet openings or outlet openings of different chambers are connected to one another via web elements that run through the fluid channel, so that a heat transfer between the heat transfer fluid and the fluid takes place via an inner wall of the jacket element and the web elements when the heat transfer fluid flows through the chambers and web elements.

16. The method of claim 14, wherein the heat transfer fluid flows through at least one of the chambers or the web element passages in a direction of flow of the fluid or against the direction of flow of the fluid or transversely to the direction of flow of the fluid.

17. The method of claim 14, wherein the heat transfer fluid flows from an outlet opening of one of the chambers to an inlet opening in one of the other chambers through one of the web element passages which is arranged in one of the web elements which is arranged in the fluid channel, so that the heat transfer fluid can flow through a plurality of the chambers sequentially.

18. The method of claim 14, wherein at least one of the inlet openings and one of the outlet openings in at least one of the chambers is arranged such that the heat transfer fluid flows in the chamber in a direction transverse to a main direction of flow of the fluid, wherein the main direction of flow of the fluid corresponds to the longitudinal axis of the heat exchanger.

19. A heat exchanger comprising a jacket element and an insert element, the jacket element forming a fluid channel for a fluid, flowable medium or fluid mixture to be tempered, wherein the insert element is arranged in the fluid channel, wherein the insert element contains a plurality of web elements that are connected to the jacket element at different locations, wherein the web elements are arranged in at least two web element sets, the web elements of each web element set being arranged essentially parallel to one another, wherein angles which the web elements of different web element sets enclose with a longitudinal axis of the heat exchanger differ, wherein at least a portion of the web elements contains web element passages which are in fluid-conducting connection with the jacket element, so that in an operating state, a heat transfer fluid, which is fed to the jacket element, can flow through the web elements, wherein the jacket element contains a plurality of chambers for the heat transfer fluid, wherein at least one of the chambers is disposed with a plurality of inlet openings and at least two outlet openings or a plurality of outlet openings and at least two inlet openings for the heat transfer fluid, and wherein at least one of the web elements is provided with a web element passage which does not lead out of the chamber.

* * * * *